US009630076B2

(12) United States Patent
Evans

(10) Patent No.: US 9,630,076 B2
(45) Date of Patent: Apr. 25, 2017

(54) PROJECTILE AND THROWING APPARATUS AND GAME FOR PROJECTILE THROWING

(71) Applicant: Curtis Alan Evans, Springfield, VA (US)

(72) Inventor: Curtis Alan Evans, Springfield, VA (US)

( * ) Notice: Subject to any disclaimer, the term of this patent is extended or adjusted under 35 U.S.C. 154(b) by 0 days.

(21) Appl. No.: 14/677,045

(22) Filed: Apr. 2, 2015

(65) Prior Publication Data

US 2015/0297964 A1 Oct. 22, 2015

Related U.S. Application Data

(63) Continuation of application No. 13/779,676, filed on Feb. 27, 2013, now Pat. No. 9,149,695.
(Continued)

(51) Int. Cl.
*A63B 59/00* (2015.01)
*A63B 65/12* (2006.01)
(Continued)

(52) U.S. Cl.
CPC ..... *A63B 59/20* (2015.10); *A63B 37/001* (2013.01); *A63B 37/0003* (2013.01);
(Continued)

(58) Field of Classification Search
CPC ..... A63B 2102/32; A63B 59/20; A63B 60/52; A63B 67/002; A63B 65/122
(Continued)

(56) References Cited

U.S. PATENT DOCUMENTS 1,022,186 A * 4/1912 Engler ..... A63B 59/20 473/509
1,585,446 A * 5/1926 Warwick ..... A63B 59/20 124/5
(Continued)

FOREIGN PATENT DOCUMENTS

DE 7608267 3/1976
DE 102010017079 12/2011
(Continued)

OTHER PUBLICATIONS

"Hyper Dog Doggie Driver product description sheet", Dec. 12, 2006, 3 pages, http://entirelypets.com/doggiedriver.html.
(Continued)

*Primary Examiner* — Alexander Niconovich
(74) *Attorney, Agent, or Firm* — Michael Haynes PLC; Michael N. Haynes

(57) ABSTRACT

An improved projectile throwing apparatus is described comprising a handle, an elongate shaft, and a throwing head for throwing a projectile, such as a golf ball. The throwing head may be interchangeable with golf shafts of varied lengths, with lacrosse shafts, or other shafts to achieve accurate, long distance golf ball throws. The throwing head may be shaped to achieve throws of different distance, launch angle, and trajectory, optionally imparting spin with a retrograde ramp at the distal end of the throwing head. The throwing apparatus is useful for golf-type game play, including for those with physical disabilities, as well as for a training and instructional aid for golf, lacrosse, and other sports.

23 Claims, 81 Drawing Sheets

Related U.S. Application Data

(60) Provisional application No. 61/604,176, filed on Feb. 28, 2012.

(51) Int. Cl.

| | |
|---|---|
| ***A63B 69/36*** | (2006.01) |
| ***F41B 3/04*** | (2006.01) |
| ***A63B 59/20*** | (2015.01) |
| ***A63B 37/00*** | (2006.01) |
| ***A63B 43/00*** | (2006.01) |
| ***A63B 67/183*** | (2016.01) |
| *A63B 67/00* | (2006.01) |
| *A63B 67/18* | (2016.01) |
| *A63B 71/00* | (2006.01) |
| *A63B 102/32* | (2015.01) |
| *A63B 60/10* | (2015.01) |
| *A63B 102/14* | (2015.01) |
| *A63B 60/06* | (2015.01) |
| *A63B 60/08* | (2015.01) |

(52) U.S. Cl.
CPC ..... *A63B 37/0004* (2013.01); *A63B 37/0011* (2013.01); *A63B 37/0022* (2013.01); *A63B 43/002* (2013.01); *A63B 65/122* (2013.01); *A63B 67/183* (2016.01); *F41B 3/04* (2013.01); *A63B 43/008* (2013.01); *A63B 60/06* (2015.10); *A63B 60/08* (2015.10); *A63B 60/10* (2015.10); *A63B 67/002* (2013.01); *A63B 67/18* (2013.01); *A63B 71/0009* (2013.01); *A63B 2102/14* (2015.10); *A63B 2102/32* (2015.10); *A63B 2210/50* (2013.01)

(58) Field of Classification Search
USPC ..... 124/5; 473/235, 505, 509, 510, 513
See application file for complete search history.

(56) References Cited

U.S. PATENT DOCUMENTS 1,877,820 A * 9/1932 Costello ..... A63B 69/3632 473/235
1,905,932 A 4/1933 Foster
2,025,995 A * 12/1935 Lerch ..... A63B 59/20 473/509
2,029,790 A * 2/1936 Bernhard ..... A63B 59/20 473/513
2,075,372 A * 3/1937 Taylor ..... A63B 59/20 473/513
2,094,766 A * 10/1937 Costello ..... A63B 69/3632 473/138
2,179,034 A 11/1939 Duncan, Jr.
2,710,753 A * 6/1955 Lockwood ..... A63B 59/20 124/5
2,856,190 A 10/1958 Quattrin
2,935,323 A * 5/1960 Cummings ..... A63B 47/02 273/129 R
3,170,688 A 2/1965 Porter
3,366,389 A 1/1968 Murray
3,392,978 A * 7/1968 Wiest, Jr. ..... A63B 67/083 473/509
3,586,329 A * 6/1971 Spreitzer ..... A63B 67/083 273/109
3,589,349 A 6/1971 Parker
3,970,307 A 7/1976 Breglia
4,045,026 A * 8/1977 Gillespie ..... A63B 59/20 124/5
4,085,936 A 4/1978 Patterson
4,111,422 A 9/1978 Burcenski
4,157,828 A * 6/1979 Cosmopulos ..... A63B 59/30 124/5
4,273,339 A * 6/1981 Fortunato ..... A63B 59/20 473/513
4,313,605 A 2/1982 Stokes et al.
4,364,371 A 12/1982 Woolard
4,502,690 A * 3/1985 Ruperto ..... A63B 59/20 473/513
4,527,801 A 7/1985 Lambert
4,548,413 A * 10/1985 David ..... A63B 59/00 124/5
4,595,205 A * 6/1986 Ruperto ..... A63B 59/20 473/513
4,673,186 A 6/1987 Walker
4,677,961 A * 7/1987 Allison ..... F41J 9/28 124/5
4,752,076 A * 6/1988 Gelinas, Jr. ..... A63B 59/20 273/109
4,794,905 A 1/1989 Woolard
5,088,469 A 2/1992 Hargrave
5,129,650 A 7/1992 Hayman
5,228,689 A 7/1993 Donofrio, Sr.
5,290,039 A * 3/1994 Cornelio ..... A63B 59/20 473/513
5,297,794 A 3/1994 Lu
5,392,755 A 2/1995 Sutton
D363,960 S 11/1995 Choi
5,522,372 A 6/1996 Gerstikov
5,908,360 A 6/1999 Guillont
5,935,016 A 8/1999 Antonious
D424,640 S 5/2000 Oblack
6,066,056 A 5/2000 Morrow
6,076,829 A 6/2000 Oblack
6,083,128 A 7/2000 Young et al.
6,241,629 B1 * 6/2001 Otto ..... A63B 69/0002 124/5
6,565,280 B1 5/2003 Post
D484,938 S 1/2004 Tu
6,837,800 B2 1/2005 Rollinson et al.
7,032,583 B1 * 4/2006 Hall ..... A63B 59/20 124/5
7,121,966 B2 * 10/2006 Fitzmaurice ..... A63B 59/00 473/559
7,128,556 B2 10/2006 Wessells et al.
7,172,513 B1 2/2007 Rinker
D554,717 S 11/2007 McKinnell
7,357,739 B2 * 4/2008 Montano ..... A63B 59/20 473/513
7,520,818 B2 4/2009 Winchester
7,520,828 B2 4/2009 Tucker
7,648,433 B1 * 1/2010 Huqueriza ..... A63B 67/002 473/505
7,665,454 B1 * 2/2010 D'Agostino ..... F41B 3/04 124/5
7,677,994 B2 3/2010 Matsumoto et al.
7,686,001 B2 3/2010 Fitt
7,686,702 B2 3/2010 Hubley
7,900,617 B1 * 3/2011 Kersh ..... F41J 9/30 124/5
D637,248 S 5/2011 Levin et al.
7,935,009 B2 5/2011 Mullin
D640,338 S 6/2011 Oblack
7,988,567 B2 8/2011 Kim et al.
8,015,968 B2 * 9/2011 Christ ..... A63B 65/00 124/5
8,028,684 B1 10/2011 Weissmann et al.
D655,359 S 3/2012 Thorogood
8,246,480 B2 8/2012 Parks et al.
D666,686 S 9/2012 Burger
8,302,585 B2 * 11/2012 Fitzgerald ..... A63B 59/20 124/5
D674,851 S 1/2013 Osborne et al.
8,353,780 B2 1/2013 Halton et al.
8,387,601 B1 3/2013 Christensen
8,418,681 B2 4/2013 Levin et al.
8,454,452 B2 6/2013 Wallans
8,517,003 B2 8/2013 Fisher
8,539,939 B2 9/2013 Minneman et al.
9,149,695 B2 * 10/2015 Evans ..... A63B 65/122
2002/0160851 A1 10/2002 Liao

(56) References Cited

U.S. PATENT DOCUMENTS

| | | | | |
|---|---|---|---|---|
| 2003/0045200 | A1 | 3/2003 | Tarng et al. | |
| 2005/0070367 | A1* | 3/2005 | Pickering | A63B 69/3632 473/219 |
| 2006/0229136 | A1* | 10/2006 | Presley | A63B 63/00 473/157 |
| 2008/0127955 | A1 | 6/2008 | Christ | |
| 2009/0075765 | A1* | 3/2009 | Eldridge | A63B 59/20 473/513 |
| 2010/0242938 | A1* | 9/2010 | Fitzgerald | F41B 3/04 124/5 |
| 2011/0017184 | A1 | 1/2011 | Henry | |
| 2011/0100345 | A1 | 5/2011 | Minneman et al. | |
| 2011/0230275 | A1 | 9/2011 | Hicks | |
| 2011/0275454 | A1 | 11/2011 | Stites et al. | |
| 2012/0048251 | A1 | 3/2012 | Oblack et al. | |
| 2012/0142446 | A1 | 6/2012 | Evans et al. | |
| 2012/0227721 | A1 | 9/2012 | Geller | |
| 2012/0231896 | A1 | 9/2012 | Seluga et al. | |
| 2012/0312286 | A1 | 12/2012 | Kilian | |
| 2013/0085010 | A1 | 4/2013 | Beach et al. | |
| 2013/0118464 | A1 | 5/2013 | Laporte | |
| 2013/0130820 | A1 | 5/2013 | Parks | |
| 2013/0167818 | A1* | 7/2013 | Ivanic | A63B 65/122 124/5 |
| 2013/0186381 | A1 | 7/2013 | Hansen | |
| 2013/0274036 | A1* | 10/2013 | Spiegel | A63B 59/02 473/513 |
| 2013/0319386 | A1 | 12/2013 | Minneman et al. | |
| 2014/0041188 | A1 | 2/2014 | Radocy | |
| 2015/0007803 | A1* | 1/2015 | Van Alen | A63B 59/02 124/5 |
| 2015/0018129 | A1* | 1/2015 | Van Alen | A63B 67/02 473/409 |
| 2015/0297964 | A1* | 10/2015 | Evans | A63B 65/122 473/513 |

FOREIGN PATENT DOCUMENTS

| | | |
|---|---|---|
| FR | 2633190 | 12/1989 |
| GB | 191207813 | 0/1912 |
| GB | 2385537 | 8/2003 |
| WO | WO2006/108274 | 10/2006 |

OTHER PUBLICATIONS

"The Lacrosse Lover's Dog Ball Thrower", Jun. 1, 2011, 2 pages, http://www.bigappleherp.com/Hyper-Dog-Lacrosse-Thrower-Toy.

* cited by examiner

PROJECTILE AND THROWING APPARATUS AND GAME FOR PROJECTILE THROWING

CROSS REFERENCE TO RELATED APPLICATIONS

The present application claims the benefit of priority of U.S. Provisional Patent Application No. 61/604,176, entitled "PROJECTILE AND THROWING APPARATUS AND GAME FOR PROJECTILE THROWING," which is herein incorporated by reference in its entirety.

BACKGROUND OF THE INVENTION

Jai alai is a game played with a long curved wicker basket strapped to the wrist of a player, sometimes called a cesta or a xistera. The basket is used to catch and hurl a ball against a wall to make it rebound in such a way that an opponent cannot return it before it bounces more than once. The jai alai basket is an expensive, hand crafted device requiring a great deal of skill to use. It takes years of training to learn how to skillfully use a jai alai basket because it is difficult to control the flight of the ball when it is thrown with the basket. This is due to the fact that the basket provides no set path for the ball and no direct means for putting a spin on the ball. Thus, unlike a baseball pitcher who imparts spin to a ball and is able to control the path of a ball with his fingers immediately prior to its release, the jai alai player must rely on centrifugal force and a snap of his wrist to control the path of the ball. Thus it is extremely difficult to control topspin, backspin, or sidespin or to throw a curve, sinker, or knuckle ball with a jai alai basket.

Jai alai is a game played in an open-walled semi-enclosed court of predetermined dimensions, and the ball speed can reach 150 miles per hour when thrown by a relatively low population of extremely skilled professional athletes. Even so, the ball is not intended to travel long distances, but rather it is intended to fly to a portion of the playing court quickly before an opposing player can catch the ball, return it to impact the front wall of the court, and continue play.

Another game utilizing a basket or scoop-like device for catching and throwing a ball is lacrosse. The lacrosse stick, also known as a crosse, is a long-handled meshed scoop.

The lacrosse stick suffers from some of the same disadvantages as the jai alai basket. A typical lacrosse head is commonly strung with a webbed rope-type catching basket (i.e. of nylon or leather strings or webs), intended to change shape and help cradle the lacrosse ball when it is caught. The webbed rope-type catching basket is also necessary to absorb energy when a ball is caught. The typical lacrosse head, for example one governed by NCAA rules, must range from 6-10 inches in width for an attacker or defender, to 10-12 inches for a goalie's lacrosse head. It is difficult to control the path of a thrown ball from a webbed lacrosse pocket and takes years of practice to become proficient at throwing the lacrosse ball from the webbed pocket. Professional lacrosse players, however, can shoot the lacrosse ball over 100 mph.

Toy makers have sought to capitalize on the popularity of lacrosse and jai alai by manufacturing baskets or scoops patterned after the jai alai basket. One example is a molded polyethylene scoop with a shape comparable to that of the jai alai basket. The scoop has a hollow, cylindrical handle. The front of the scoop is open for catching and throwing balls. The back and sides of the scoop are completely solid. The portion of the scoop near the handle is generally bowl-shaped so that it is possible to hold projectiles in it while running. Like jai alai and lacrosse baskets, it is difficult to control the path of a projectile thrown by the toy.

Another feature of these toys is that they are adapted for catching a thrown ball or projectile, requiring that the width of the scoop or basket be sufficiently wide to allow the user to catch the projectile with only a reasonable level of skill.

Games like lacrosse and recreational throwing games are characterized by low projectile speed, relatively short ball travel distances, throwing the ball at another human being guarding the goal, and team play that requires both throwing and catching the projectile.

Other children's toys have been developed for playing catch with lightweight, softball-sized hollow plastic balls or foam or polystyrene balls. These recreational children's toys and throwing implements are intended for throws typically in the distances of 5 to 25 yards.

One such throwing and catching toy is described in U.S. Pat. No. 4,045,026. The company Wham-O, Inc., selling the toy under the trade name "TracBall," manufactures a thermoplastic molded scoop and basket implement for throwing a lightweight hollow ball at slow speed to be caught by another player holding the same throwing and catching toy.

Much differently, golf is a sport of great history, where a golf ball is struck rather than thrown. It continues to gain in popularity, as the number of courses has increased, and as equipment advances have been made. Some of those advances include graphite and composite shaft construction, large-head metal drivers making it easier for amateur players to drive the golf ball longer and straighter from the tee with greater frequency, and better golf balls, both in material of construction and dimple shape, size, patterns and distribution. Golf became more exciting for the amateur when he could regularly drive the ball over 150-200 yards. Not only does a long drive put the player in the position to achieve a lower score by reducing the number of strokes to put the ball on the green and into the hole, but a long ball flight is simply exciting for the player. Some amateur players achieve catharsis with long drives, even if the remainder of their game, and score, remains poor. Long drives are themselves the source of competition and have spurred increased driver sales.

Nevertheless, in trying to drive the ball long distances or in striking the ball from the ground with another club, the golf player often swings too hard, unintentionally deviating from the mechanics of an efficient swing and imparting unwanted side spin on the ball, resulting in hooks and slices and unpredictable and uncontrolled ball flight. Only players with experience and high levels of skill can predictably and repeatedly impart the ball spin they desire, and they use it within their game to shape the trajectory of their shots to achieve lower scores. A controlled backspin, draw or fade allows the professional to use golf course contour to place the ball in the best position for the next shot. For the typical golfer, the result of uncontrolled spin can be lost balls, higher scores, frustration, a slower pace of play, and discontent with the game.

Despite its popularity, golf remains expensive and time consuming to learn. The equipment can become costly. The cost to play a round of golf, greens fees and golf cart rental can be high, with golfers being willing to pay higher prices for well maintained courses, as the quality of the golf course turf can greatly affect the enjoyment of the game since the ball is hit from the ground. Within the golf market, there is a need for training devices to help the player achieve a higher level of competence by developing a better swing or by achieving a marginal level of increased proficiency over competitors.

Golf ball flight is a function of club head speed, launch angle, ball spin, wind speed and direction, golf ball weight and surface condition (e.g. the size, shape, and pattern of dimples, affecting the fluid dynamics of the air flowing around the ball in flight), golf ball COR ("coefficient of restitution," or ability to store and release the energy imparted upon it by the face of the golf club), and golf club head Moment of Inertia (e.g. "MOI," the measure of rigidity of the club, affecting the amount of energy able to be imparted to the golf ball for the duration of impact, ultimately affecting the launch speed of the golf ball projectile), and ultimately ball speed at launch. The United States Golf Association (USGA) sets restrictions on the weight and size of the golf ball. Under present rules, the weight of the ball should not exceed 1.620 ounces (0.04593 kg) and must have a diameter of at least 1.680 inches. The association also regulated the coefficient of restitution (COR) of the driver and the ball. The upper limit for a driver is approximately 0.83, and golf balls typically have a COR of about 0.78. This means that if a golf ball strikes a solid surface at a speed of 10 m/s it must rebound at a speed of no more than 7.8 m/s.

A professional golfer may achieve golf club head speed of around 100 mph, with golf ball speed after impact being 150-165 mph when hit with a modern driver. Top professionals occasionally produce club head speed of 125 mph and golf ball speed of 180 mph. The fastest ball golf ball speed recorded by a "long drive" specialist with a longer than normal golf club shaft is about 205 mph. As an approximation, a 100 mph club head speed causes the ball to leave the club head at 140 mph and at about 50-60 rotations per second. A driver might have a launch angle of 12 degrees, whereas a lob wedge might have a launch angle of 60 degrees or more and be used for shots of shorter length or higher trajectory. In sum, a golf shot is an inefficient way to impart energy to a projectile, and golf club physical properties are highly regulated (e.g. MOI, a physical volume limit of 460 cc, regulations on the shape and depth of grooves on the face of the club, and so on). The result is that a golf club has a small "sweet spot" that must be hit in order to transmit the maximum amount of energy to the ball, and it is difficult to do by an amateur, particularly from an irregular ground surface like deep grass. Several means are available to affix golf club heads to shafts.

Further, the golf swing requires a two-handed grip upon the golf club and an amount of rotation about the spine. For some, back problems, muscular problems, or skeletal or other health problems or disabilities may make a golf swing uncomfortable, painful, or impossible. For some, this means abandoning the game of golf, which can be difficult to do, or not being able to play at all.

Though adaptive golf carts and motorized chairs and posture enhancing devices have been developed for physically challenged golfers, sometimes costing tens of thousands of dollars, their use is premised on the need to execute a golf swing to strike the ball from the ground. A seated player may have difficulty executing the golf swing while avoiding contact with the knees, and there exists a long felt need for improved sporting goods equipment for these athletes.

SUMMARY OF THE INVENTION

In order to overcome the disadvantages of the above games, toys and devices, what is disclosed is a projectile, an improved apparatus for throwing a projectile and a golf-like game that can be played using the improved throwing apparatus and projectile. The game of "throw golf" may be played on golf courses, and other fields of play, by using the improved throwing apparatus to advance the ball, rather than by striking the ball with a golf club.

An improved projectile throwing apparatus is described comprising a handle, an elongate shaft, and a throwing head for throwing a projectile, such as a golf ball. The throwing head may be interchangeable with golf shafts of varied lengths, with lacrosse shafts, or other shafts to achieve accurate, long distance golf ball throws. The throwing head may be shaped to achieve throws of different distance, launch angle, and trajectory, optionally imparting spin with a retrograde ramp at the distal end of the throwing head. The throwing apparatus is useful for golf-type game play, including for those with physical disabilities, as well as for a training and instructional aid for golf, lacrosse, and other sports.

DETAILED DESCRIPTION OF THE INVENTION

Figure 1A:
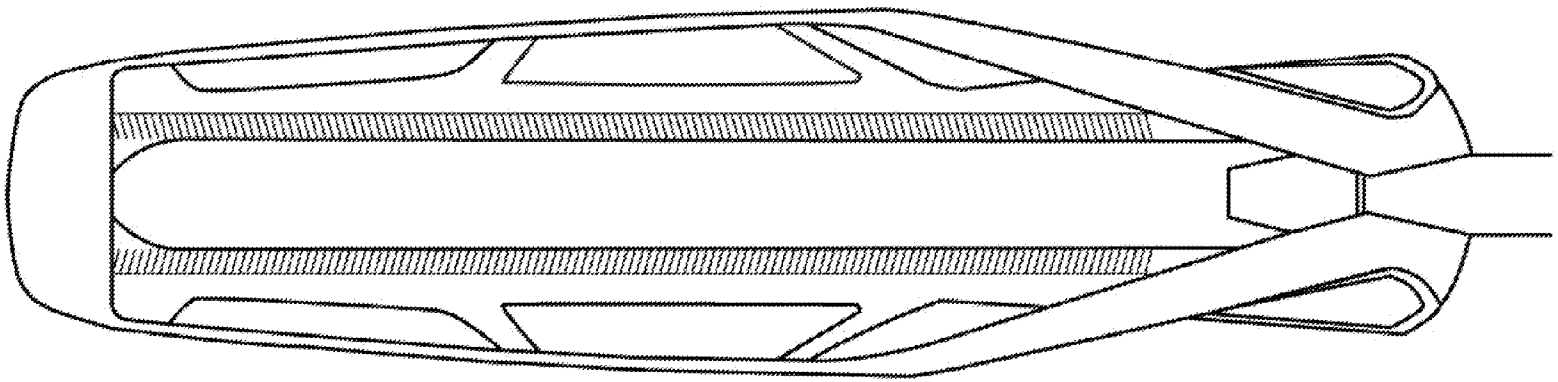
FIG. 1A illustrates a front view of an embodiment of a throwing head.

The throwing apparatus comprises a handle, an elongate shaft, a head connector, and a throwing head.

In one embodiment, a golf shaft is equipped with a grip or handle. The grip may be a standard golf grip, or it may be sized to approximate a tennis racquet handle, a racquetball racquet handle, or a baseball bat grip. Grips of this type may be commercially available as golf grips or oversized golf grips that have been used in varied golf putter configurations. The handle or grip may also include a retaining wrist lanyard, to prevent the throwing apparatus from accidentally being released by the thrower. The lanyard may also allow the thrower to alter grip pressure without fear of inadvertent release of the throwing apparatus.

The shaft connects the handle to the throwing head. Exemplary shaft configurations include a golf club shaft (such as those being constructed of steel, graphite, carbon fiber, composite fibers, or the like), a lacrosse shaft (typically 35-72 inches in length, but optionally shorter, and made of any suitable material including composite, metal or metal alloy, wood, aluminum, scandium, titanium, vanadium, or similar), a composite hockey stick shaft, or other shafts constructed of fiberglass, carbon fiber, plastic, wood, metal or metal alloy (for example aluminum, scandium, titanium, vanadium) or composite (for example as utilized in construction of tennis racquets or racquetball racquets).

The length of the shaft may be varied depending upon the shot or throw to be made by the player. For example, one length shaft may be selected for throws of longest distance (e.g. a throw from a tee box, akin to the use of a driver in golf to strike the ball the longest distance possible) while retaining an acceptable level of repeatability and control. An approximate "driver-type" shaft for long throws may have a length of between 24 inches and 72 inches.

Shorter shaft lengths may be used with a throwing head either for shorter throw distances, or for throws that require the player to impart special ball spin characteristics to play the ball as he desires. For example, the shaft may be very nearly located to the throwing head, in lengths of 6 inches to 24 inches. Specialty throwing apparatuses (or "clubs") may be designed for special throws, and each may be used with a different throwing method. For instance, a short shaft with a throwing head may be employed with an underhanded throw to impart topspin on the ball, for the purpose of having the ball achieve a trajectory that at its termination is nearly vertical, causing the ball to land and stop very near its intended target without any roll. Contrarily, the throwing apparatus may be deployed with a long shaft and an overhand throwing method to impart backspin and a ball trajectory that ensures the longest throw distance possible.

Shafts may be varied in material of construction to affect stiffness. The shaft may range from being completely rigid, meaning that the shaft undergoes no deformation when leverage is applied to the handle during the throwing motion, to flexible, meaning that the shaft undergoes substantial deformation when leverage is applied to the handle during the throwing motion, as one may experience in using a fishing pole to cast bait. A shaft with excessive flexibility is undesirable and may cause unpredictable throw lengths, ball trajectories and ball spins.

The shaft is integrally formed with or connected to the handle. At the end of the shaft opposing the handle, the throwing head is attached by a head connector. The head connector may be glue, adhesive, epoxy, threads and grooves, locking connectors, or any other means for securely attaching the throwing head to the shaft. Head connectors are often used in golf club manufacture. In one embodiment, the head connector is, as used in the manufacture of golf clubs, a rod shaped adapter, one end of which is semi-permanently adhered to the shaft (using either the inner diameter or the outer diameter), and the other end being threaded to accept and engage a correspondingly threaded portion of the throwing head or to accept a restraining bolt. In this embodiment, the throwing head can be attached and detached with relative ease, for example by being screwed on by use of the mating threads, making one throwing head adapted for use with a number of different shafts. Twist and lock fasteners may also be used, making attaching and detaching the throwing head quick and easy, yet providing a safe and secure connection with reduced risk of the throwing head inadvertently detaching from the throwing head.

The shaft may be longitudinally aligned with the handle, or some applications might require the handle not to be longitudinally aligned with the shaft but to be angled, thereby affecting the relationship between the handle and the trajectory imparted by the throwing head. Altering this launch angle by the handle-shaft alignment is similar to a golfer's selection of clubs with different lofts and lie for different types of shots and ball trajectory and spin, or to match the user's swinging mechanics or characteristics. Similarly, part of the shaft may be longitudinally aligned with the handle, with part of the shaft not longitudinally aligned with the handle. That is, the shaft need not be linearly constructed, but may itself have kinks, bends or angles (including adjustable ones), suited for use with different throwing heads, ultimately affecting the trajectory and spin of the projectile.

In another embodiment, the shaft is configured to impart one level of stiffness in the throwing plane without affecting stiffness in planes other than the throwing pane. This may be achieved by physical manufacture of the shaft itself (for example by material or physical dimension of the shaft), or by adjustments upon the shaft that allow the user to alter or adjust the stiffness of the shaft within the throwing plane. Implements may be used within the throwing apparatus or with the shaft to alter its stiffness within the throwing plane, such as springs, elasticized rings, strings and rods in tension, magnets, pulleys, cams, magneto-rheological fluids (MRFs), electro-rheological fluids (ERFs) and the like. These implements may be deployed to allow the user to impart and store energy within the shaft, handle, or throwing head for the purpose of efficiently releasing the energy back into the projectile at time of launch.

The throwing head, not being adapted to catch a ball, is shaped to cradle a throwing projectile, such as a golf ball or specialty ball adapted for play on a particular course. In one embodiment, the throwing head comprises 1) a proximal end, at which is located A) a means for connecting to the shaft, and B) a projectile retainer, for example configured as a ball pocket shaped to cradle a golf ball and retain it until a throw is performed; 2) a distal end, from which the projectile is optimally launched; and 3) a throwing head ramp defined between the proximal end and the distal end.

The means for connecting to the shaft, like the head connector, may comprise a female threaded cylindrical orifice adapted to engage the male threaded end of an adapter connected to the shaft; a male threaded end to engage a corresponding female threaded adapter connected to the shaft; a throat portion having an orifice of octagonal cross section adapted to receive a lacrosse shaft (or a throat portion with orifice adapted to receive any of the common cross sectionally-dimensioned lacrosse shafts, such as circular, oval, hexagonal, flipgrip, triax, concave octagon, and powergrip; and wherein the orifice is optimally configured to engage 1 or more inches of the lacrosse shaft); a through hole to accept a threaded restraining bolt which mates with a female threaded adapter connected to the shaft; or any other means to connect the throwing head to the shaft.

The projectile retainer may comprise a cup, a pocket, an elasticized restraint, an elasticized restraint ring, or other means to release the ball at the correct time within the throwing motion to cause it to begin travel to the distal end of the throwing head. Optionally, the projectile retainer comprises a spring or spring finger to use tension and friction upon the ball to hold the ball in place throughout the beginning of the throwing motion but to release the ball into the throwing head ramp to complete the throw. Additionally, a trigger may be utilized in conjunction with the projectile retainer, causing the projectile to launch at the proper time within the throwing motion. For example, the trigger may connect to the spring finger and when activated cause the spring finger to release its pressure on the projectile.

Between the proximal end and the distal end of the throwing head is configured a throwing head ramp. The throwing head ramp is configured such that the projectile, e.g. a golf ball, initially seats within the projectile retention area and then rolls, slides or travels the distance of the throwing head during throwing motion until the projectile reaches and is launched at the distal end of the throwing head. The throwing head ramp may be shaped with a retrograde terminus, intended to impart spin to the ball as it is launched from the throwing head. In some embodiments, the retrograde terminus is adjustable. Preferably, the throwing head ramp is constructed of solid material other than rope, webbing, or leather strings.

In an embodiment, the throwing head ramp comprises a friction-based engager that affects the level to which the projectile must roll as opposed to sliding along the dimension of the throwing head ramp. For example, the friction-based engager may be grooves, sandpaper, rubber, elastomer, plastic, serrations, indents, leather, coarse surface, silicone, teeth, gears, or a track (or two substantially parallel tracks), or a combination thereof, along which the spherical projectile rolls.

If a golf ball is used as the projectile, and if the throwing head ramp comprises a grooved or serrated ramp or track, the golf ball and throwing head ramp may produce a sound at launch, such as a zip, whiz, or whirl. This sound at launch may be altered by the material of construction of the throwing head. The sound at launch may be pleasing to the user and may be used to indicate a properly executed throw, just as a seasoned golfer may listen for the "ping" of a golf ball when struck properly by the "sweet spot" of a metal driver, a sound which alone spurred unexpected sales of metal drivers as they displaced wooden drivers and a sound which continues to influence golfers' preferences of golf clubs and varied brands.

The friction-based engager may also be configured to correspond to the surface of the projectile. In this embodiment, the friction-based engager may be a parallel track with gear-type serrations, and the projectile may have corresponding surface treatment to mate with the gear-type serrations, such that the ball rolls along the throwing head ramp without slipping, or with reduced slipping. This roll along the throwing head ramp without slipping causes the ball to engage the retrograde terminus, allowing it to impart a level of spin that would not be available if the ball slid or slipped at the retrograde terminus. A friction friction-based engager of this type allows precise, repeatable and predictable spins to be imparted to the projectile, and it may stabilize the projectile in flight, as would rifling within the barrel of a firearm.

In one embodiment, the throwing head is adapted and sized to throw a golf ball, or one of the many similarly sized balls used to practice golf and sized equivalently. In other embodiments, the throwing head may be adapted and sized to throw a baseball or a tennis ball or other specialty ball. In another embodiment, the projectile is a golf-ball sized ball with trailing stabilizing fins or fletching attachments. The trailing stabilizing fins or fletching attachments may be secured directly to the ball, or they may be attached to an archery arrow-type rod, which is secured onto or into the ball. An archery arrow segment may be lightweight and of strong construction, being constructed of carbon, composite, or any material suitable for archery arrows. For a projectile with trailing stabilizing fins or fletching attachments, the throwing head may be shaped to cradle the projectile and release it within the throwing motion without the projectile rolling, and optionally imparting a spiral release. In another embodiment, the projectile is a ball where the weight is concentrated about an axis of the ball to encourage rotation about that axis.

An adapter may also be used to connect the throwing head to the shaft. If, for example, one has purchased a throwing head that was designed for attachment to a golf shaft, but intends to use the throwing head with a lacrosse shaft, a short adapter, for example gender changing-type adapter, may be used with the lacrosse head mount on one end and the golf shaft mount on the other. Similar adapters may be fashioned for golf shafts, lacrosse shafts, composite hockey stick shafts, and so on.

In another embodiment, the means for connecting to the shaft is a quick-release mechanism for quickly and easily removing one throwing head and replacing it with another. Examples include a spring and post detent, a forked adapter with corresponding fork adapter receiver, a twist and lock detent (an example of which may be found in mounts for connecting a sound suppressor to the barrel of a firearm), a ball bearing and sleeve (an example of which may be found in hose connectors), a spring connecting arm with locking restraint (an example of which may be found in a locking carabiner used for rock climbing), and so on.

In another embodiment, the throwing head is constructed of metal (aluminum, steel, titanium, scandium, vanadium, or other suitable metal or alloy characterized by strength and relative light weight), composite, carbon fiber, plastic, fiberglass, Kevlar, elastomer, or combination or any similar material or materials. Since the projectile and the throwing head are accelerated at the end of the shaft, the optimal head reduces mass to the greatest extent possible. The throwing head may also have its constituent parts shaped to be as wind resistant as possible.

In the motion of throwing, the shaft of the throwing apparatus defines a throwing plane. Very simply, one may envision the spoke of a bicycle as it travels with respect to the wheel's hub. In the throwing motion, the thrower's hand may be thought of as the hub or point around which the shaft of the throwing apparatus rotates. During throwing motion, the shaft travels at an angular velocity with a corresponding linear velocity at the throwing head. Using simple math, the player must match an angular velocity and throwing apparatus length (or radius) to impart the desired launch speed of the projectile, as well as the launch angle. As the shaft scribes a throwing arc and defines the throwing plane, the projectile must be launched at the correct time to create the desired projectile launch angle. The throwing head is shaped to allow the thrower to launch the projectile at a desired launch angle, theta. With the throwing apparatus, and the skill of the user, the projectile may be easily and repeatedly launched within the throwing plane, and with greater ease than one may launch a golf ball by striking it from the ground with a golf club.

Optionally, a retrograde throwing head launch ramp at the terminus of the distal end of the throwing head may facilitate ball spin and it may alter one's launch angle. In one embodiment, the retrograde throwing head launch ramp angle may be variable. That is, as one property of the throwing head, the retrograde throwing head launch ramp angle is adjustable by the user and the adjustment means comprises another part of the launch head. The terminus of the throwing head, or the retrograde throwing head launch ramp, may also be a track of partially helical shape, imparting a spiral-type spin to stabilize a ball in flight, as would rifling within a firearm barrel.

In another embodiment, also shown in the figures below, the throwing head may be adapted to secure into the pocket of a lacrosse head, for example by attachment to the lacrosse head. In this manner, a golf ball may roll along the throwing head launch ramp, whereas such roll would be impeded by the mesh webbing of a typical lacrosse head's deep webbed pocket. In this example, the throwing head inserted into the pocket of the lacrosse head, and affixed to the lacrosse head, allows the lacrosse head to be used to throw a golf ball, facilitating play of the game described below and serving as a training aid for lacrosse.

In the game to be played with the throwing apparatus, there are several techniques the player may use to throw or advance the ball. These include a one-handed overhead throw or swing, as one would envision as being employed by a baseball pitcher holding the throwing apparatus or a tennis player serving a tennis ball; a one-handed forehand throw or swing, as one would envision as being employed by a tennis player playing a forehand stroke; a one-handed backhand throw or swing, as one would envision as being employed by a tennis player playing a backhand stroke; a two-handed forehand swing or stroke, as one would envision as being employed by a baseball batter or a golfer performing a warm-up swing at waist level; a two-handed overhead swing or stroke, as one would envision as being employed by a lumberjack splitting wood with an axe; a two-handed semi-overhead swing or stroke, as one would envision being used by a lacrosse player shooting the ball on goal; a two-handed backhand throw or swing, as some tennis players employ to play a backhand stroke; a one-handed running throw as one would envision as being employed by one throwing a javelin; a one-handed underhand throw, or any number of throwing techniques as the player may develop for achieving throws of a consistent length or trajectory. A skilled thrower may deploy a snap or whipping motion to the throwing method, using body mechanics, physics, and physical strength to impart force upon the throwing apparatus to achieve great velocity at the throwing head, and, as a result the projectile. Skilled throwers may achieve throwing head speeds in excess of 100 mph, and perhaps much higher.

Using the throwing apparatus disclosed, a game is played approximating golf, wherein the thrower uses a golf ball and set of throwing apparatuses to advance the ball to a target or hole. Using a set of interchangeable shafts and throwing heads, each with different characteristics as may be selected by the player, the player may use the rules of golf, but instead throwing the ball rather than striking it from the ground. In one embodiment of the game, the player throws the ball until he reaches the green, then uses a conventional golf putter to putt the ball into each hole. Score is recorded as the number of throws and putts required to hole the ball.

This game of "throw golf" may be played on normal golf courses, or any playing course a player deems acceptable. Similar to "Frisbee golf," some players configure their own targets and fields of play, while others prefer set courses with known obstacles, using repeated play to measure one's level of ability. Players may also opt to use balls with varying flight characteristics, weights, surface treatments, and so on. Specialty golf-ball sized balls may be deployed for use with courses of varied lengths and types of shots, just as players of "disc golf" or "Frisbee golf" select different flying discs for different types of shots.

Advantageously, players of "throw golf" using the disclosed throwing apparatus may play on regular golf courses, even with those playing conventional golf, without slowing the pace of play, without wasting time losing and hunting for errantly hit balls, without adversely affecting the conditions of the golf course facility itself, and without having to undertake to learn how to strike a golf ball with a golf club.

Other advantages of the throwing apparatus and the game played with it include: the attraction of a new set of potential users of golf facilities; the encouragement of novice golfers to play conventional golf by getting them on the course for the sake of learning the rules and etiquette before achieving a fully proficient golf game, or by mixing throws and striking the ball, for example when encountering a forced carry over a water hazard but lacking facility to perform that shot with conventional golf equipment; the encouragement of those adverse to perceived stigma of golf but who would not perceive the same stigma if the same course could be used for a throwing sport; the potential for competition with conventional golfers; the reduced likelihood of placing a ball in a hazard, thereby reducing likelihood of incurring penalty strokes or lost balls; the fact that a throwing motion is more intuitive than is the mechanics of a proper golf swing; and the fact that more people know how to throw than know how to golf.

Another important advantage of the throwing apparatus is that it allows handicapped or disabled individuals greater access to participating on a golf course. Golf is typically played from a standing position, requiring good balance. The golf swing and striking a ball from the ground is practically impossible to perform if one is bound to a wheelchair, has problems with balance, or has other physical impediments to high level of physical coordination. For these athletes, throwing a ball, even from a seated position, may be the only way for them to enjoy a golf course and the game of "golf." In addition, the throwing apparatus reduces the need for expensive and cumbersome specialty carts, motorized devices and other balance-enhancing implements, since a throw can be accomplished from a stable, seated position.

Among this set of athletes, there are many with the requisite upper body strength, mobility and coordination to use the throwing apparatus. Use of the throwing apparatus allows golf courses to more easily comply with the requirements of the Americans with Disabilities Act, and it allows these special athletes an opportunity to play an adaptive form of golf with equipment that may also meet the rules of the United States Golf Association (USGA).

While a throw golfer may not be able to attain the length of throw a good golfer might attain by hitting the ball with his driver, the throw golfer would likely be more consistent, with straighter throws, and with much greater accuracy as they approach the green. Because a majority of conventional golf strokes occur within 100 yards of the green (and by some estimates 65% of all golf shots, and including 80% of shots golfers lose to par) it is possible not only for the throw golfer to achieve scores in competition with amateur recreational golfers, but to beat their scores. Also, because each player may putt the ball on the green, the number of strokes due to putting alone may be used as a source of competition.

Alternatively, the throwing apparatus may be used as a golf training device, allowing the fast and easy demonstration of how a given swing plane can affect the spin imparted on a ball. For a right-handed golfer, an "outside-in" swing plane produces a "slice," or curved ball trajectory moving from left to right. The throwing apparatus may replicate this spin pattern easily for the assistance and education of the amateur golfer.

The throwing apparatus may also be used as a fun training device for lacrosse players. Particularly when the throwing head is adapted for connection to a lacrosse shaft, the throwing head described can be attached for a golf-type game using the same throwing mechanics one might use in lacrosse. More practice produces a more proficient player. Particularly for children who play lacrosse but might not always have a catching partner or a net to shoot at, the throwing head described allows a new game and method of practice that does not require a catching partner or team of players.

Additionally, many kids play lacrosse through middle school or high school and may not have the talent or opportunity to play at higher levels. For those who do progress to play at a collegiate level, even fewer have opportunities to play professionally. Unlike golf, which allows an amateur to play a lifelong sport, a team-based lacrosse career can end, and along with it the enjoyment from playing a ball throwing sport, particularly since very few recreational leagues presently exist for older players. Also, lacrosse may be seen as a violent, aggressive, physical sport. For some younger players, they may suffer injury, or be physically smaller or slower than other athletes, but they may have gained proficiency in the mechanics of throwing the ball. Using the throwing apparatus, the sport of "throw golf" is a viable crossover sport for them to play.

In another embodiment, the projectile may be shaped with two lobes (as one might envision with a yo-yo), wherein one half is a first part, the other half is a second part, with a mating part, such as a rod, being situated between the first part and the second part. In the case of a yo-yo, a string is wrapped about the mating part and the length of the string when unwound causes the yo-yo to spin and achieve a level of gyroscopic stabilization.

When used with a throwing apparatus, however, a throwing ramp may be configured to matingly engage the circumference of the mating part. For example, the throwing ramp may comprise gears which matingly engage gears formed on the outer circumference of the mating part. Here, the throwing ramp may bisect the first part and the second part in order to engage the mating part.

In an embodiment, the first part and the second part, when formed into an assemblage, have a center of mass that equilibrates approximately to the middle of the mating part. In this fashion, when thrown with a throwing head, the projectile may be launched as efficiently as possible, without encountering unwanted wobble or de-stabilization when achieving gyroscopic stabilization at launch.

The first part and the second part may be of differing size, thickness, weight, and leading edge shape. In another example, the assemblage, when viewed in profile, resembles the aerofoil-type shape of an airplane wing or a Frisbee. The purpose of this shape of the profile of the assemblage is to create aerodynamic lift when the projectile is thrown.

The first part and the second part may be manufactured to allow their removal from the mating part. In such an example, different combinations and permutations of the assemblage may be possible, thereby affecting the aerodynamic qualities of the assemblage in flight. For example, if a long flight distance is desired, the thickness of the assemblage might be thinner and with a different leading edge shape than if the desired throw distance is shorter, in which case a thicker assemblage with a different aerodynamic flight distance might be desired. Just as in the sport of disc golf, different projectile configurations may be used for differing shot lengths, trajectories, and purposes.

An athlete using the throwing apparatus might utilize his ability to achieve differing launch velocities, or even a consistent launch velocity, in conjunction with the differing combinations of projectile configurations, to play a game approximating golf as a test of skill.

In an embodiment of the projectile, its overall weight, material of construction, and size of the assemblage may be varied. Preferably, at least one combination is about 3 inches in diameter and the approximate weight of a golf ball, designed to be used on a golf course as a field of play, and designed to land on a golf green without creating any more damage to the turf than would a golf ball landing on the green. Other larger and heavier projectiles or discs may be suitable for longer throws, for example from a tee box on a golf course. Sizes may vary from the size of a golf ball to the size of a hockey puck, and optionally larger.

The first part and the second part may be connected by spring tension, with the mating part in the middle. To mount the assemblage to the throwing head for throwing, the first part and second part are pried apart, allowing the mating part to contact the throwing head. Once thrown from the throwing head, the spring tension causes the first part and the second part to draw nearer to one another, thereby resulting in an aerodynamic assemblage profile.

In one example, the first part is one hemisphere of a golf ball, and the second part is another hemisphere of a golf ball. In this example, the first part and second part are identical in shape and weight.

In another embodiment of the throwing head, the throwing head may be constructed with one throwing ramp member, rather than a dual-track, as illustrated in some Figures, upon which the mating part of the projectile rolls. The projectile rolls to the distal end of the throwing head and is then launched with spin as it leaves the throwing head. In this configuration, the projectile straddles the throwing ramp member.

This embodiment may also be described as differing from throwing implements used to throw skeet (or clay pigeon) for trap shooting and related sport, which cradle a portion of the outer periphery of the one piece, integrally formed clay pigeon in order to propel it downrange.

The throwing ramp for this specialty projectile, as in other embodiments, may define a curvature arc. The throwing head ramp may also be situated at an angle not in alignment with the throwing plane. For example, if the throwing plane is vertical, the angle of the bisected-hemispherical golf ball, for example, may also be vertical. This might be desirable if the athlete is aiming for the green and desires a backspin coming straight back to the thrower. Contrarily, an oblong projectile of the type described, more similarly shaped to a flying disc, may be best launched "sidearm" with the spin imparted being out of the direction of travel of the projectile. If a Frisbee is launched horizontally to the ground, a straight, level flight path can be predicted, or, if a curved flight path is desired, an off-axis throw can be made. This same phenomenon can be applied to the projectile described as used with the throwing apparatus. That is, different launch angles can be achieved by the way the projectile is released, and by the angles of the throwing head itself.

The throwing head can be configured to allow a throwing plane 45 degrees from perpendicular, but to launch the projectile horizontal to the ground. The thrower may employ any of the throwing methods described above, for example a throw similar to use of a forehand tennis stroke. The throwing apparatus facilitates greater launch velocities that a thrower might be able to attain with just throwing the projectile by hand.

A throwing head with a retrograde terminus may be employed. For a right handed thrower throwing forehand sidearm and launching the projectile horizontal to the ground, and with a retrograde terminus, the projectile would have a clockwise spin (as viewed from the top down).

The techniques described throughout this disclosure may address one or more of these needs and may advantageously overcome one or more deficiencies of other options. Certain embodiments of the inventions will now be described. These embodiments are presented by way of example only, and are not intended to limit the scope of the inventions. Indeed, the novel methods, articles, devices and games described herein may be embodied in a variety of other forms. Furthermore, various omissions, substitutions and changes in the form of the methods, articles, devices, apparatuses and games described herein may be made without departing from the spirit of the inventions. To illustrate some of the embodiments, reference will now be made to the figures.

With reference to the figures, FIG. 1A illustrates an embodiment of a throwing head.

Figure 1B:
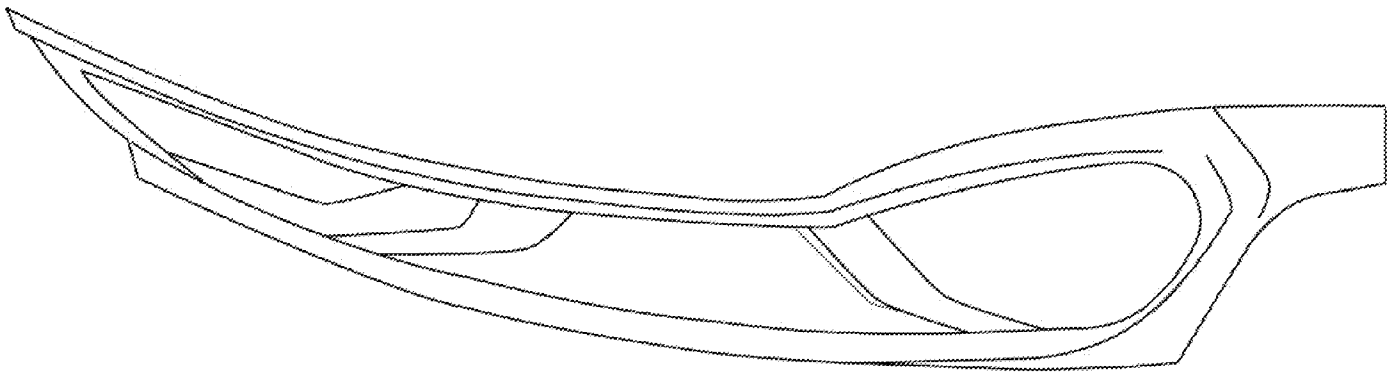
FIG. 1B illustrates a perspective view of an embodiment of a throwing head.

FIG. 1B illustrates a perspective view of an embodiment of a throwing head.

Figure 1D:
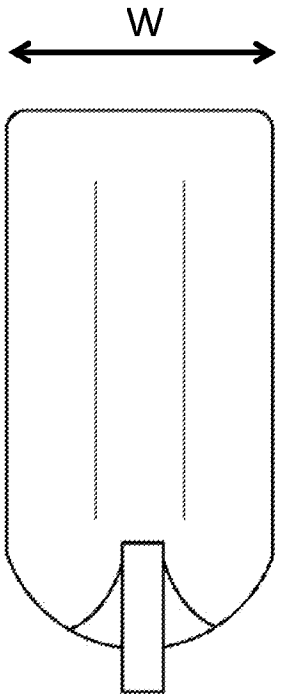
FIG. 1D shows a front perspective view of the throwing head.
Figure 1C:
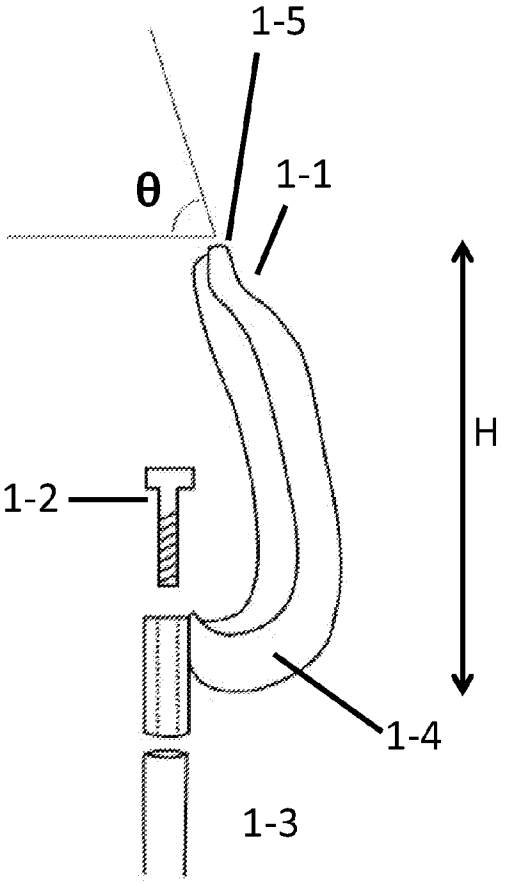
FIG. 1C depicts a perspective view of a throwing head.

FIG. 1C depicts a perspective view of a throwing head 1-1, a bolt 1-2 to connect the throwing head to a golf shaft, and a golf shaft 1-3 to accept the bolt. Here, the throwing head is configured in a scoop configuration and sized to accept a golf ball. The throwing head has a ball seating portion 1-4, into which a golf ball is placed before it is thrown. Opposite the ball seating portion, at the distal end of the throwing head is located a retrograde ramp 1-5. The retrograde ramp 1-5 is intended to impart spin onto the ball when thrown and to provide a launch angle, theta. A height H is shown. In one embodiment, height H is approximately 4 inches to 16 inches.

FIG. 1D also shows a front perspective view of the throwing head. In this embodiment the throwing head is dimensioned to throw a golf ball, but not to catch one, since balls thrown with the throwing apparatus are intended to be thrown hard, at long distance, and not at another person. As a result, the width of the throwing head may be substantially uniform throughout its height. Here is shown a width W, which in one embodiment is approximately 1.75 inches as being adapted for a golf ball. In another embodiment, the distal end of the throwing head may be wider than the average width of the throwing head, but not wide enough to allow it to catch a projectile.

Figure 2:
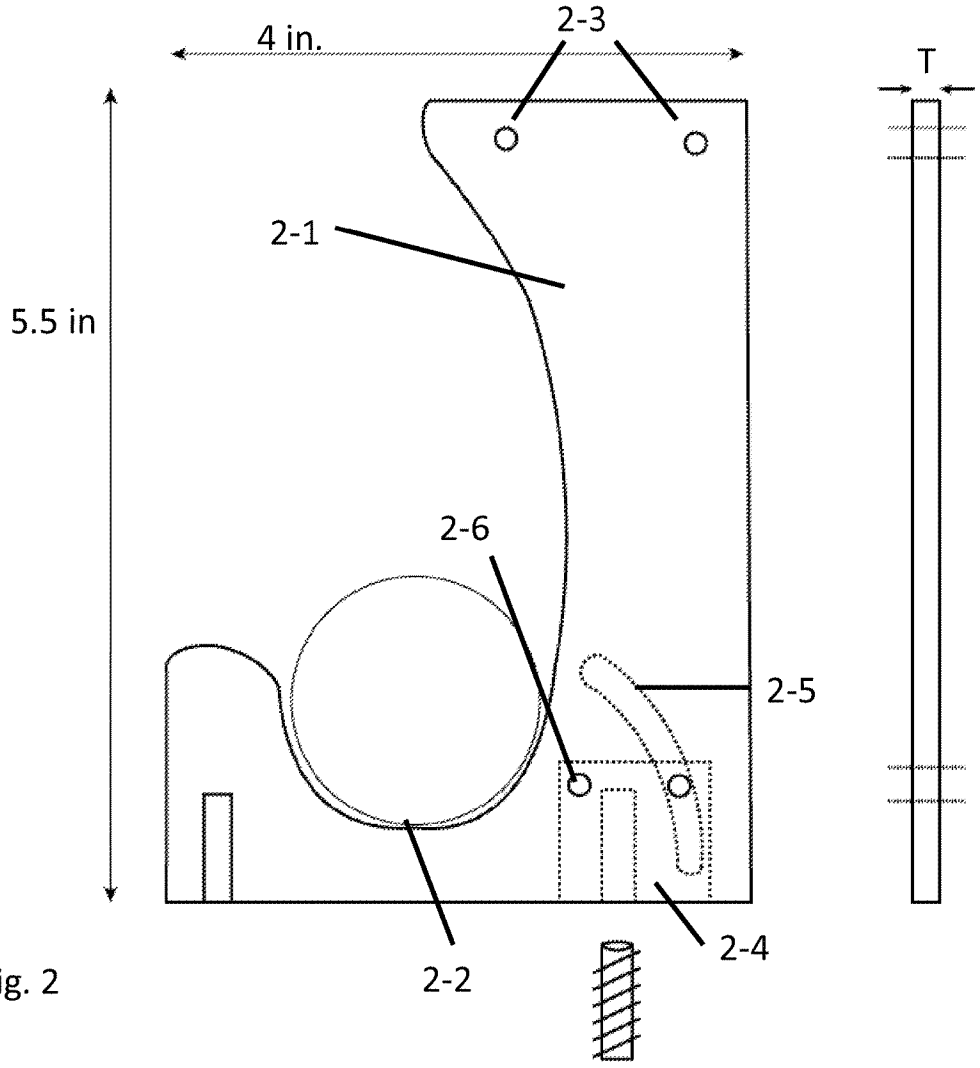
FIG. 2 shows an embodiment of a throwing head comprising a shaped plate.

FIG. 2 shows an embodiment of a throwing head comprising a shaped plate 2-1, intended to function with a similar shaped plate in the same plane, but offset by a distance shorter than the diameter of a ball to be thrown as a projectile. In this example, the shaped plate may be constructed from a sheet of lightweight but rigid aluminum, with a material thickness, T. The shaped plate here is dimensioned approximately 4 inches by 5.5 inches by T inches. A curvature arc A-B is machined into the shaped plate to define the throwing head ramp. The projectile retainer 2-2 is the pocket defined by the curvature arc A-B nearest the bottom-most portion of the curvature arc. When attached to the shaft, during a throwing motion the ball rolls up the curvature arc A-B and leaves the throwing head at or near point B.

The shaped plate of FIG. 2, also shows four bore holes 2-3, two at the top, each to accept a through-bolt for attachment to a spacer, mating shaped plate, and nut; and two holes at the bottom to accept a through-bolt for attachment to a shaft connecting block 2-4, mating shaped plate, and nut.

FIG. 2 also shows a shaped plate that has an angular fitment arc 2-5, which is shown as an angular recess through which a bolt is inserted and tightened to fix the angle of the throwing head with respect to the shaft. Here, hole 2-6 serves a pivot point and hole 2-5 is the angular fitment arc. When the through-bolts are loose, the user can select the angle of the throwing head by rotating the throwing head about the through-bolt in hole 2-6, and then tightening the through-bolt in hole 2-5. The through-bolt for hole 2-5 may be any fastener that allows the user to secure the shaped plates together via the shaft-connecting block. Alternative fasteners include quick release levers and cams, screws and gears to allow adjustment of the throwing head angle by turning an adjustment screw, or other similar fasteners.

Figure 2B:
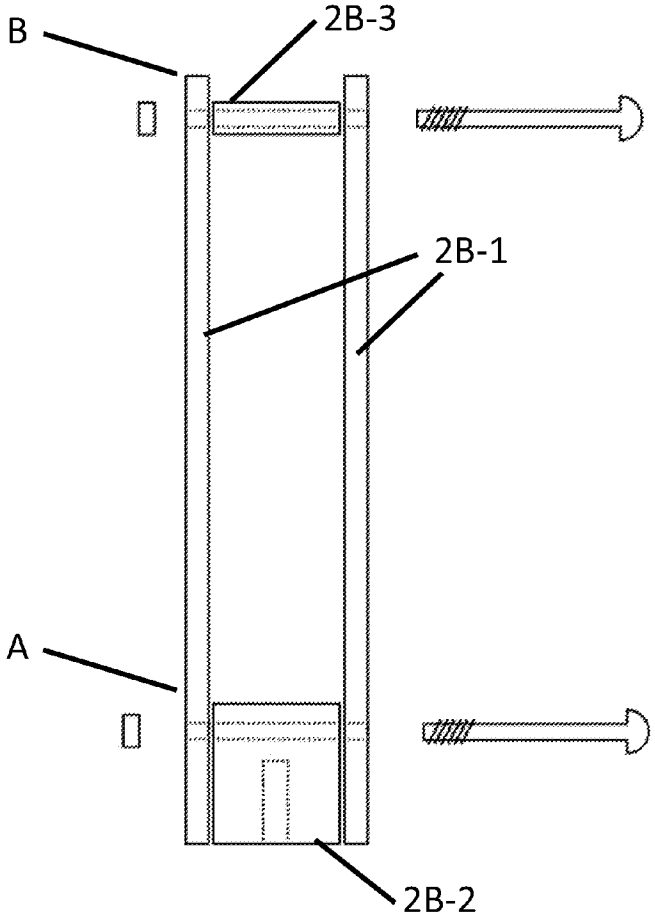
FIG. 2B shows a front view of a throwing head assemblage.

FIG. 2B shows a front view of the throwing head assemblage comprising two shaped plates 2B-1, a shaft connecting block 2B-2, a top spacer 2B-3, and bolt and nut fasteners to secure them together. The shaft-connecting block 2B-2 is shown with a bottom orifice, which may be threaded to accept a mating adapter to connect the throwing head to the shaft. FIG. 2B shows the front view to the curvature arc A-B, which defines a dual track upon which a ball may roll. In this example, the shaped plates are spaced approximately 1 inch apart. A spherical golf ball, with a diameter of approximately 1.680 inches can roll along this dual track. Mathematically, using a ball of predetermined diameter, the distance between the shaped plates defines a chord of the cross dimension of the sphere. If the shaped plates are too far apart, the ball will fall through, and if the shaped plates are too close together, the ball when thrown may dislodge from the tracks before reaching point B at the distal end to the throwing head, causing errant and dangerous throws. The distance between the shaped plates should be that which allows the ball to remain within the tracks over the complete length of the curvature arc A-B, or over that part of the arc the thrower desires.

Figure 2C:
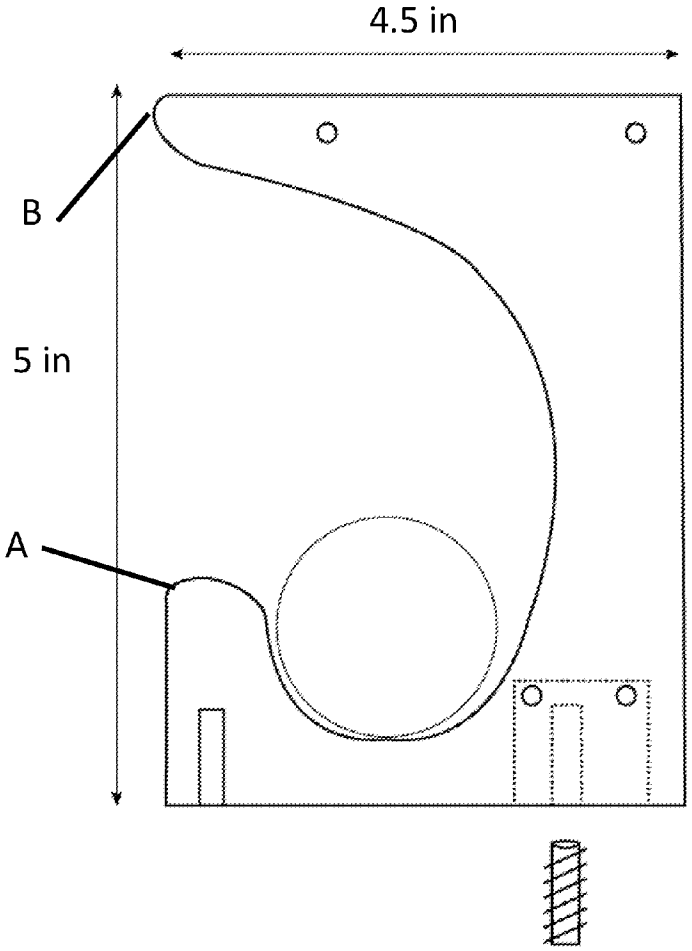
FIG. 2C is another embodiment of a shaped plate of a throwing head.

FIG. 2C is another embodiment of a shaped plate of a throwing head, therein being defined another example of a curvature arc A-B. In yet other embodiments, the curvature arc A-B may be defined to accomplish a desired launch angle, theta. The shaped plates of FIG. 2, FIG. 2B, and FIG. 2C may be helpful in the user's selection of a particular shape and launch angle. The construction method is simple and inexpensive, allowing a user to find the curve and shape parameters that meet his liking, which parameters or fitments may be used in the prototyping or manufacture of lightweight composite constructions illustrated in other embodiments.

Figure 3:
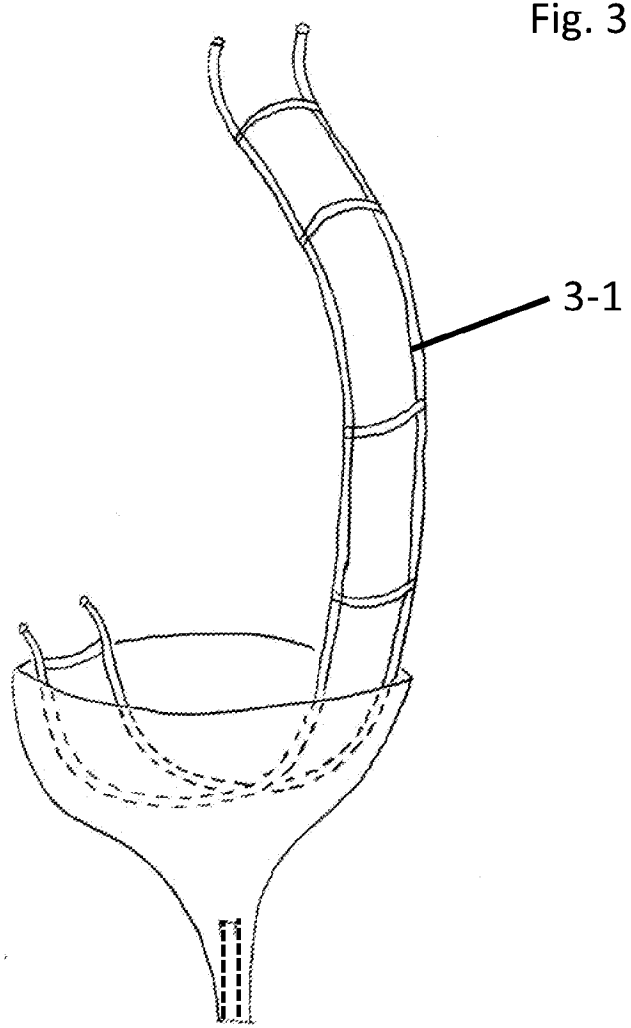
FIG. 3 depicts an embodiment of a throwing head with a dual track throwing head ramp.

FIG. 3 depicts an embodiment of a throwing head with a dual track throwing head ramp 3-1, here fashioned from metallic rods secured to one another by cross braces and secured into the proximal end of the throwing head. The tracks are shown as approximately 1 inch apart, to accept a golf ball of approximately 1.680 inches in diameter.

Figure 4:
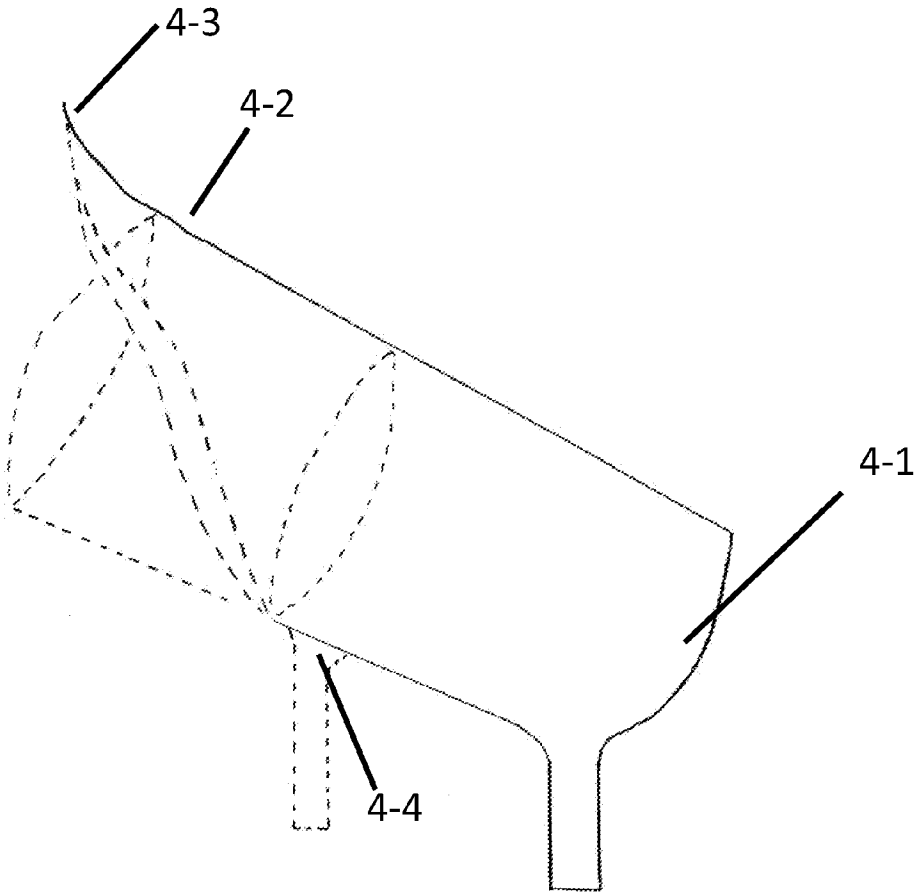
FIG. 4 depicts an embodiment of a throwing head.

FIG. 4 depicts an embodiment of a throwing head. In this embodiment the head is shaped substantially cylindrically at the proximal end 4-1 and open at the distal end 4-2 with the retrograde throwing head launch ramp 4-3 at the terminus. FIG. 4 illustrates that part of the cylindrical shape of the throwing head can be removed toward the distal end, so long as sufficient rigidity remains at the distal end to throw the projectile. Other portions of the throwing head may be removed or machined away, so long as structural rigidity is maintained, for example to make the throwing head lighter, more aerodynamic, and so on. Also, one embodiment shows the shaft may be connected near the proximal end 4-1 of the cylindrical throwing head, or the shaft can be connected nearer the middle of the throwing head at location 4-4.

Figure 5:
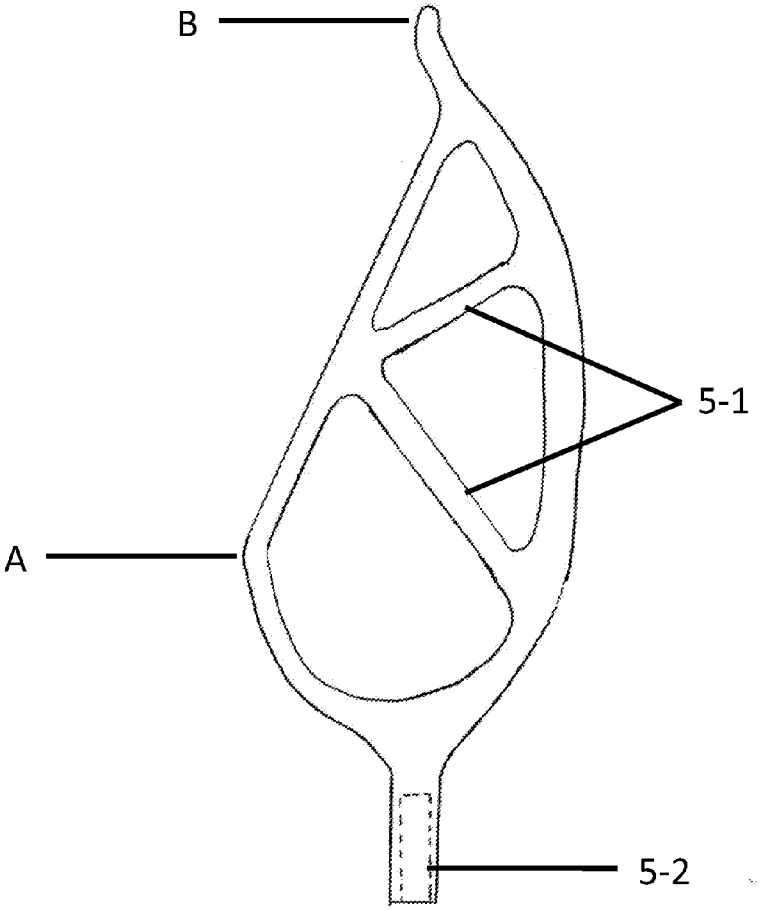
FIG. 5 illustrates a side view of a scoop-shaped throwing head of the throwing apparatus.

FIG. 5 illustrates a side view of a scoop-shaped throwing head of the throwing apparatus. In this embodiment, also represented sized for a golf ball, the throwing head may be manufactured with carbon fiber or composite to reduce weight while retaining stiffness. In FIG. 5, the throwing head defines curvature arc A-B, with there being support lattice members 5-1 to connect a part of the proximal end to a part of the distal end. In this example, there are three truss-type support lattice members to prevent the distal end from deflecting due to the forces exerted upon the throwing head by the projectile during the throwing motion.

Also shown in FIG. 5 is a shaft connector recess 5-2, to accept the shaft. This recess may comprise a threading or a threaded sleeve to mate with a corresponding portion of the shaft.

Figure 6A:
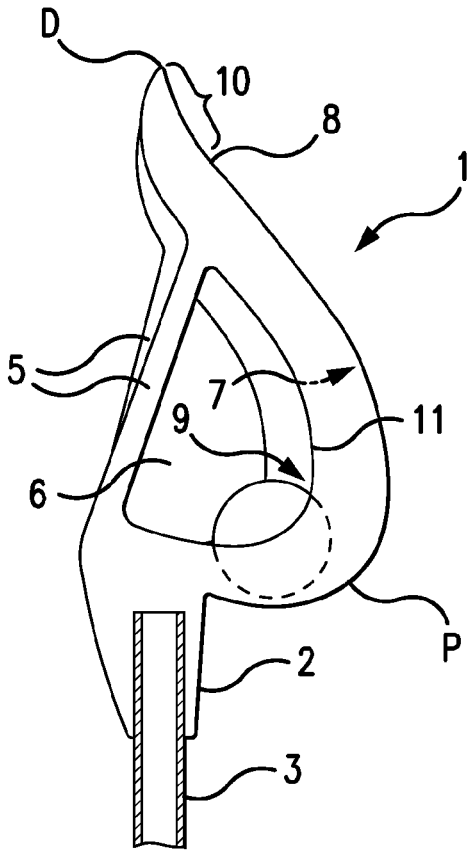
FIG. 6A depicts a side view of a scoop-shaped throwing head comprising a scoop and support lattice members.

FIG. 6A depicts a side view of a scoop-shaped throwing head comprising a scoop and support lattice members, here shown as being manufactured with carbon fiber or composite to reduce weight while retaining stiffness. FIG. 6A shows scoop-shaped throwing head 6A-1 comprising a throwing head neck portion 6A-2 configured for connection to an elongate shaft that has a handle. FIG. 6A shows a scoop-shaped throwing head of relatively small dimension (as compared to the length of the elongate shaft) configured to accommodate, for example, a golf ball-sized projectile in a pocket sized therefor, wherein the throwing head has a strut or support lattice member that connects near the distal end of the throwing head and near the proximal end of the channel of the throwing head. The throwing head 6A-1 has a lattice member 6A-5, an opening 6A-6 that is defined in part by lattice member 6A-5, a throwing ramp 6A-7 (on the interior of the scoop, partially obscured here due to the perspective) with a terminus 6A-8, which is here shown having a retrograde terminus 6A-10 added thereto, sidewalls 6A-11 on the edge of the scoop shape, the sidewalls depicted as having a height about at least half the diameter of the projectile and helping define the pocket 6A-9 (a type of projectile retainer), a proximal end P (in the length dimension) defined b a back wall, a cup or socket 6A-9 defined in part by the back wall, and a distal end D in the length and height dimension.

Figure 6B:
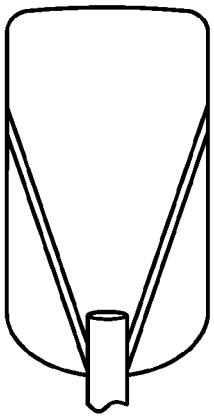
FIGS. 6B and 6C depict a front view of a scoop-shaped throwing head comprising a scoop and support lattice members.
Figure 6C:
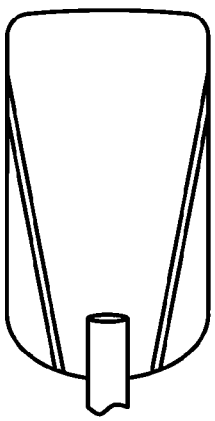

FIG. 6B depicts a front view of a scoop-shaped throwing head comprising a scoop and support lattice members, where the support lattice member(s) is connected near the shaft centerline. In other placements, as in FIG. 6C, the support lattice members may be located further from the centerline of the shaft.

Figure 7:
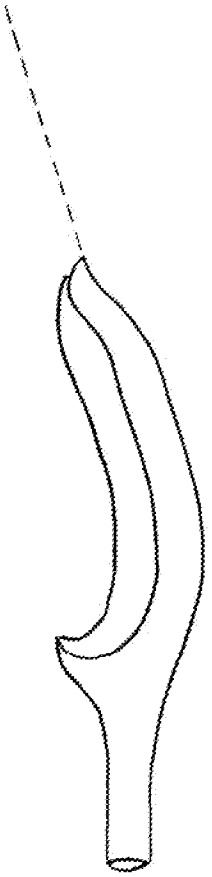
FIG. 7 illustrates a scoop shaped throwing head.

FIG. 7 illustrates a scoop shaped throwing head. This embodiment demonstrates a launch angle, theta, that is achieved from the distal end when the shaft is mated and is in a vertical orientation. The launch angle is not vertical, but it is closer to vertical than to horizontal.

Figure 8:
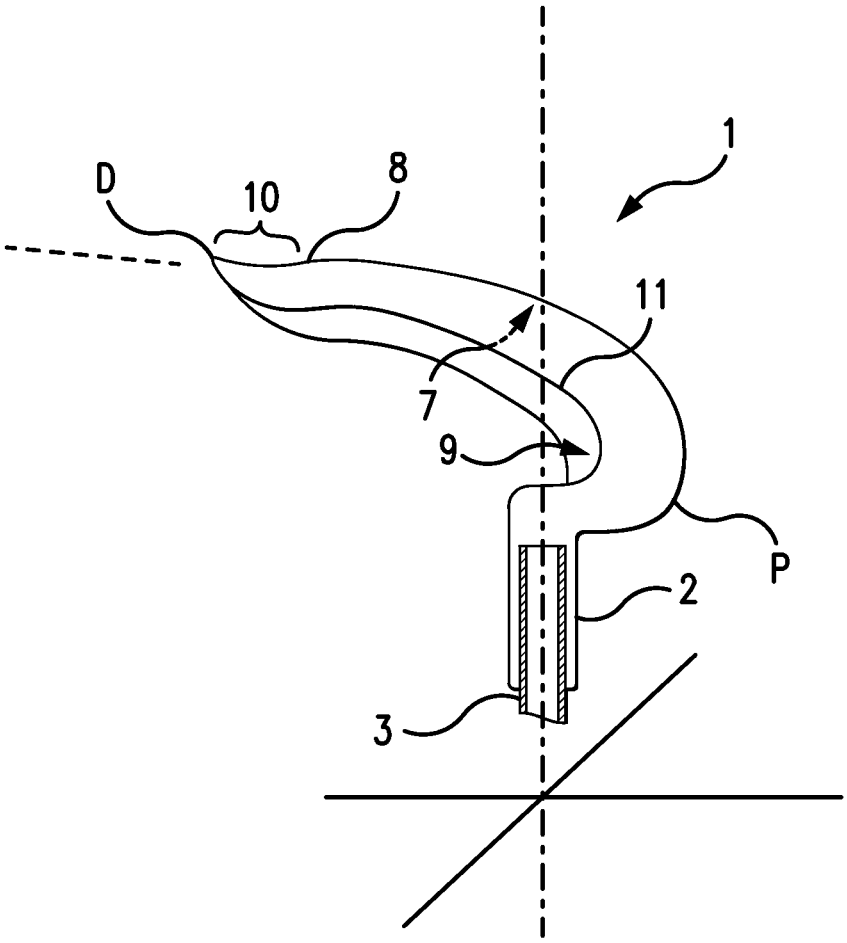
FIG. 8 illustrates a scoop shaped throwing head.

FIG. 8 illustrates a scoop shaped throwing head. This embodiment demonstrates a launch angle, theta, that is achieved from the distal end when the shaft is mated and is in a vertical orientation. The launch angle is not horizontal, but it is closer to horizontal than to vertical, being about 90 degrees to about 135 degrees from the longitudinal axis of the shaft. FIG. 8 shows scoop-shaped throwing head 8-1 comprising a throwing head neck portion 8-2 configured for connection to an elongate shaft that has a handle. FIG. 8 shows a scoop-shaped throwing head of relatively small dimension (as compared to the length of the elongate shaft) configured to accommodate, for example, a golf ball-sized projectile in a pocket sized therefor. This embodiment is shown optionally omitting the support lattice member 6A-5, as was shown in FIG. 6A. The throwing head 8-1 has a throwing ramp 8-7 (on the interior of the scoop, partially obscured here due to the perspective) with a terminus 8-8, which is here shown having a retrograde terminus 8-10 added thereto, sidewalls 8-11 on the edge of the scoop shape, the sidewalls depicted as having a height about at least half the diameter of the projectile and helping define the pocket 8-9, a proximal end P (in the length dimension) defined by a back wall, cup or pocket 8-9 defined in part by the back wall, and a distal end D in the length and height dimension.

Figure 9:
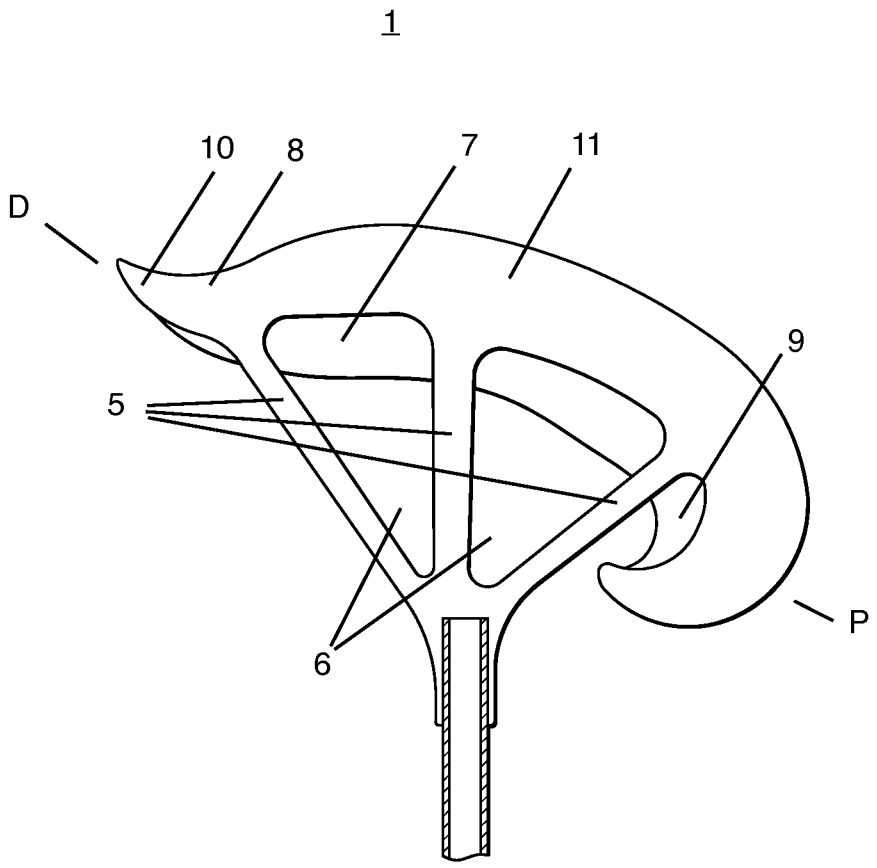
FIG. 9 illustrates a side view of a scoop-shaped throwing head of the throwing apparatus.

FIG. 9 illustrates a side view of a scoop-shaped throwing head of the throwing apparatus. In this embodiment, also represented sized for a golf ball, the throwing head may be manufactured with carbon fiber or composite to reduce weight while retaining stiffness. In FIG. 9, the throwing head 9-1 defines curvature arc A-B. In this embodiment, three support lattice members 9-5 (on each side) are deployed to connect to a part of the proximal end, a part of the distal end, and a point between the proximal end and the distal end. In this example, the support lattice members 9-5, are shown as defining at least one opening 9-6. The throwing head 9-1 has a throwing ramp 9-7 (on the interior of the scoop, partially obscured here due to the perspective) with a terminus 9-8, which is here shown having a retrograde terminus 9-10 added thereto, sidewalls 9-11 on the edge of the scoop shape, the sidewalls depicted as having a height about at least half the diameter of the projectile and helping define the pocket 9-9, a proximal end P (in the length dimension) defined by a back wall, cup or pocket 9-9 defined in part by the back wall, and a distal end D in the length dimension.

Figure 10:
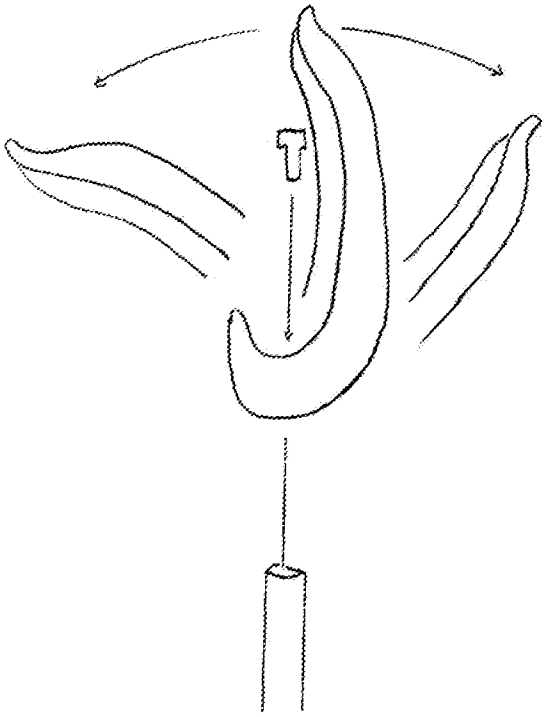
FIG. 10 illustrates a scoop shaped throwing head.

FIG. 10 illustrates a scoop shaped throwing head, wherein the throwing head may be secured to the shaft in any number of various orientations with respect to the longitudinal axis of the shaft. In this embodiment, an arc-shaped recess is formed in the proximal end of the throwing head, or a plurality of holes are formed in the proximal end of the throwing head, through which a fastener (or fasteners) is inserted and tightly secured to the shaft. With this connection, the user may quickly and easily adjust and fine-tune the throwing angle that may be achieved with the throwing head.

Figure 11B:
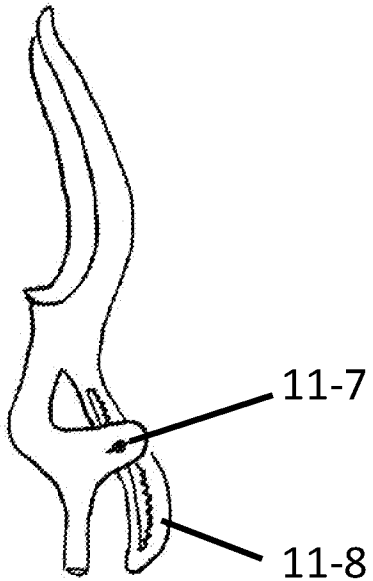
FIG. 11B illustrates an embodiment of the throwing head.
Figure 11A:
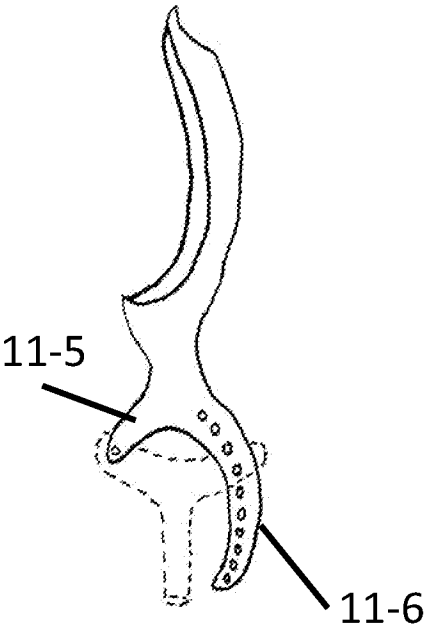
FIG. 11A illustrates another scoop shaped throwing head, wherein the throwing head may be secured to the shaft in any number of various orientations with respect to the longitudinal axis of the shaft
Figure 11:
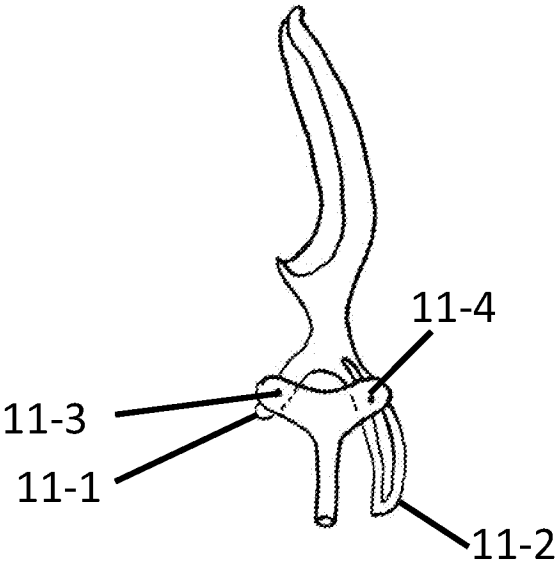
FIG. 11 illustrates another scoop shaped throwing head, wherein the throwing head may be secured to the shaft in any number of various orientations with respect to the longitudinal axis of the shaft.

FIG. 11 illustrates another scoop shaped throwing head, wherein the throwing head may be secured to the shaft in any number of various orientations with respect to the longitudinal axis of the shaft. In this embodiment, a pivot arm 11-1 and a pivot arm with an integral adjusting arc recess 11-2 cooperate to allow the user to quickly and easily adjust and fine tune the throwing angle that may be achieved with the throwing head. A fastener 11-3 creates a pivot point and an angle fastener 11-4 allow the adjustment. The fasteners may be bolts, screws, pins, quick release arms or cams, or the like. The function of the fasteners is to fix the angle of the throwing head with respect to the shaft and to securely maintain that angle through the throwing motion.

FIG. 11-A illustrates another scoop shaped throwing head, wherein the throwing head may be secured to the shaft in any number of various orientations with respect to the longitudinal axis of the shaft. In this embodiment, a pivot arm 11-5 and a pivot arm with integral adjusting angle holes 11-6 cooperate to allow the user to quickly and easily adjust and fine-tune the throwing angle that may be achieved with the throwing head. The fasteners may be bolts, screws, pins, quick release arms or cams, or the like. The function of the fasteners is to fix the angle of the throwing head with respect to the shaft and to securely maintain that angle through the throwing motion.

FIG. 11-B illustrates an embodiment in which the pivot point may be integrally formed within the throwing head, and the angle adjusting mechanism is a threaded bolt or screw 11-7 that allows the user to quickly rotate it to select a desired launch angle. In this example, there is shown a pivot arm with gear teeth 11-8, which communicates with the threaded bolt or screw 11-7 to fix the angle of the throwing head with respect to the shaft.

Figure 12:
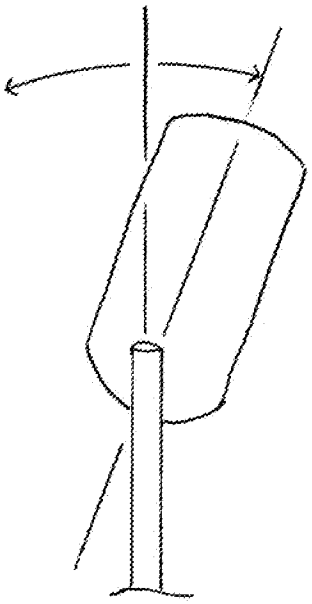
FIG. 12 illustrates a front view of an exemplary throwing head.

FIG. 12 illustrates a front view of an exemplary throwing head, as in FIG. 1, wherein the throwing head is canted or rotated along another axis. In this embodiment, the angle is fixed, but it is within the spirit of the present disclosure and contemplated that the user may adjust this angle as well to achieve desired throwing characteristics.

Figure 13:
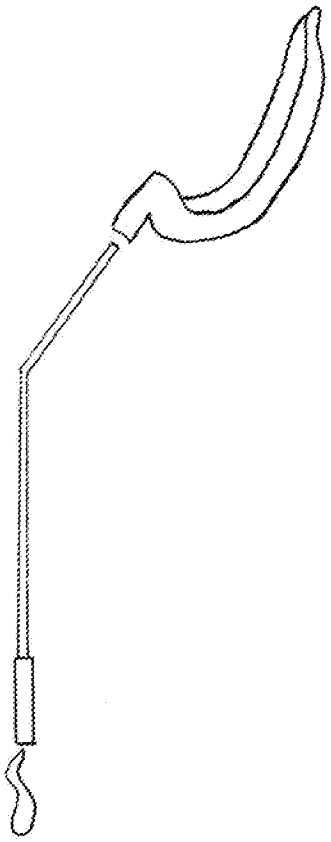
FIG. 13 illustrates a side view of an exemplary throwing apparatus, comprising a throwing head, as in FIG. 1, and an elongate shaft with a varied longitudinal axis as one traverses the length of the shaft.

FIG. 13 illustrates a side view of an exemplary throwing apparatus, comprising a throwing head, as in FIG. 1, and an elongate shaft with a varied longitudinal axis as one traverses the length of the shaft. In combination with the varied throwing head configurations, constructions, adjustable angles, sizes, and so on, this example shows other curved and angled shafts may be deployed to provide the user a multitude of combinations and permutations by which to effect a number of different throws.

Figure 14B:
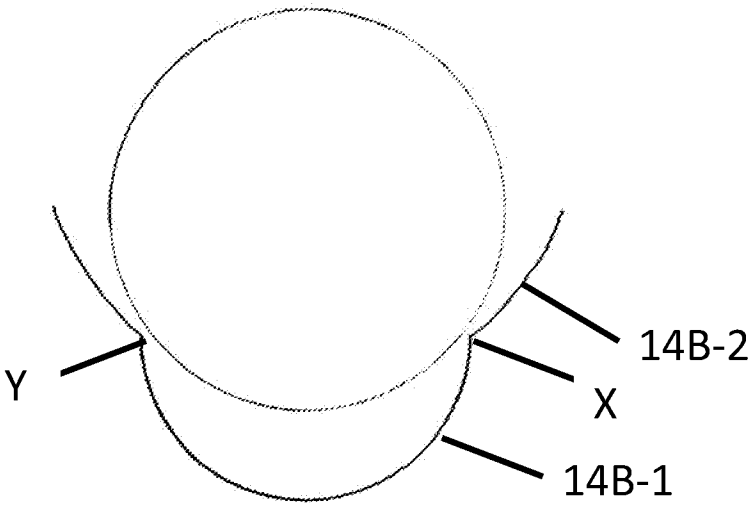
FIG. 14B shows a cross section of one embodiment of a scoop-type throwing head, wherein the scoop comprises a complex curve of more than one radius.
Figure 14A:
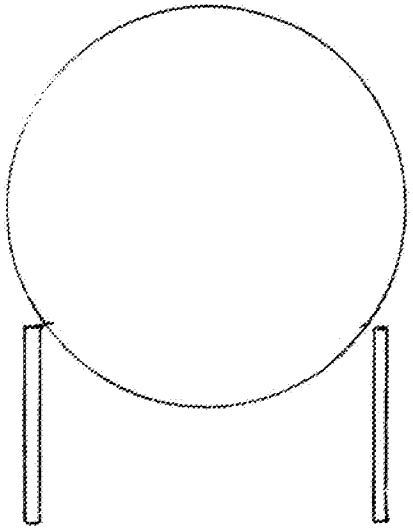
FIG. 14A shows a ball seated between two parallel tracks of an exemplary throwing head.

FIG. 14 illustrates a cross sectional dimension of a throwing head ramp. FIG. 14-A shows a ball seated between two parallel tracks, as was discussed in the embodiment in FIG. 2. The distance between the two tracks corresponds to a chord of the cross section of the ball, and when the ball rolls on the two tracks, stability is achieved because there are two contact points with the track.

FIG. 14-B shows a cross section of one embodiment of a scoop-type throwing head, wherein the scoop comprises a complex curve of more than one radius. In this embodiment curve 14B-1 is created by selecting a radius smaller than the radius of the ball, which results in two contact points between the ball and the throwing head, creating the same stability when being thrown from the throwing head. The second curve 14B-2, represents another part of the throwing head that allows for throws even if the ball should dislodge from the intended points of contact, x and y. This type of complex curve, when employed with the shape of the throwing head and appropriate materials, provides an additional measure of rigidity and stiffness, and will cause the throwing head to be more durable and less susceptible to deformation over repeated usage.

FIG. 14C illustrates a three-dimensional rendering of the throwing head using the complex curve of FIG. 14B.

Figure 15:
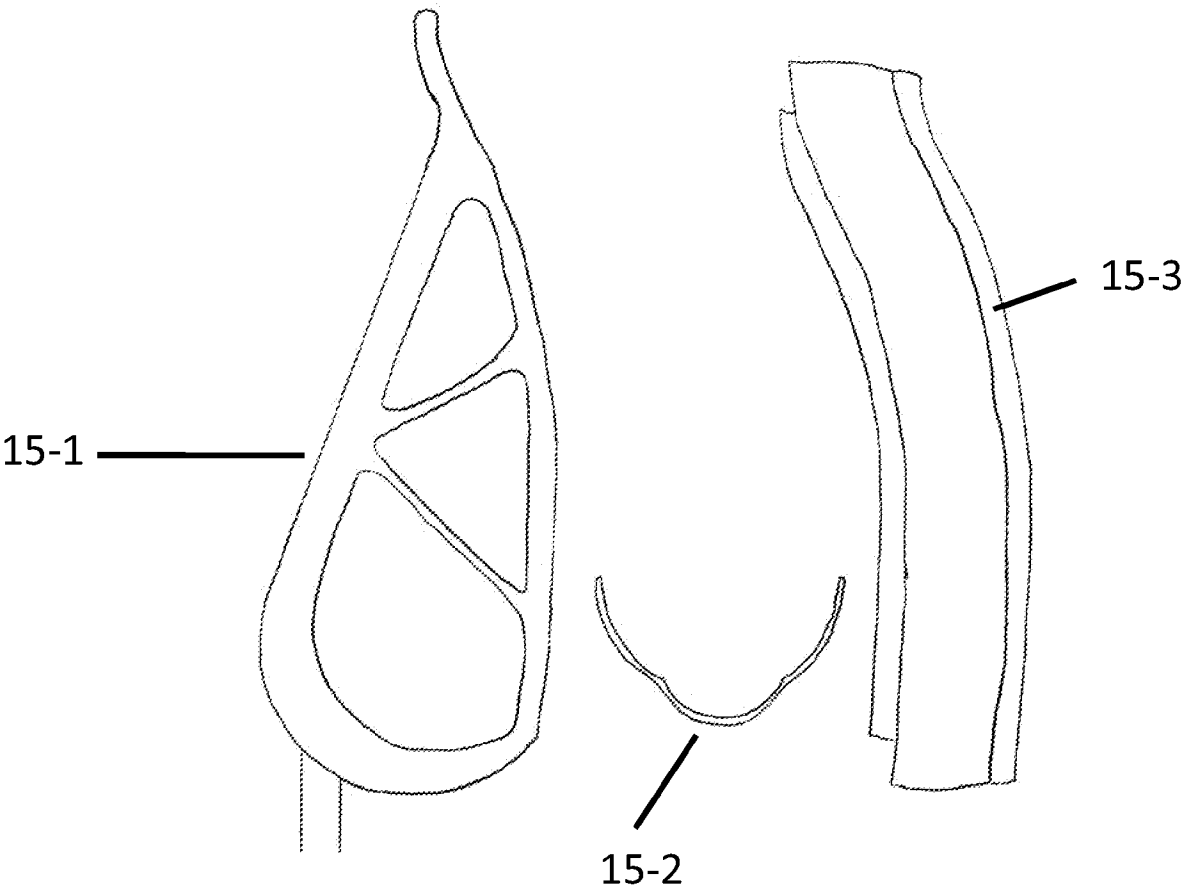
FIG. 15 is a side view of one embodiment of the throwing head 15-1, a cross section 15-2 of the throwing head ramp, and the throwing ramp 15-3 extruded about the arc defined from the proximal end of the throwing head to the distal end of the throwing head. A retrograde terminus is shown at the distal end.

FIG. 15 is a side view of one embodiment of the throwing head 15-1, a cross section 15-2 of the throwing head ramp, and the throwing ramp 15-3 extruded about the arc defined from the proximal end of the throwing head to the distal end of the throwing head. A retrograde terminus is shown at the distal end.

Figure 16:
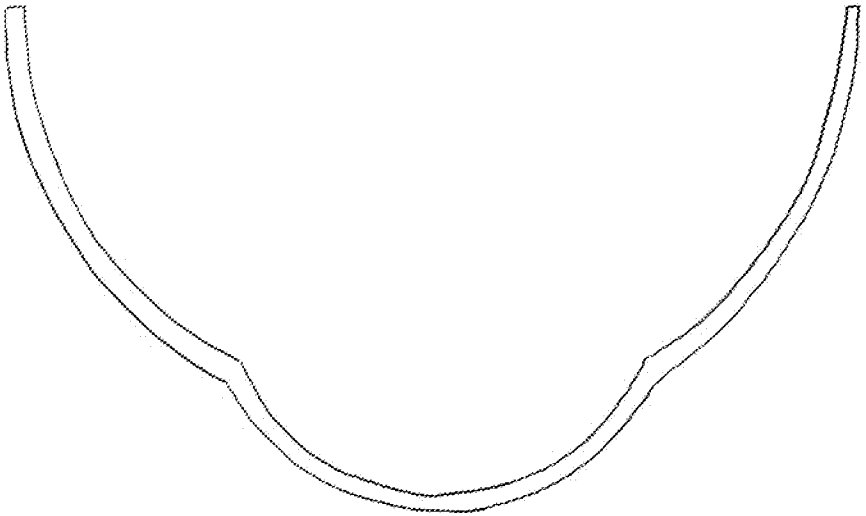
FIG. 16 is a cross section of the throwing head ramp.

FIG. 16 is a cross section of the throwing head ramp.

Figure 17:
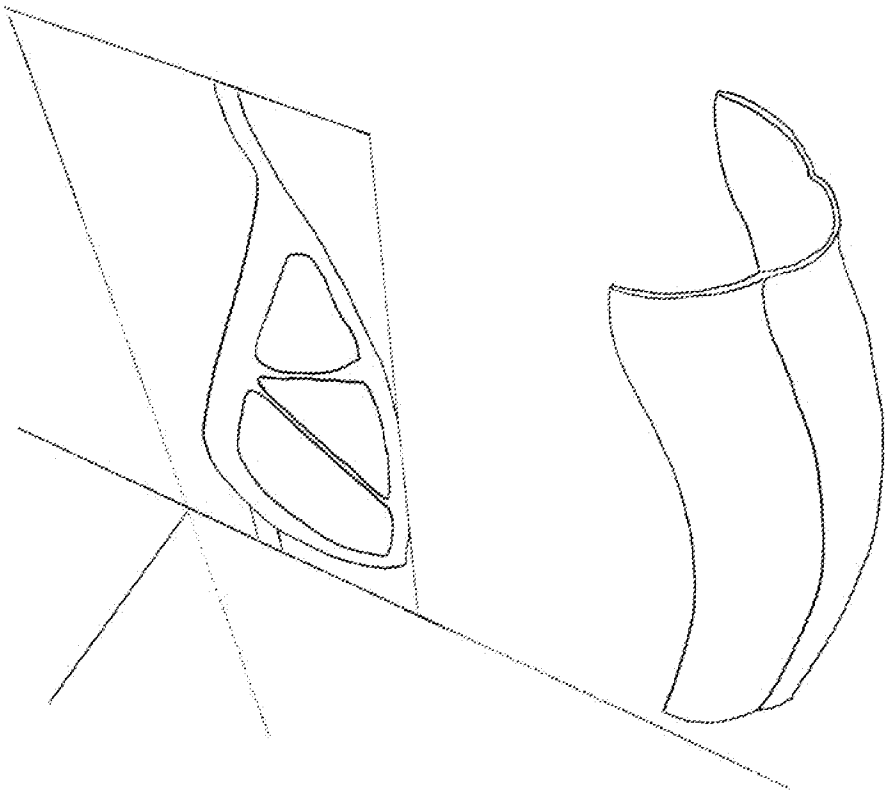
FIG. 17 is another perspective of one embodiment of the throwing head, a cross section of the throwing head ramp, and the throwing ramp extruded about the arc defined from the proximal end of the throwing head to the distal end of the throwing head. A retrograde terminus is shown at the distal end.

FIG. 17 is another perspective of one embodiment of the throwing head, a cross section of the throwing head ramp, and the throwing ramp extruded about the arc defined from the proximal end of the throwing head to the distal end of the throwing head. A retrograde terminus is shown at the distal end.

Figure 18:
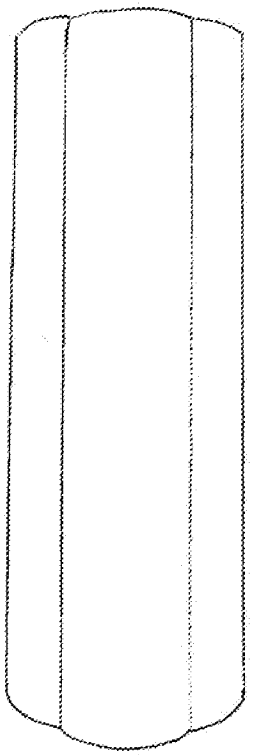
FIG. 18 is a rear view of the throwing head ramp.

FIG. 18 is a rear view of the throwing head ramp.

Figure 19:
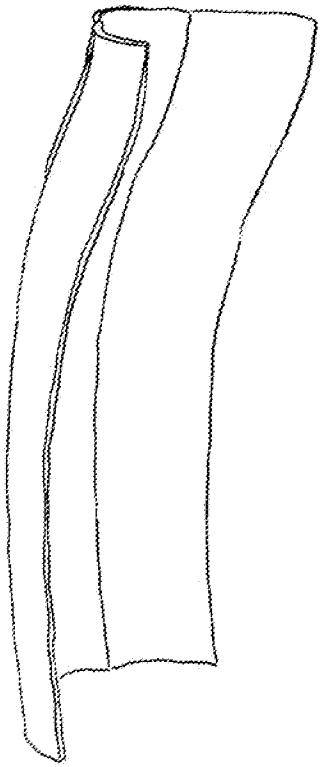
FIG. 19 is a partial front view of one embodiment of the throwing head, looking into the scoop-type throwing head ramp. A retrograde terminus is shown at the distal end.

FIG. 19 is a partial front view of one embodiment of the throwing head, looking into the scoop-type throwing head ramp. A retrograde terminus is shown at the distal end.

Figure 20:
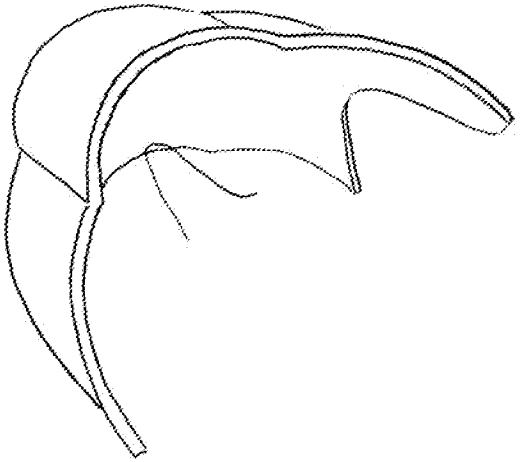
FIG. 20 is another perspective of one embodiment of the throwing head, looking into the scoop-type throwing head ramp. A retrograde terminus is shown at the distal end.

FIG. 20 is another perspective of one embodiment of the throwing head, looking into the scoop-type throwing head ramp. A retrograde terminus is shown at the distal end.

Figure 21:
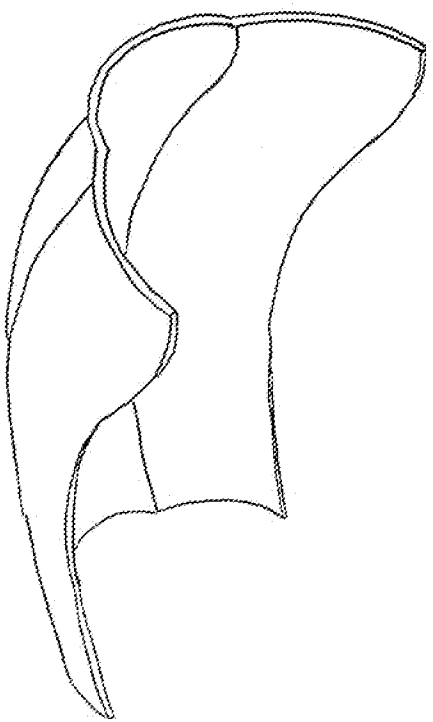
FIG. 21 is another perspective of one embodiment of the throwing head, looking into the scoop-type throwing head ramp. A retrograde terminus is shown at the distal end.

FIG. 21 is another perspective of one embodiment of the throwing head, looking into the scoop-type throwing head ramp. A retrograde terminus is shown at the distal end.

Figure 22:
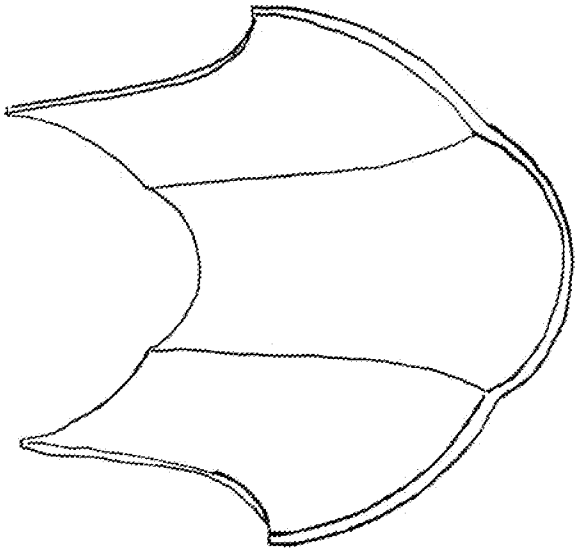
FIG. 22 is another perspective of one embodiment of the throwing head, looking into the scoop-type throwing head ramp. A retrograde terminus is shown at the distal end.

FIG. 22 is another perspective of one embodiment of the throwing head, looking into the scoop-type throwing head ramp. A retrograde terminus is shown at the distal end.

Figure 23:
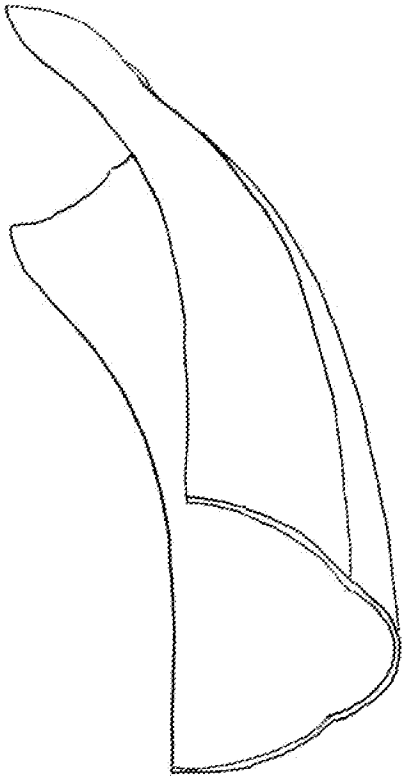
FIG. 23 is another bottom-up perspective of one embodiment of the throwing head, looking into the scoop-type throwing head ramp. A retrograde terminus is shown at the distal end.

FIG. 23 is another bottom-up perspective of one embodiment of the throwing head, looking into the scoop-type throwing head ramp. A retrograde terminus is shown at the distal end.

Figure 24:
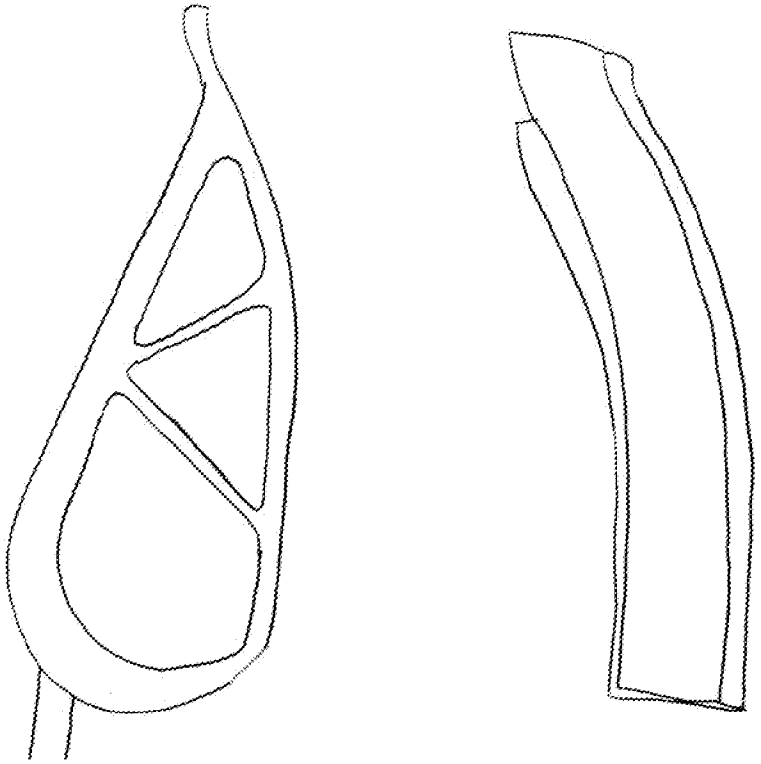
FIG. 24 is another side view of one embodiment of the throwing head.

FIG. 24 is another side view of one embodiment of the throwing head.

Figure 25:
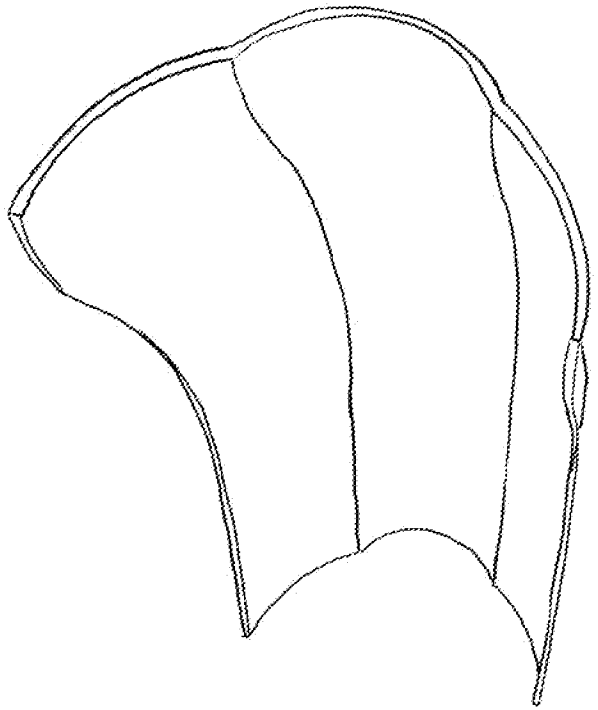
FIG. 25 is another top down perspective of one embodiment of the throwing head, looking into the scoop-type throwing head ramp. A retrograde terminus is shown at the distal end.

FIG. 25 is another top down perspective of one embodiment of the throwing head, looking into the scoop-type throwing head ramp. A retrograde terminus is shown at the distal end.

Figure 26:
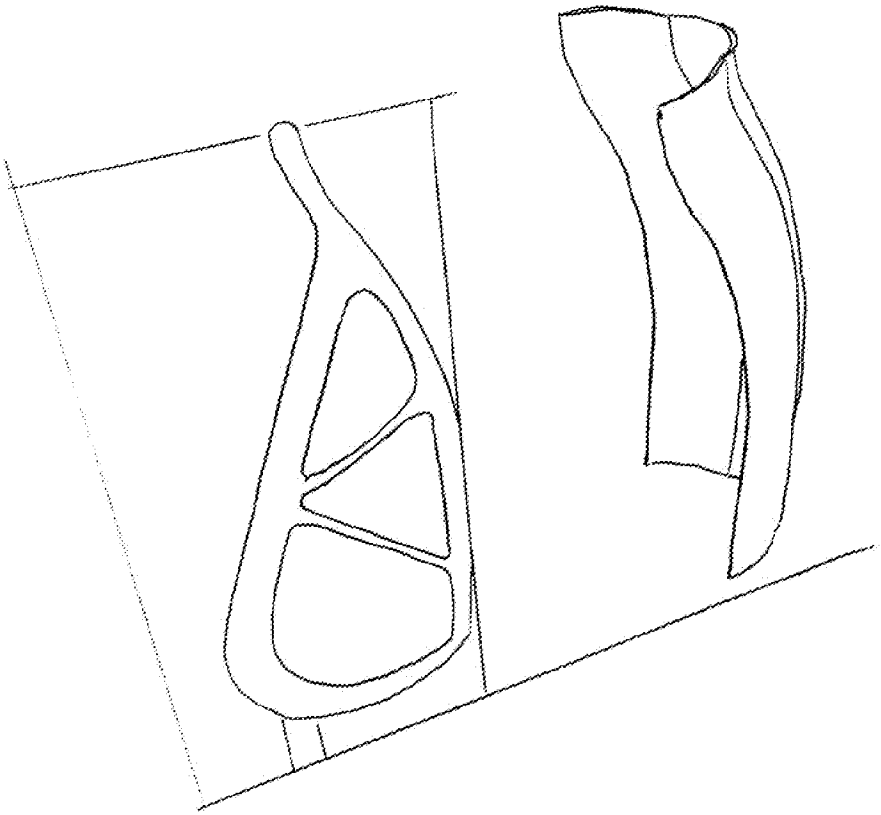
FIG. 26 is another top down perspective of one embodiment of the throwing head, looking into the scoop-type throwing head ramp. A retrograde terminus is shown at the distal end.

FIG. 26 is another top down perspective of one embodiment of the throwing head, looking into the scoop-type throwing head ramp. A retrograde terminus is shown at the distal end.

Figure 27:
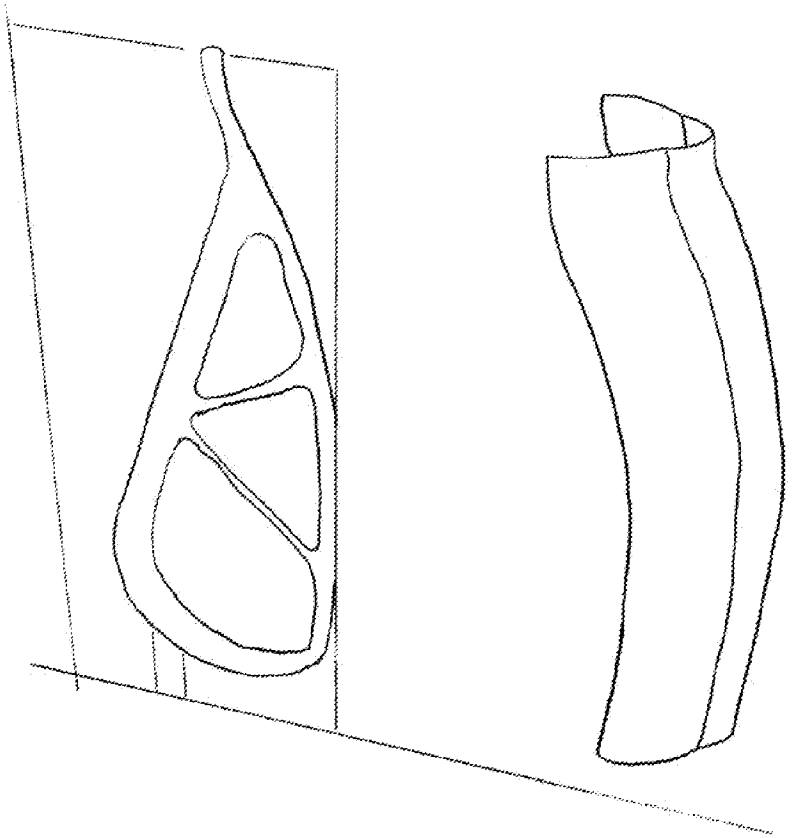
FIG. 27, is another partial top down perspective of one embodiment of the throwing head, looking at the back of the scoop-type throwing head ramp. A retrograde terminus is shown at the distal end.

FIG. 27, is another partial top down perspective of one embodiment of the throwing head, looking at the back of the scoop-type throwing head ramp. A retrograde terminus is shown at the distal end.

Figure 28:
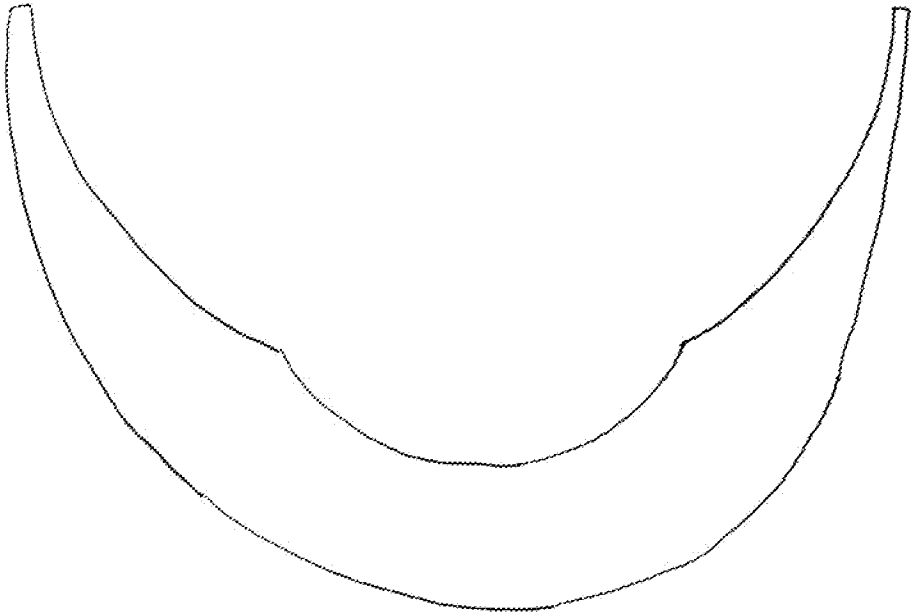
FIG. 28 is a view of a supporting spine that may be attached to the back of the throwing head to provide support and rigidity.

FIG. 28 is a view of a supporting spine that may be attached to the back of the throwing head to provide support and rigidity. Affixing these support spines to the throwing head allows removal of a portion of the scoop-type throwing head ramp to achieve lighter weight, improved aerodynamics, and increased strength.

Figure 29:
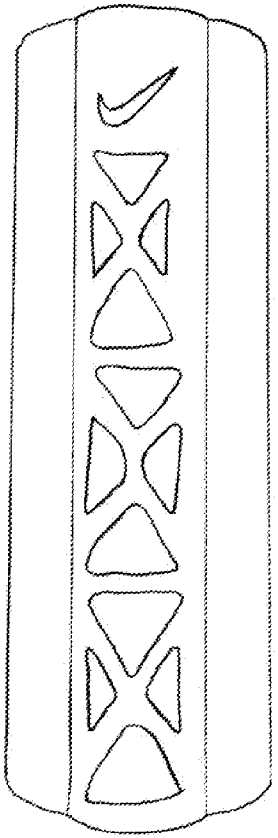
FIG. 29 is a rear view of a portion of the scoop-type throwing head, illustrating that portions may be removed.

FIG. 29 is a rear view of a portion of the scoop-type throwing head, illustrating that portions may be removed to achieve lighter weight and improved aerodynamics without decreasing strength. Removal of portions may also be done in an ornamental design, including incorporation of brand logos, here shown with a commonly recognized "swoosh" trademark of Nike, Inc.

Figure 30:
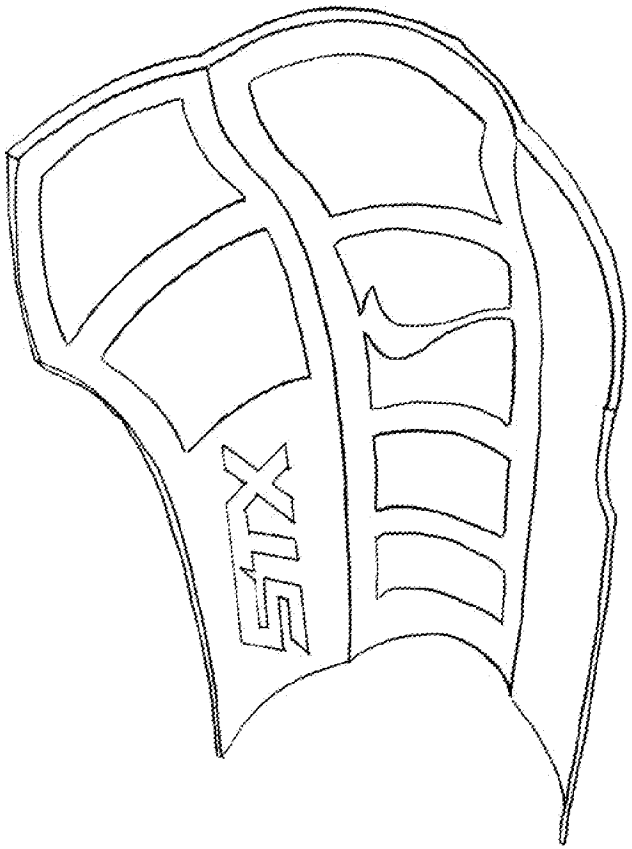
FIG. 30 is a perspective view of the scoop-type throwing head, illustrating that portions may be removed.

FIG. 30 is a perspective front view of a portion of the scoop-type throwing head, illustrating that portions may be removed to achieve lighter weight and improved aerodynamics without decreasing strength. Removal of portions may also be done in an ornamental design, including incorporation of brand logos. Along the spine of the throwing head is shown an integral branding element, here the commonly recognized "swoosh" trademark of Nike, Inc. Along the sidewall of the throwing head is shown an integral branding element, here the stylized lettering "STX", a trademark of STX, LLC, and STX, Inc., Baltimore, Md., a well know manufacturer of sporting goods equipment.

Figure 31:
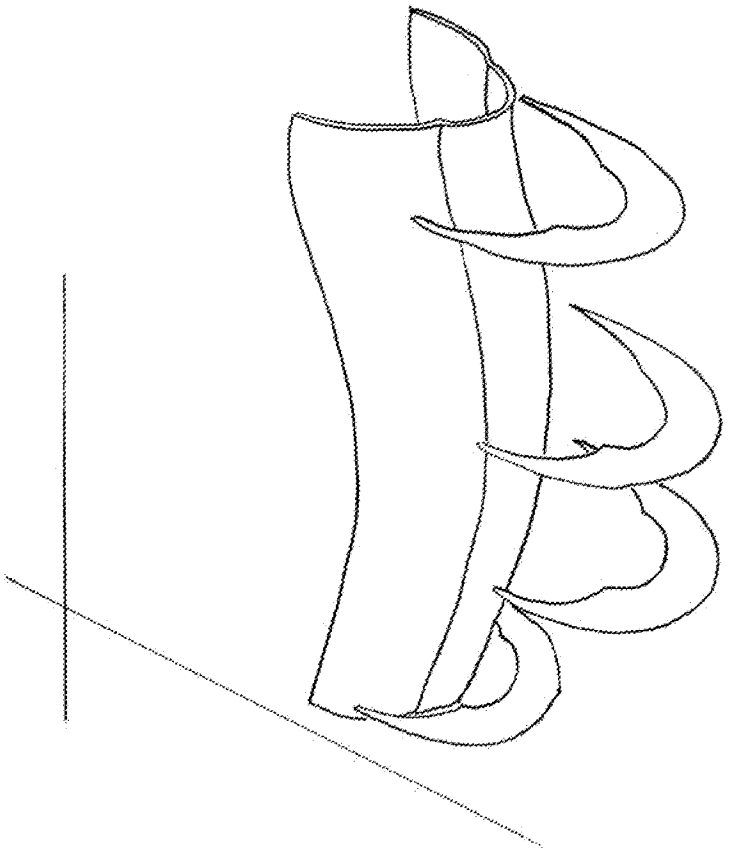
FIG. 31 is a perspective view showing stabilizing fins to be attached to the scoop-type throwing head.

FIG. 31 is a perspective view showing stabilizing fins to be attached to the scoop-type throwing head.

Figure 32:
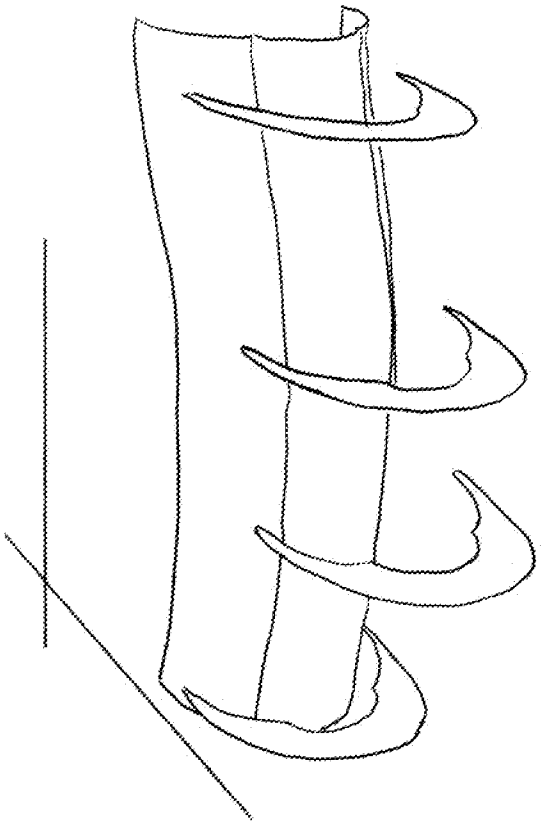
FIG. 32 is a perspective view showing stabilizing fins to be attached to the scoop-type throwing head.

FIG. 32 is a perspective view showing stabilizing fins to be attached to the scoop-type throwing head.

Figure 33:
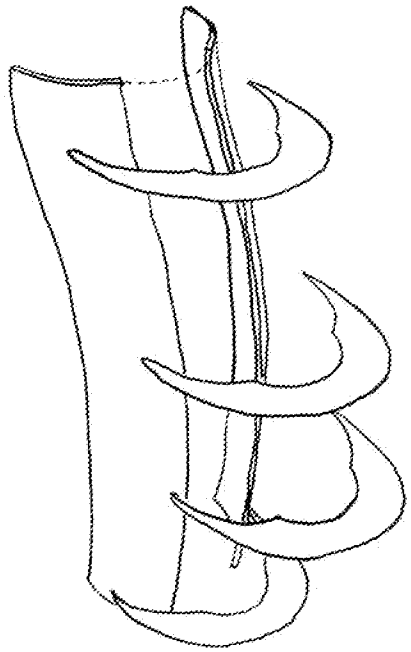
FIG. 33 is a perspective view showing stabilizing fins to be attached to the scoop-type throwing head, with part of the throwing head having been removed.

FIG. 33 is a perspective view showing stabilizing fins to be attached to the scoop-type throwing head, with part of the throwing head having been removed.

Figure 34:
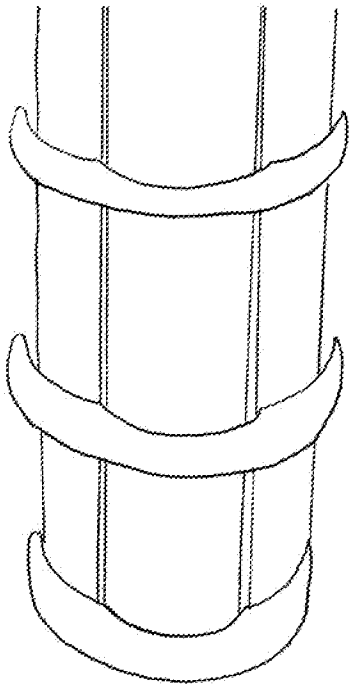
FIG. 34 is a rear perspective view showing stabilizing fins to be attached to the scoop-type throwing head, with part of the throwing head having been removed.

FIG. 34 is a rear perspective view showing stabilizing fins to be attached to the scoop-type throwing head, with part of the throwing head having been removed.

Figure 35:
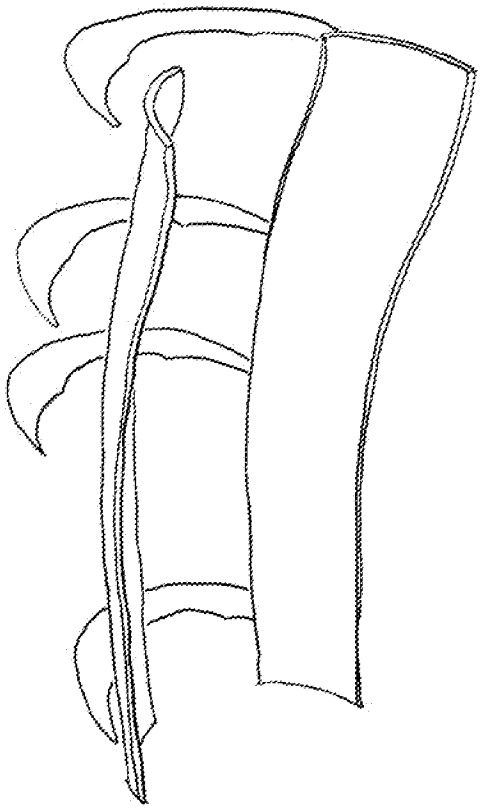
FIG. 35 is a partial front perspective view showing stabilizing fins to be attached to the scoop-type throwing head, with part of the throwing head having been removed.

FIG. 35 is a partial front perspective view showing stabilizing fins to be attached to the scoop-type throwing head, with part of the throwing head having been removed.

Figure 36:
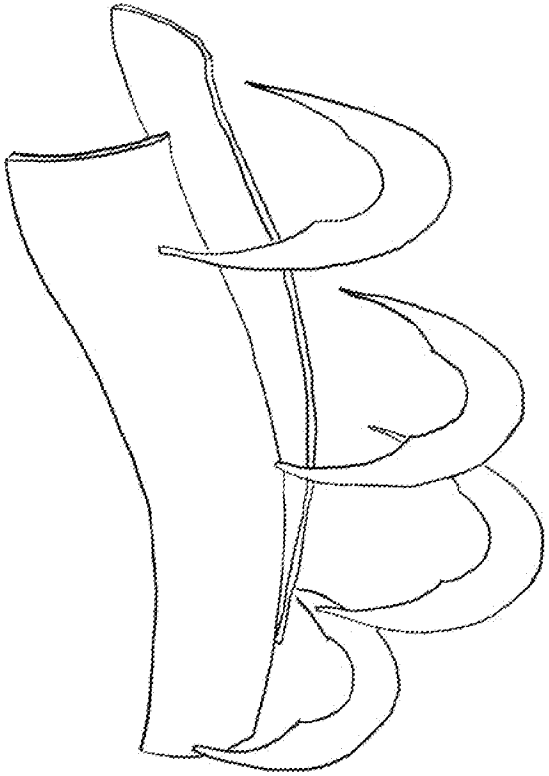
FIG. 36 is a perspective view showing stabilizing fins to be attached to the scoop-type throwing head, with part of the throwing head having been removed.

FIG. 36 is a perspective view showing stabilizing fins to be attached to the scoop-type throwing head, with part of the throwing head having been removed.

Figure 37:
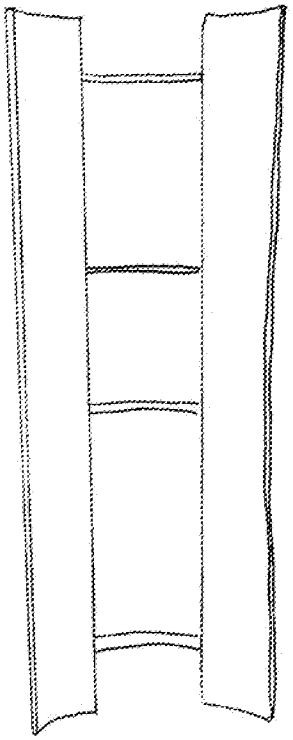
FIG. 37 is a front perspective view showing stabilizing fins to be attached to the scoop-type throwing head, with part of the throwing head having been removed.

FIG. 37 is a front perspective view showing stabilizing fins to be attached to the scoop-type throwing head, with part of the throwing head having been removed, but maintaining contact points x and y as in FIG. 14.

Figure 38B:
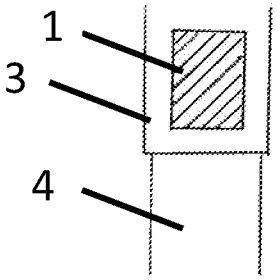
FIG. 38B illustrates a perspective view of a connecting adapter.
Figure 38A:
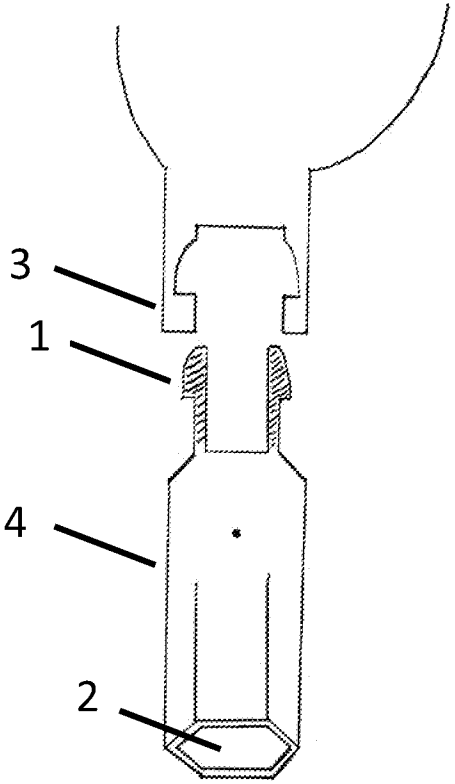
FIG. 38A illustrates an adapter configuration to attach a lacrosse shaft to the throwing head.

FIG. 38A illustrates an adapter configuration to attach a lacrosse shaft to the throwing head. Here, one end of the adapter is shaped as a quick-release, forked adapter end 38A-1, and the other end 38A-2 is shaped to accept a lacrosse shaft, here shown in hexagonal shape. The end 38-2 may also be shaped or sized to accept a golf shaft, or any other suitable shaft. The proximal end of the throwing head is shown with a corresponding fork adapter receiver 38A-3. The adapter 38A-4 is designed to mate with the throwing head in a manner that allows the throwing head to be securely connected to the shaft, yet remain simple and easy to remove, with the function of quickly changing throwing head and shaft combinations.

FIG. 38B illustrates a perspective view of the adapter 38B-4 being in mated configuration with the throwing head and particularly the corresponding fork adapter receiver 38-3. From this perspective, rotated 90 degrees about the longitudinal axis of the adapter, the fork adapter receiver 38-3 is shown with a window through which the user may pinch together the prongs of the forked adapter end 38-1 to disengage the adapter 38-4 from the throwing head.

Figure 39:
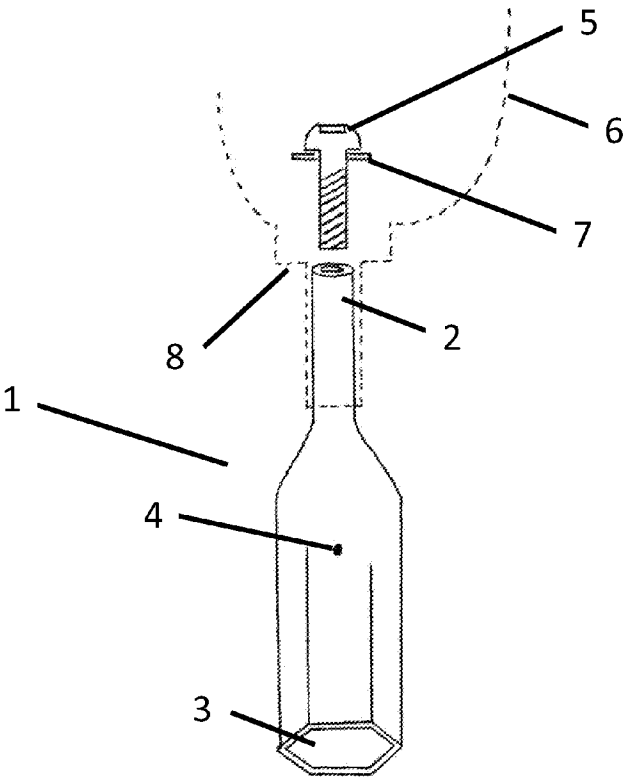
FIG. 39 illustrates an adapter configuration to attach a lacrosse shaft to the throwing head.

FIG. 39 illustrates an adapter configuration to attach a lacrosse shaft to the throwing head. In this embodiment, the adapter 39-1 has a first end 39-2, shown as approximating the dimension of the tip of a golf shaft, and a second end 39-3 being shaped to accept a lacrosse shaft, here shown in hexagonal shape. The adapter has a through hole 39-4 to accept a bolt or screw to secure the adapter to the shaft once inserted. The first end 39-2 is shown as being configured to accept a threaded screw or bolt 39-5 to secure the throwing head 39-6 to the adapter and shaft. An optional washer 39-7 is shown as engaging a shoulder 39-8, here shown as being integrally formed into the proximal end of the throwing head 39-6.

Figure 39B:
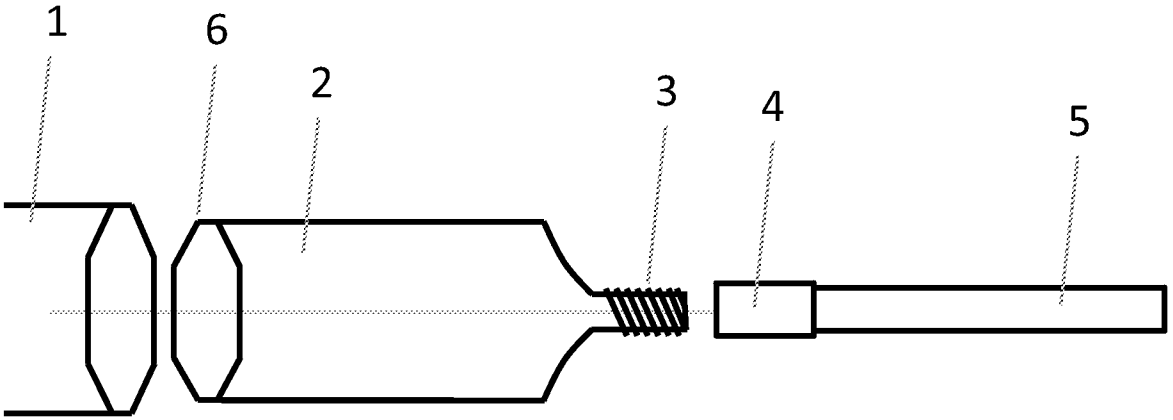
FIG. 39B illustrates an adapter configuration to attach a golf shaft to the throwing head.

FIG. 39B illustrates an adapter configuration to attach a golf shaft to the throwing head. In this embodiment, the adapter 39B-2 has a first end 39B-6, shown as approximating the dimension of an octagonal lacrosse shaft, and a second end 39B-3 being male-threaded to mate to a female attachment 39B-4 affixed to a golf shaft 39B-5. The first end 39B-6 of the adapter 39B-2 mates with the proximal end of the throwing head 39B-1, here illustrated as having an octagonal orifice configured to mate with a lacrosse shaft of octagonal dimension.

Figure 40:
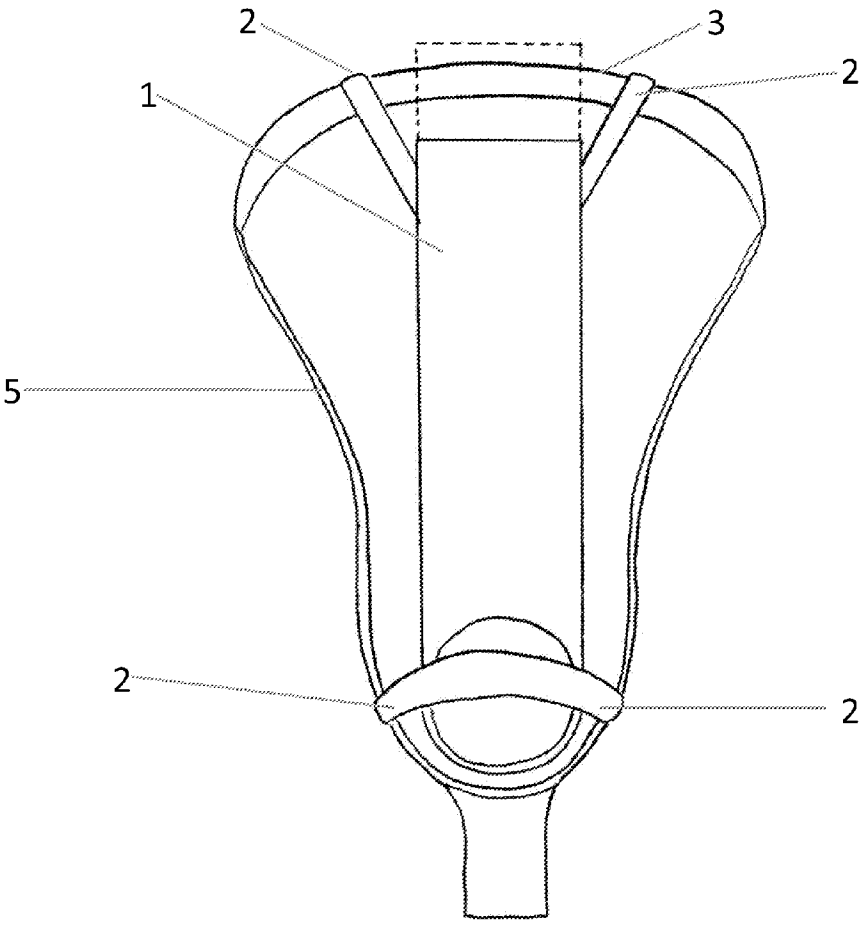
FIG. 40 illustrates another embodiment of a throwing head, being adapted to attach or mate to a conventional lacrosse head.

FIG. 40 illustrates another embodiment of a throwing head, being adapted to attach or mate to a conventional lacrosse head 40-5. Here, the throwing head 40-1 is sized for golf balls, and is secured into the pocket area of the conventional lacrosse head. In this embodiment, the throwing head comprises a securer 40-2 configured to connect a rigid throwing head ramp to a conventional lacrosse head. Here, the securer is shown as four points of contact with the rails of a conventional lacrosse head, wherein each point of contact comprises an arm that securely clasps to the rail of a conventional lacrosse head. In this embodiment, the lowermost two arms are designed to flex outward, both to seat the throwing head into the pocket-part of the conventional lacrosse head, for example by snapping onto the lacrosse head's side rail, and to facilitate quick removal of the throwing head apparatus, while the uppermost two arms clamp over the top or distal rail 40-3 of the frame of the conventional lacrosse head. Specialty lacrosse heads may be utilized, wherein the frame of the lacrosse head has elements integrated into the lacrosse head for the purpose of mating to and accepting this embodiment of the throwing head and its securer. The lacrosse head and the throwing head may be designed so that lacrosse head anchor or mating points correspond to the securer of the throwing head. Here, the throwing head is illustrated as being shorter in height than the conventional lacrosse head to which it attaches, but the dashed lines indicate the throwing head may be configured in height to pass the distal rail end of the conventional lacrosse head. Advantageously over the deep webbed pocket of the conventional lacrosse head, the rigid throwing head and launch ramp allows better throws of golf balls. The securer 40-2 may also include tie downs and anchor points, a hole through which a screw may secure the throwing head to the conventional lacrosse head, a quick release mechanism, and any other securer for securing the throwing head to a conventional lacrosse head.

Figure 40B:
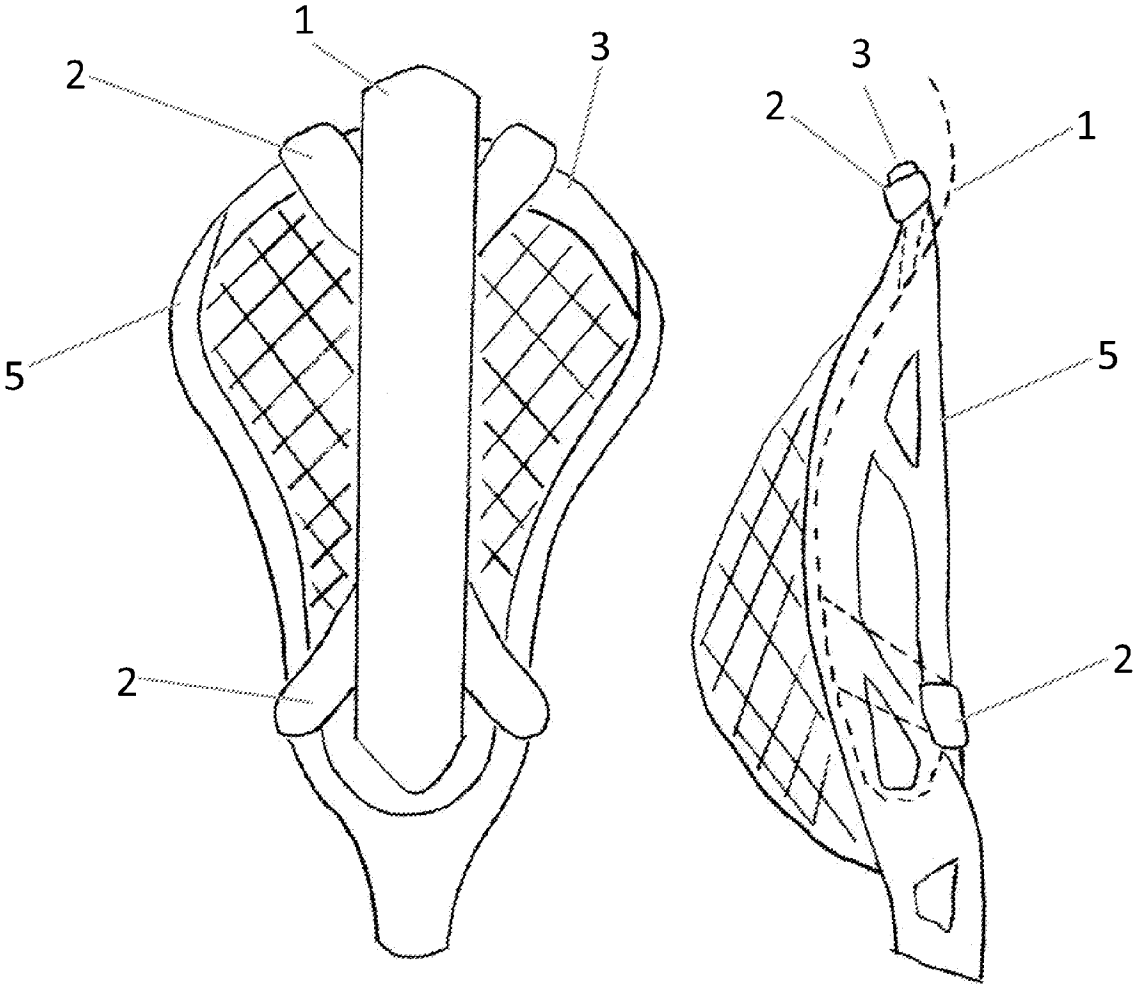
FIG. 40B illustrates another embodiment of a throwing head, being adapted to attach or mate to a conventional lacrosse head.

FIG. 40B illustrates another embodiment of a throwing head, being adapted to attach or mate to a conventional lacrosse head 40B-5. Here, the throwing head 40-1 is sized for golf balls, and is secured into the pocket area of the conventional lacrosse head 40B-5. In this embodiment, the throwing head comprises securer 40-2 to connect a rigid throwing head ramp to a conventional lacrosse head. Here, the securer is shown as four points of contact with the rails of a conventional lacrosse head, wherein each point of contact comprises an arm, or hook fastener, that securely clasps to the rail of a conventional lacrosse head. In this embodiment, the lowermost two arms are designed to flex, both to seat the throwing head into the pocket-part of the conventional lacrosse head, for example by snapping onto the lacrosse head's side rail, and to facilitate quick removal of the throwing head apparatus, while the uppermost two arms clamp over the top or distal rail 40-3 of the frame of the conventional lacrosse head. In FIG. 40B, the perspective view on the right illustrates that the securer 40B-2 clasp over the rail of the conventional lacrosse head, and the portions of the securer that are outside the perimeter of the conventional lacrosse head are indicated as being shaded. Specialty lacrosse heads may be utilized, wherein the frame of the lacrosse head has elements integrated into the lacrosse head for the purpose of mating to and accepting this embodiment of the throwing head and its securer. The lacrosse head and the throwing head may be designed so that lacrosse head anchor or mating points correspond to the securer of the throwing head. Here, the throwing head is illustrated as being taller in height than the conventional lacrosse head to which it attaches. Advantageously over the deep webbed pocket of the conventional lacrosse head, the rigid throwing head and launch ramp allows better throws of golf balls.

Figure 41:
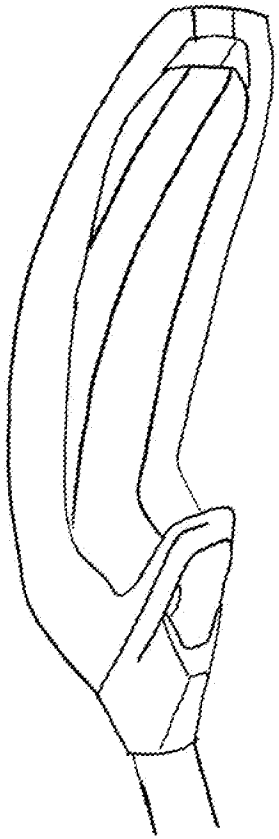
FIG. 41 illustrates an embodiment of the throwing head.

FIG. 41 illustrates an embodiment of the throwing head.

Figure 42:
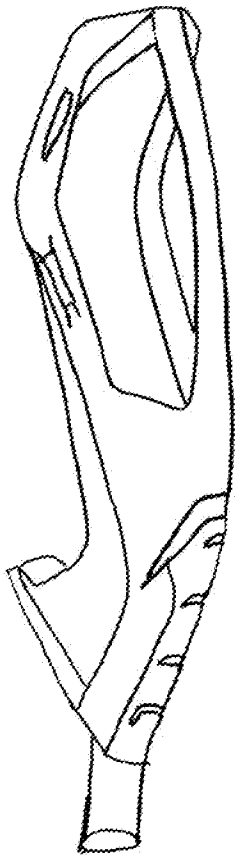
FIG. 42 illustrates an embodiment of the throwing head.

FIG. 42 illustrates an embodiment of the throwing head.

Figure 43:
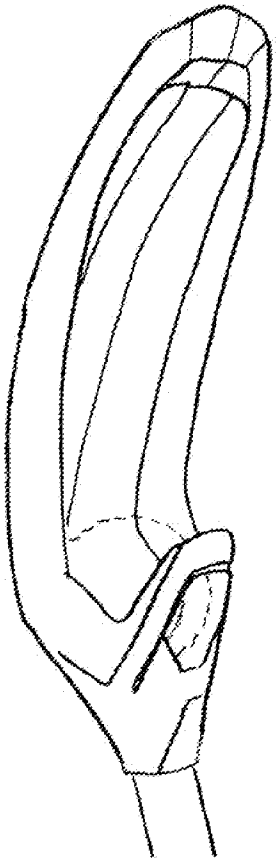
FIG. 43 illustrates an embodiment of the throwing head.

FIG. 43 illustrates an embodiment of the throwing head.

Figure 44:
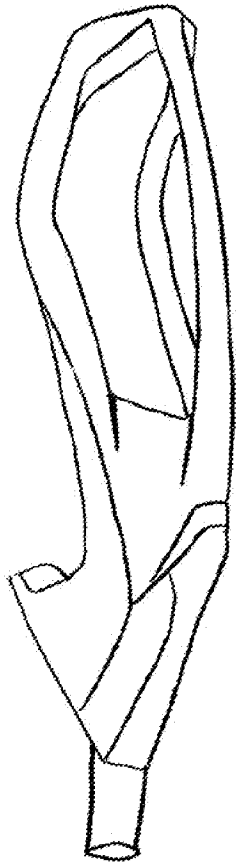
FIG. 44 illustrates an embodiment of the throwing head.

FIG. 44 illustrates an embodiment of the throwing head.

Figure 45:
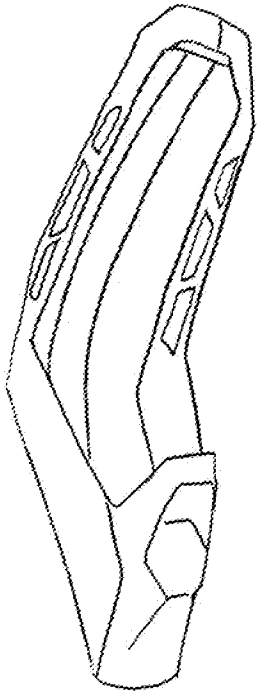
FIG. 45 illustrates an embodiment of the throwing head.

FIG. 45 illustrates an embodiment of the throwing head.

Figure 46:
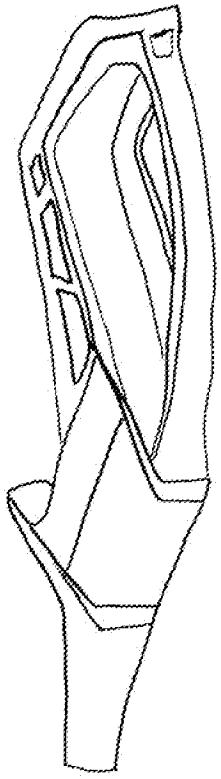
FIG. 46 illustrates an embodiment of the throwing head.

FIG. 46 illustrates an embodiment of the throwing head.

Figure 47:
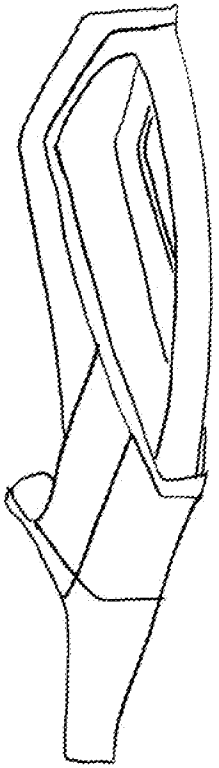
FIG. 47 illustrates an embodiment of the throwing head.

FIG. 47 illustrates an embodiment of the throwing head.

Figure 48:
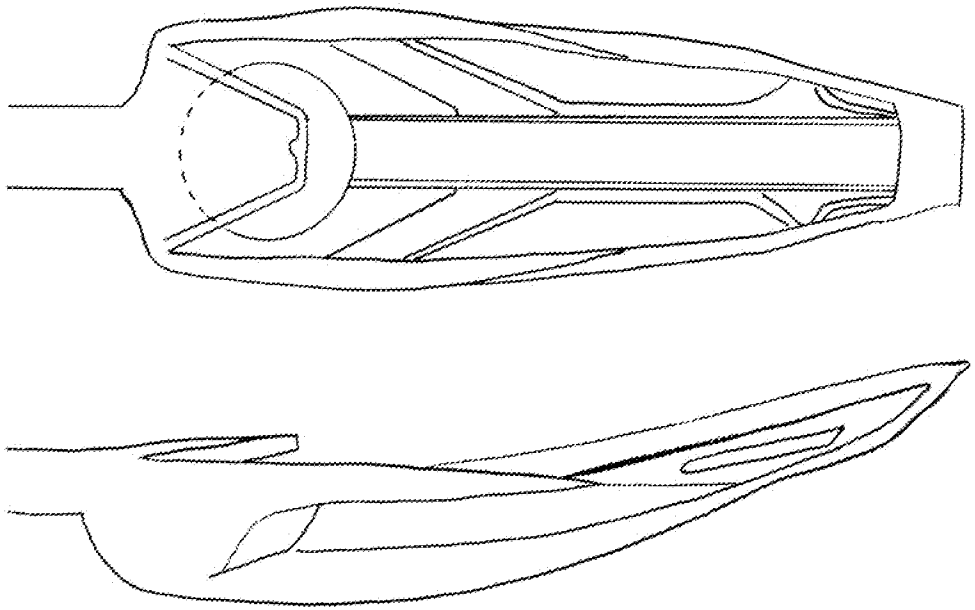
FIG. 48 illustrates an embodiment of the throwing head, from a front perspective and a side perspective.

FIG. 48 illustrates an embodiment of the throwing head, from a front perspective and a side perspective.

Figure 49:
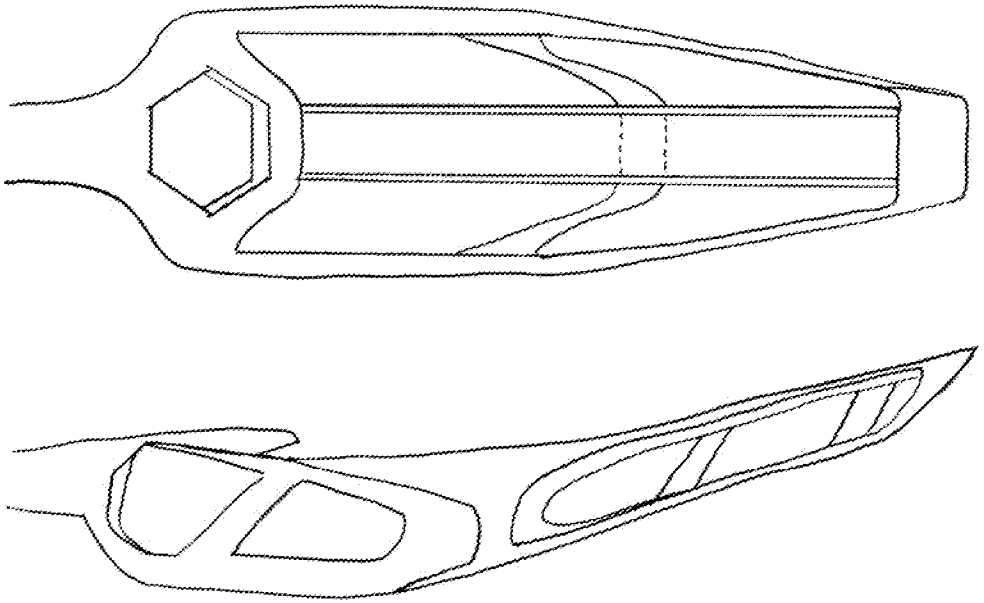
FIG. 49 illustrates an embodiment of the throwing head, from a front perspective and a side perspective.

FIG. 49 illustrates an embodiment of the throwing head, from a front perspective and a side perspective.

Figure 50:
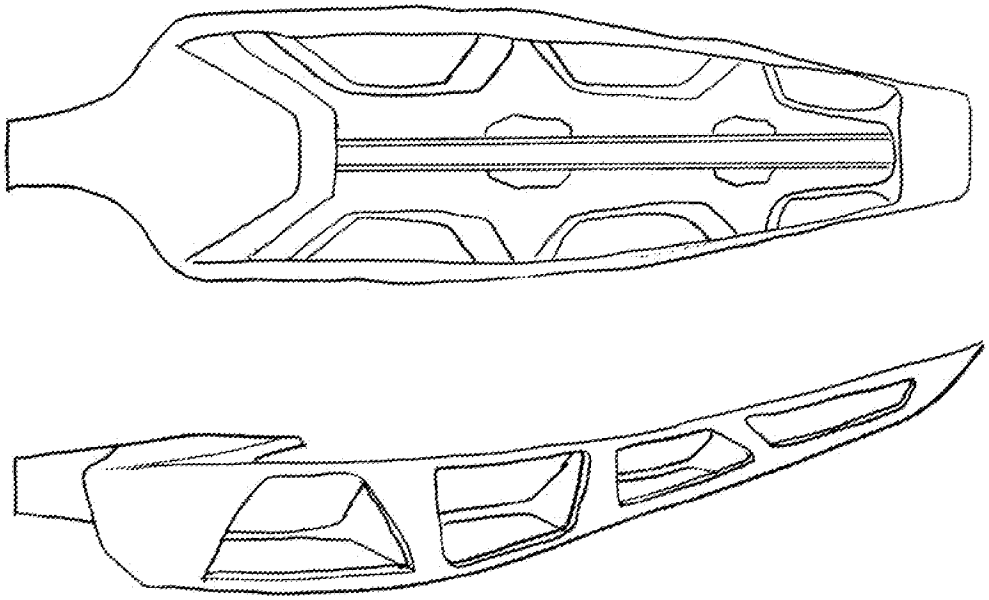
FIG. 50 illustrates an embodiment of the throwing head, from a front perspective and a side perspective.

FIG. 50 illustrates an embodiment of the throwing head, from a front perspective and a side perspective.

Figure 51:
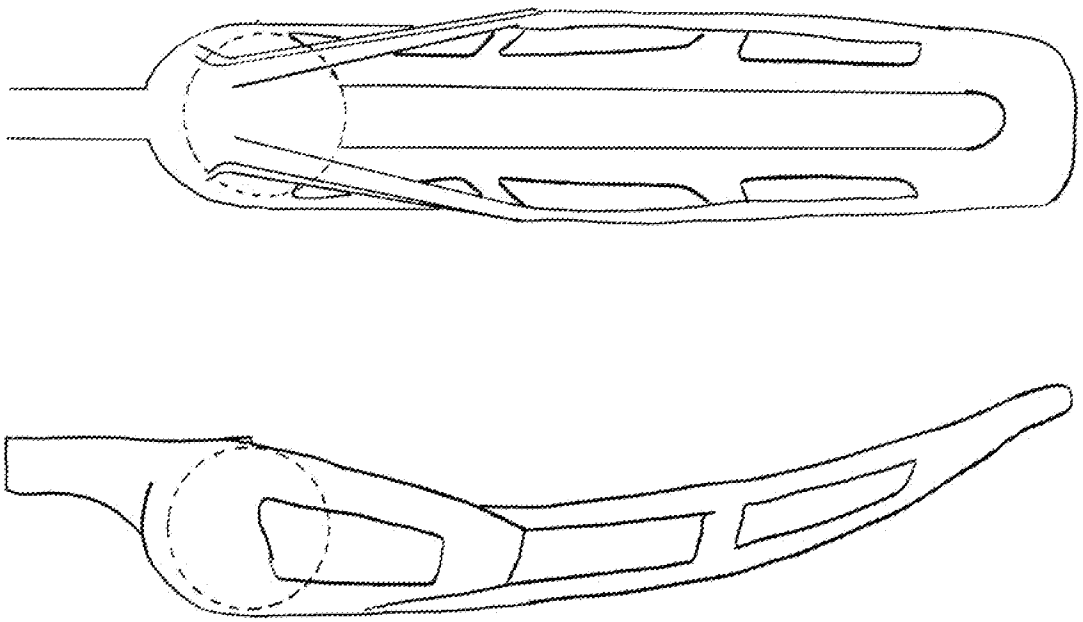
FIG. 51 illustrates an embodiment of the throwing head, from a front perspective and a side perspective.

FIG. 51 illustrates an embodiment of the throwing head, from a front perspective and a side perspective.

Figure 52:
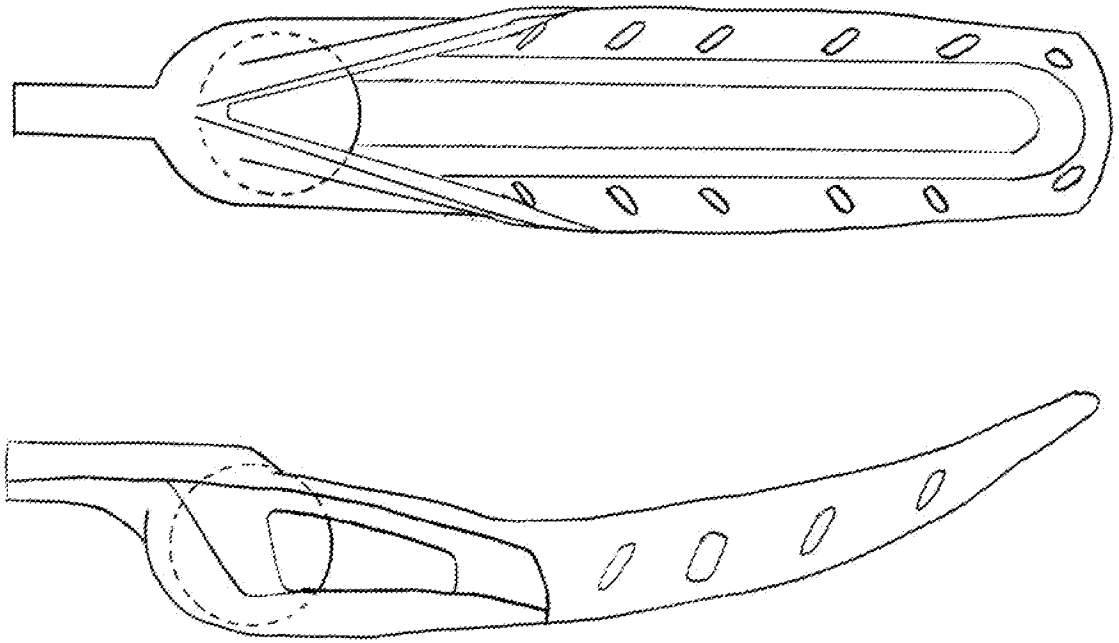
FIG. 52 illustrates an embodiment of the throwing head, from a front perspective and a side perspective.

FIG. 52 illustrates an embodiment of the throwing head, from a front perspective and a side perspective.

Figure 53:
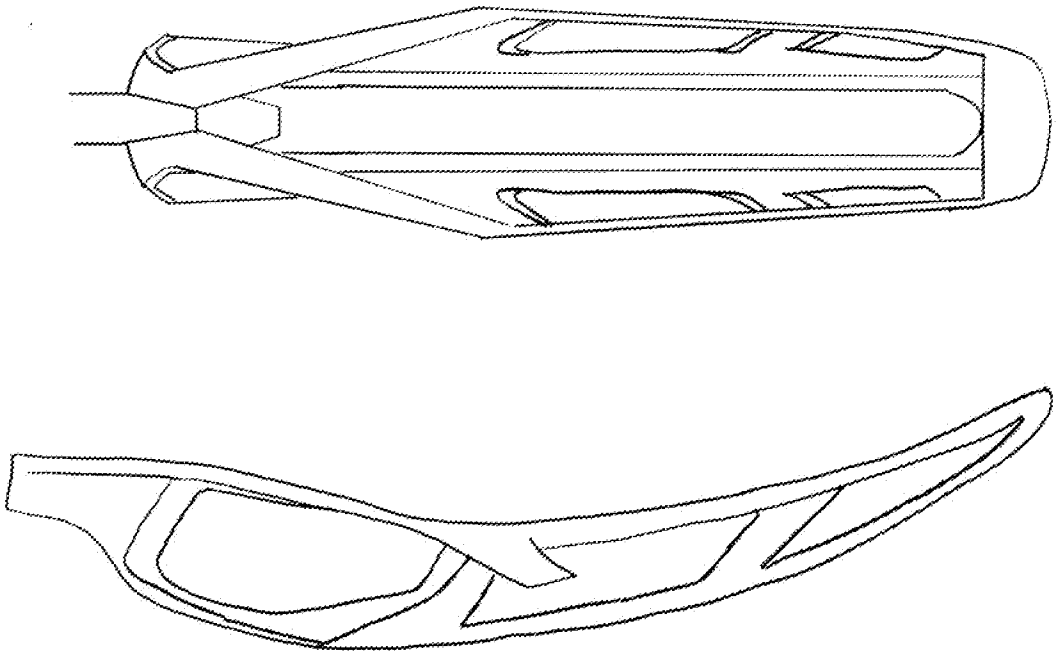
FIG. 53 illustrates an embodiment of the throwing head, from a front perspective and a side perspective.

FIG. 53 illustrates an embodiment of the throwing head, from a front perspective and a side perspective.

Figure 53A:
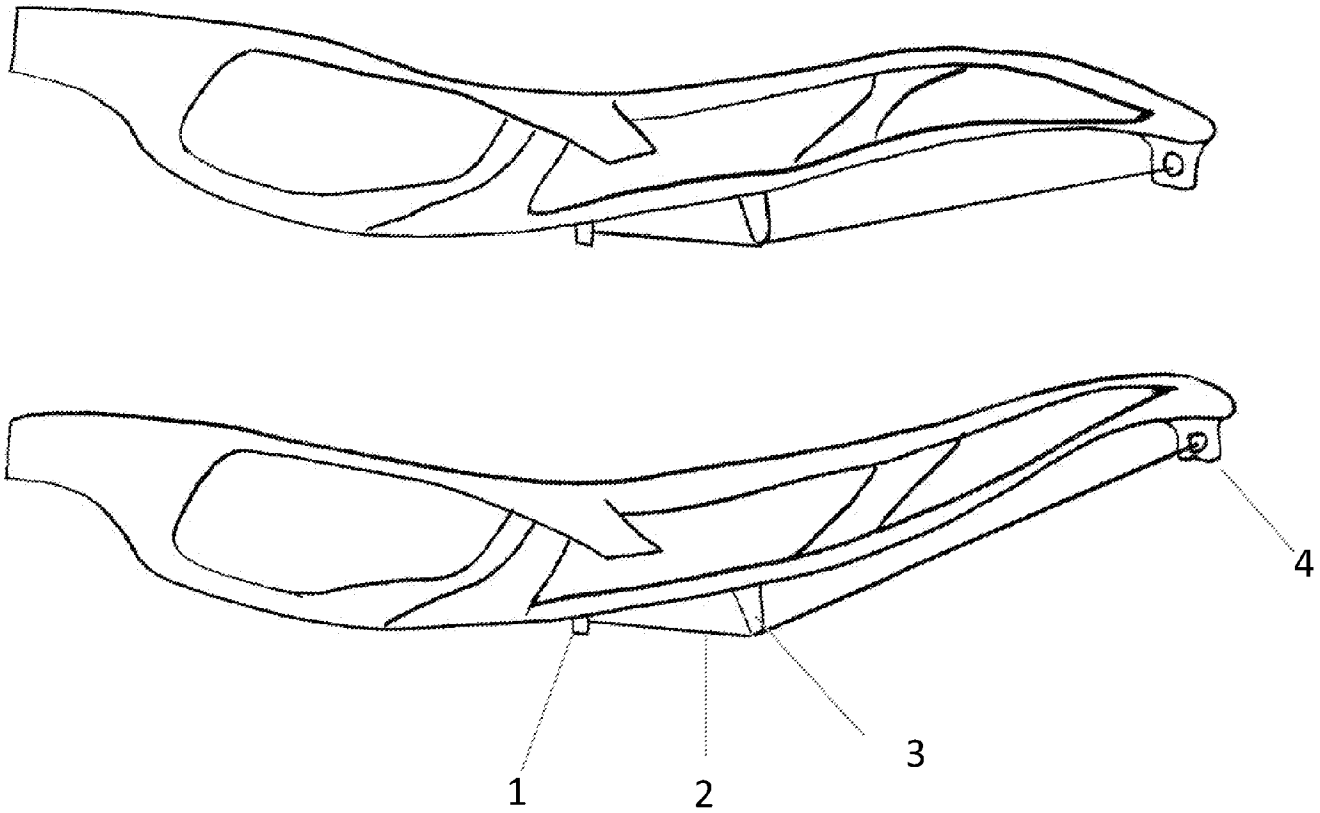
FIG. 53A illustrates an embodiment of the throwing head, from a side perspective with a terminus angle adjustment mechanism.

FIG. 53A illustrates an embodiment of the throwing head, from a side perspective with a terminus angle adjustment mechanism to form a variable retrograde terminus angle. In this embodiment, the terminus angle adjustment mechanism comprises a tensioning element 53-1, a tension member 53-2, a fulcrum 53-3, and an anchor tab 53-4. The tensioning element 53-1 is shown as a screw that may be rotated to coil or release a segment of the tension member 53-2, which is illustrated as a rope or cable-type filament that may be placed in tension by being strung over the fulcrum 53-3 and attached to the distal end at the anchor tab 53-4. When the tensioning element 53-1 is rotated to coil the tension member 53-2, the distal end of the throwing head is deformed to form a variable retrograde terminus. Preferably, the throwing head at its terminus is constructed of an elastic material, wherein an application of tension or stress at the anchor tab 53-4 will cause deflection without breakage, and wherein the removal of such tension or stress will cause the throwing head to return to its original shape.

Figure 54:
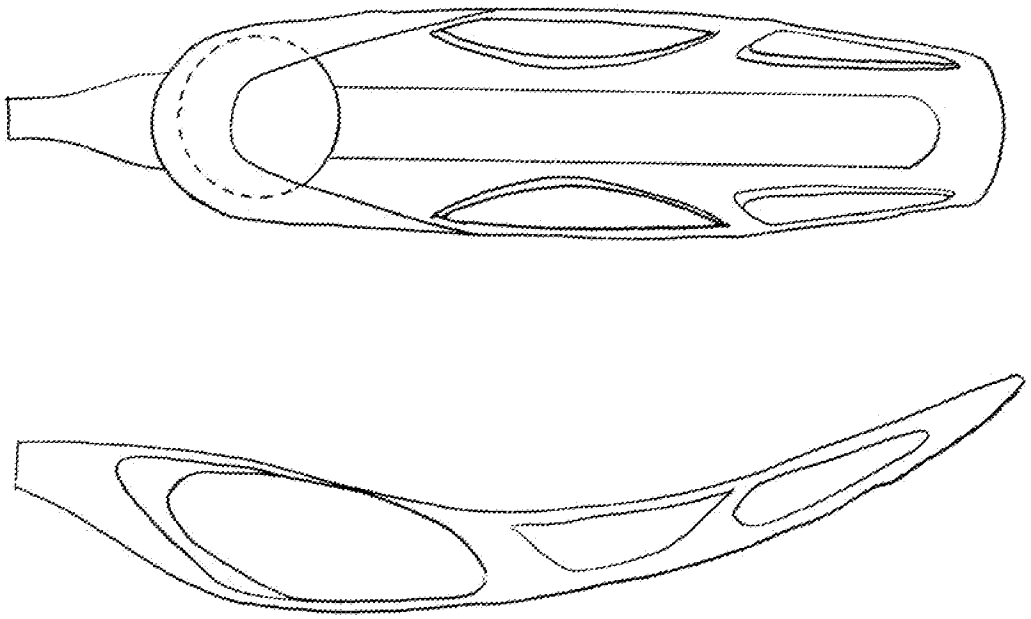
FIG. 54 illustrates an embodiment of the throwing head, from a front perspective and a side perspective.

FIG. 54 illustrates an embodiment of the throwing head, from a front perspective and a side perspective.

Figure 55:
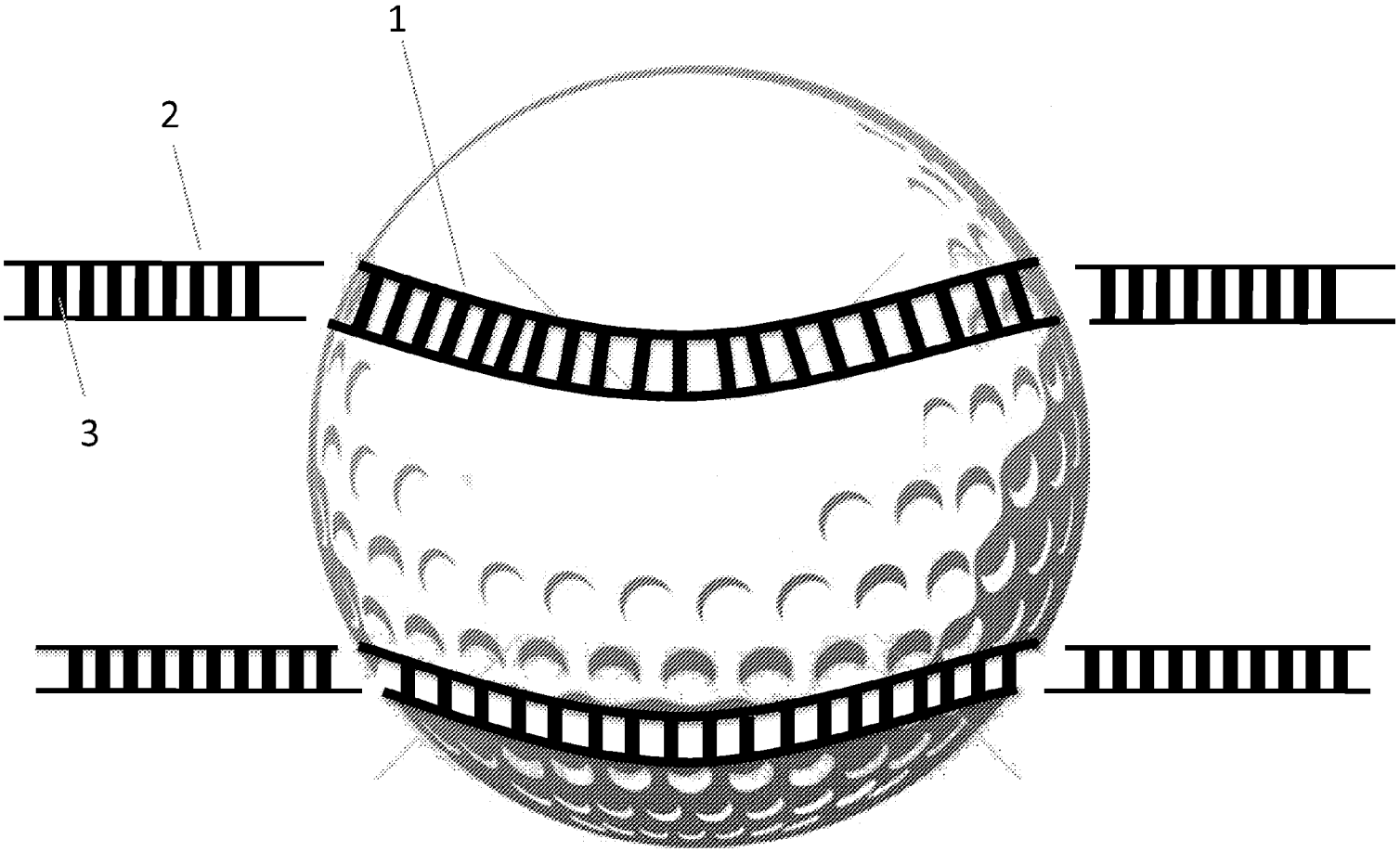
FIG. 55 illustrates a specialty ball for use with the throwing head.

FIG. 55 illustrates a specialty ball for use with the throwing head. Here, a golf ball sized ball is illustrated with dimples and with a pair of surface treatments 55-1 intended to function with the friction-based engager of the throwing head. An embodiment of a friction-based engager is illustrated as a parallel track 55-2 with gear-type serrations 55-3, and the projectile is illustrated with corresponding surface treatment 55-1 to mate with the gear-type serrations 55-3, such that the ball rolls along the throwing head ramp with reduced slipping. The illustrated pair of surface treatments 55-1 circles the ball, and the pair are spaced at a distance to correspond to a chord of the cross section of the ball to match the distance between the parallel track 55-2 to ensure mated engagement. The surface treatment 55-1 may be molded into the ball, as would be done with dimples in the manufacture of golf balls. Alternatively, surface treatment 55-1 may comprise material differing from the covering of the remainder of the ball, for example a rubber compound that may be more pliable or likely to engage the friction-based engager than would a golf ball with a uniform, integral surface treatment such as urethane, balata, or SURLYN, the trade name used by the E.I. DuPont Company for a synthetic, highly resilient, durable material that is used in the majority of golf balls in the golf industry. The surface treatment 55-1 may comprise metal rings, for example to increase wear and to mate with gear-type serrations 55-3 of the throwing head.

Figure 55B:
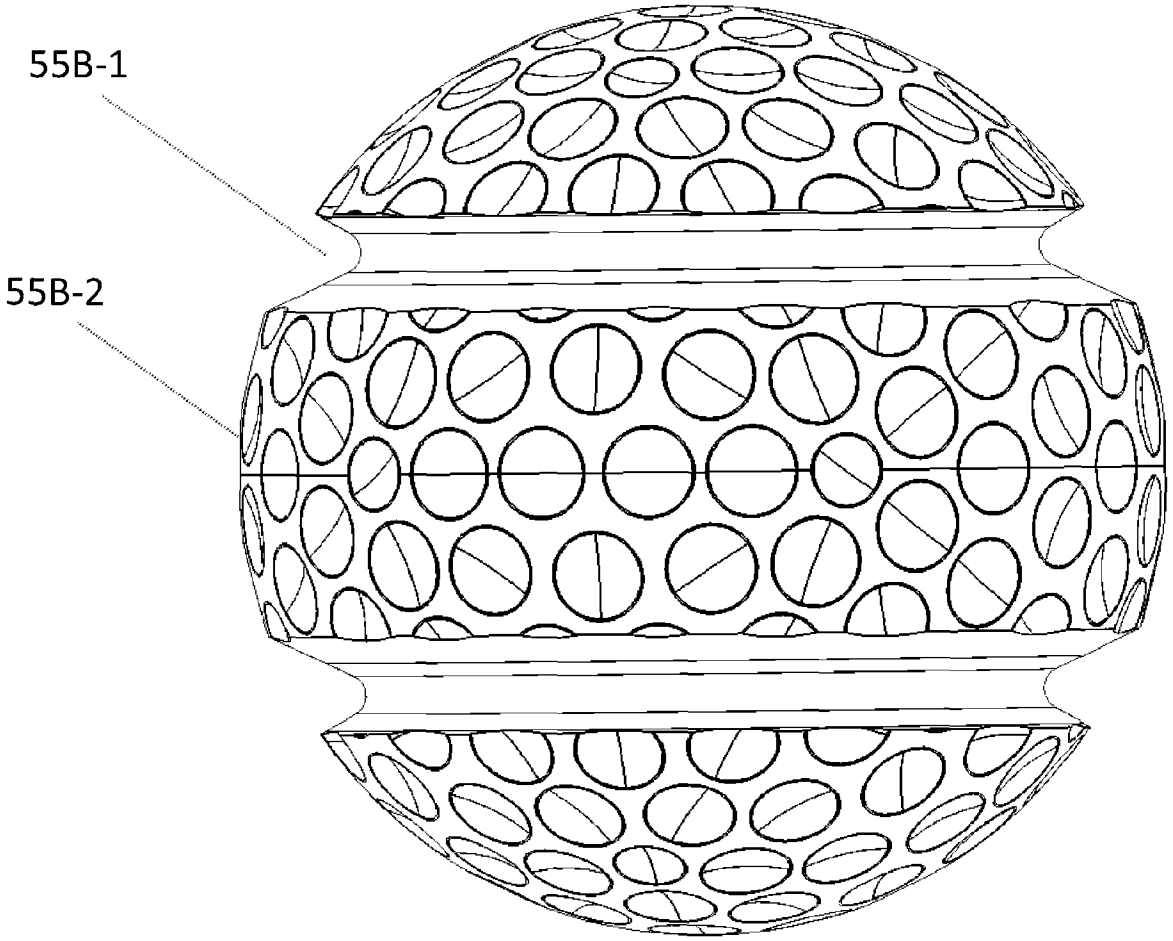
FIG. 55B illustrates a specialty ball for use with the throwing head.

FIG. 55B illustrates a specialty ball for use with the throwing head. Here, a golf ball sized ball is illustrated, by line drawing, with dimples and with a first area surface treatment intended to function with the friction-based engager of the throwing head. Here, similar to FIG. 55, the first area surface treatment is illustrated as a small circle parallel track 55B-1 about the sphere, said track being configured to engage a throwing head ramp (See, e.g. FIG. 63, at 63-1). The small circle parallel track 55B-1 in this embodiment is illustrated as being slightly recessed from the outermost circumference of the specialty ball, and the recess is optimally shaped to matingly engage the throwing ramp. These recesses may comprise a friction-based engager, for example, a different material of construction, teeth, gears, indents, bumps, or the like. The second area 55B-2, shown as a dimpled surface, is here shown as the remainder of the sphere apart from the small circle parallel track 55B-1. The second area 55B-2 appears as non-contiguous, as it is interrupted by the small circle parallel track 55B-1. For adornment, the specialty ball may be colored differently in different areas.

Figure 55C:
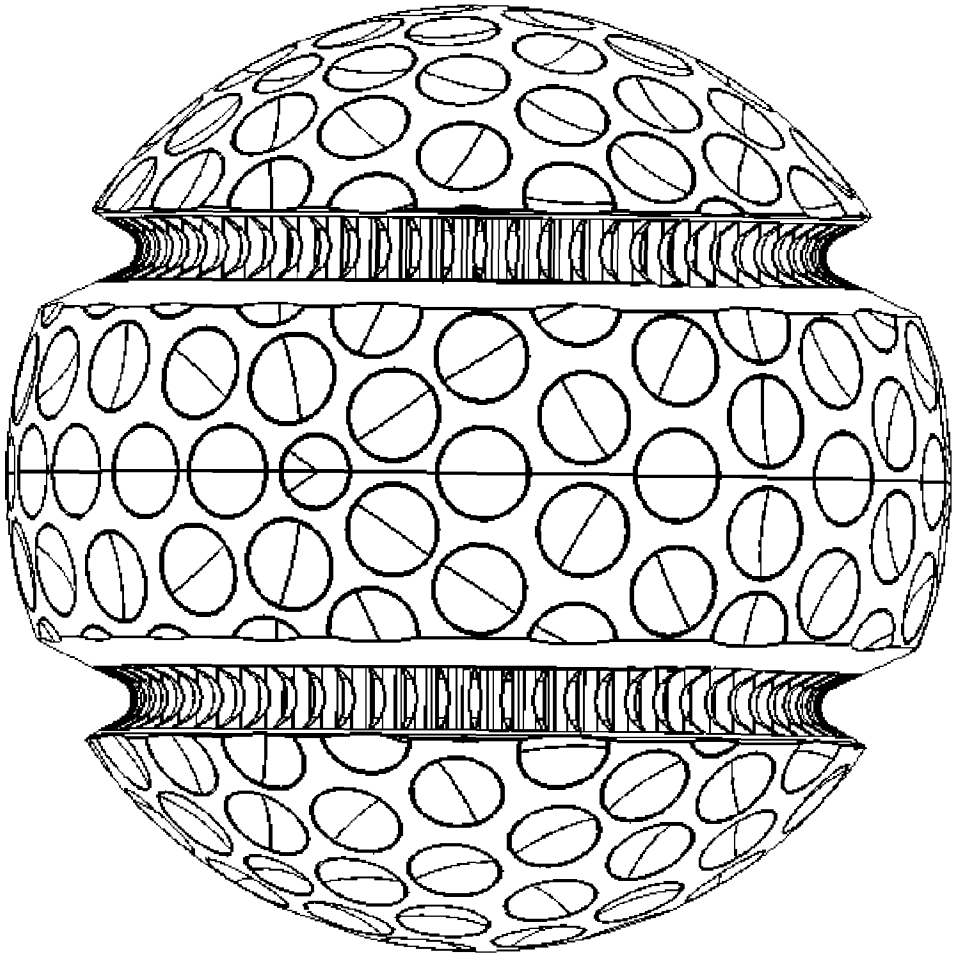
FIG. 55C illustrates a specialty ball for use with the throwing head.

FIG. 55C illustrates a specialty ball for use with the throwing head. Here, a golf ball sized ball is illustrated, by line drawing, with dimples and with a first area surface treatment intended to function with the friction-based engager of the throwing head. The small circle parallel track in this embodiment is illustrated as being slightly recessed from the outermost circumference of the specialty ball, and the recess is optimally shaped to matingly engage the throwing ramp. These recesses here comprise a friction-based engager, shown as gears.

Figure 56:
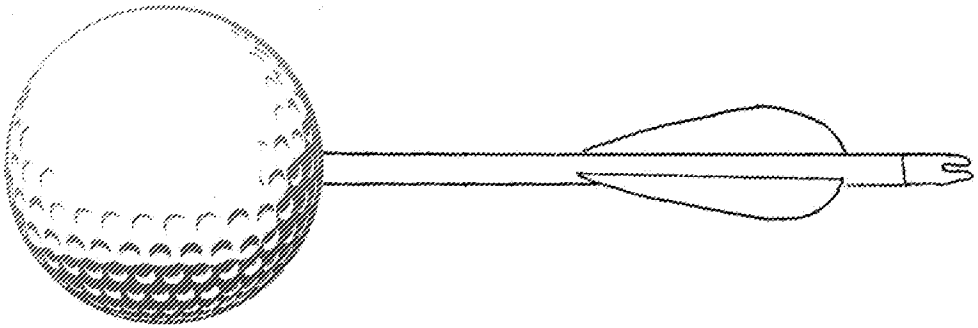
FIG. 56 illustrates a specialty projectile.

FIG. 56 illustrates a projectile comprising a golf ball, an archery arrow-type shaft affixed to the golf ball, and stabilizing fins or fletching affixed to the arrow-type shaft. The surface treatments of FIG. 55 may also be used with this projectile embodiment. This specialty projectile may also be used as a type of crossbow-type bolt. A crossbow may be configured to accept this specialty projectile, and a crossbow or crossbow-type or stringed launcher may be used to launch the projectile much greater distances than may be achieved with a throw alone. In the game of throw golf, such a launcher may be used for "drives", or when the projectile is required to be propelled great distances, for example in the range of hundreds of yards. This embodiment of the specialty projectile facilitates golf by handicapped persons, allowing the athlete to use a launching device from a tee box, a throwing apparatus for shorter distances, while switching to a standard golf ball for putting on a golf green.

Figure 57B:
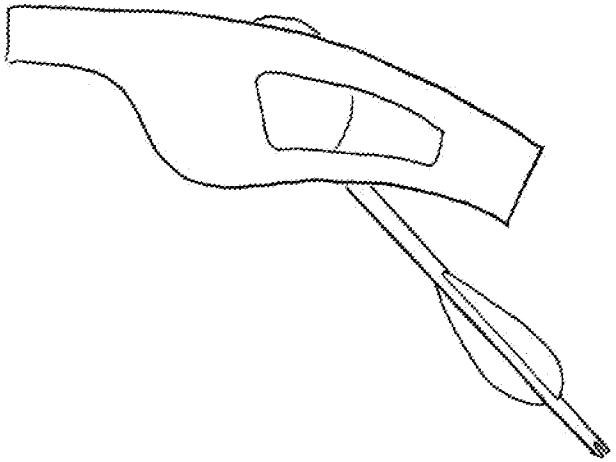
FIG. 57B illustrates an embodiment of the throwing head with a retrograde terminus and adapted to be used with a specialty projectile.
Figure 57:
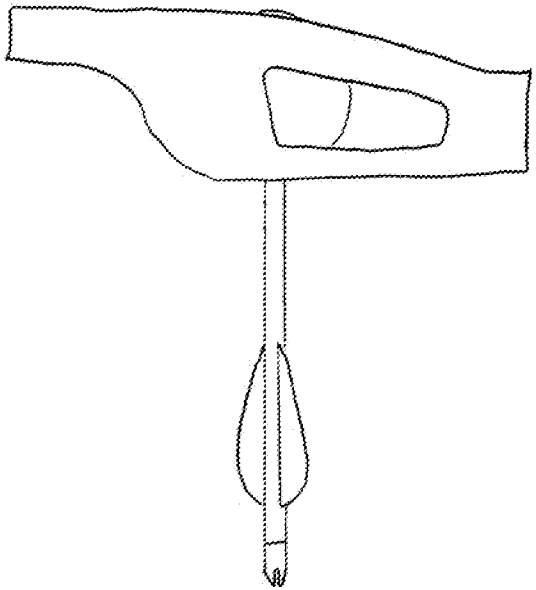
FIG. 57 illustrates an embodiment of the throwing head, adapted to be used with a specialty projectile.

FIG. 57 illustrates an embodiment of the throwing head, adapted to be used with the projectile of FIG. 56.

FIG. 57B illustrates an embodiment of the throwing head, adapted to be used with the projectile of FIG. 56, wherein the projectile is loaded into the throwing head with the arrow-type shaft positioned at an angle. This embodiment also illustrates that the length of the throwing head is short, but comprising a retrograde terminus. As the projectile rolls to the distal end, the arrow-type shaft achieves a desired launch angle when released from the throwing head, illustrated in FIG. 57C.

Figure 57C:
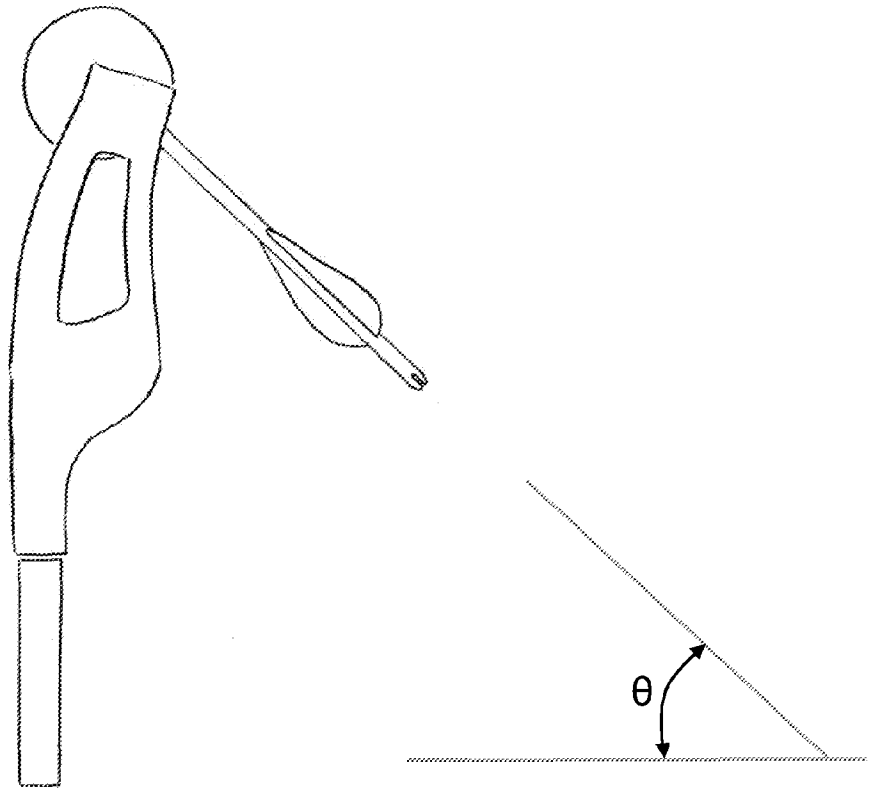
FIG. 57C illustrates an embodiment of the throwing head as in FIG. 57B, mounted to a shaft, and in the vertical position during a throw.

FIG. 57C illustrates an embodiment of the throwing head as in FIG. 57B, mounted to a shaft, and in the vertical position during a throw. The projectile has rolled to the distal end, rotating the arrow-type shaft to achieve a launch angle, theta (θ). The projectile launches, with the fletching helping to stabilize the flight trajectory.

Figure 58:
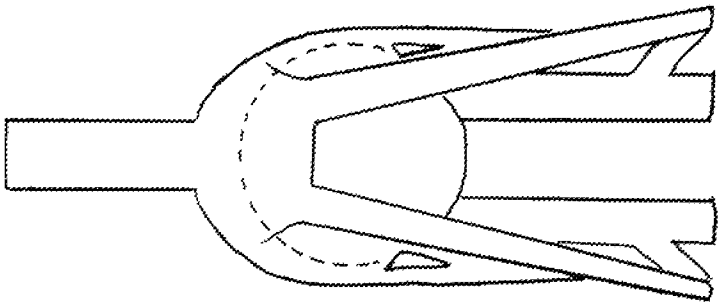
FIG. 58 illustrates the front view of an embodiment of the throwing head, adapted to be used with a specialty projectile.

FIG. 58 illustrates the front view of an embodiment of the throwing head, adapted to be used with the projectile of FIG. 56. In this embodiment, the throwing head is shorter in height, and the distal end is left open to allow through passage of the arrow-type shaft when the projectile is launched.

Figure 59:
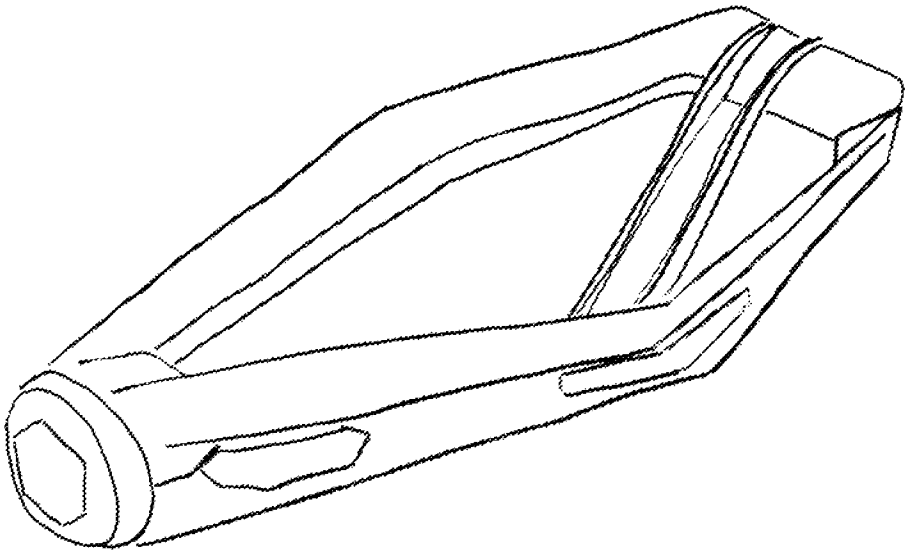
FIG. 59 illustrates an embodiment of the throwing head.

FIG. 59 illustrates an embodiment of the throwing head.

Figure 60:
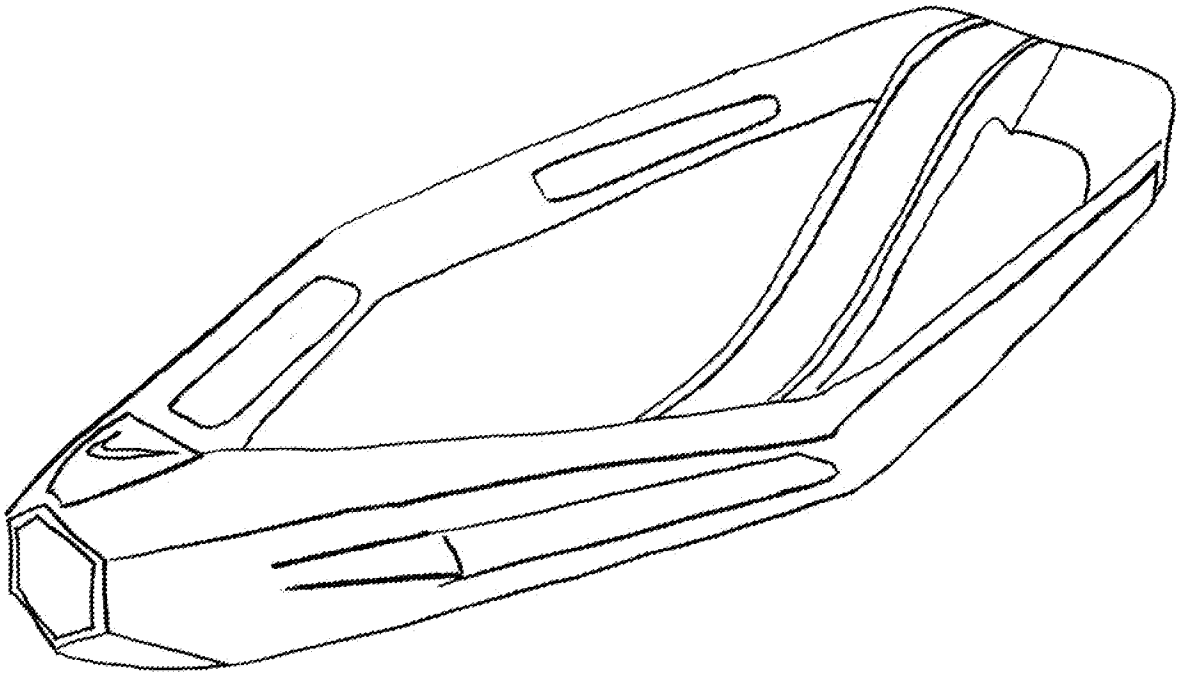
FIG. 60 illustrates an embodiment of the throwing head.

FIG. 60 illustrates an embodiment of the throwing head.

Figure 61:
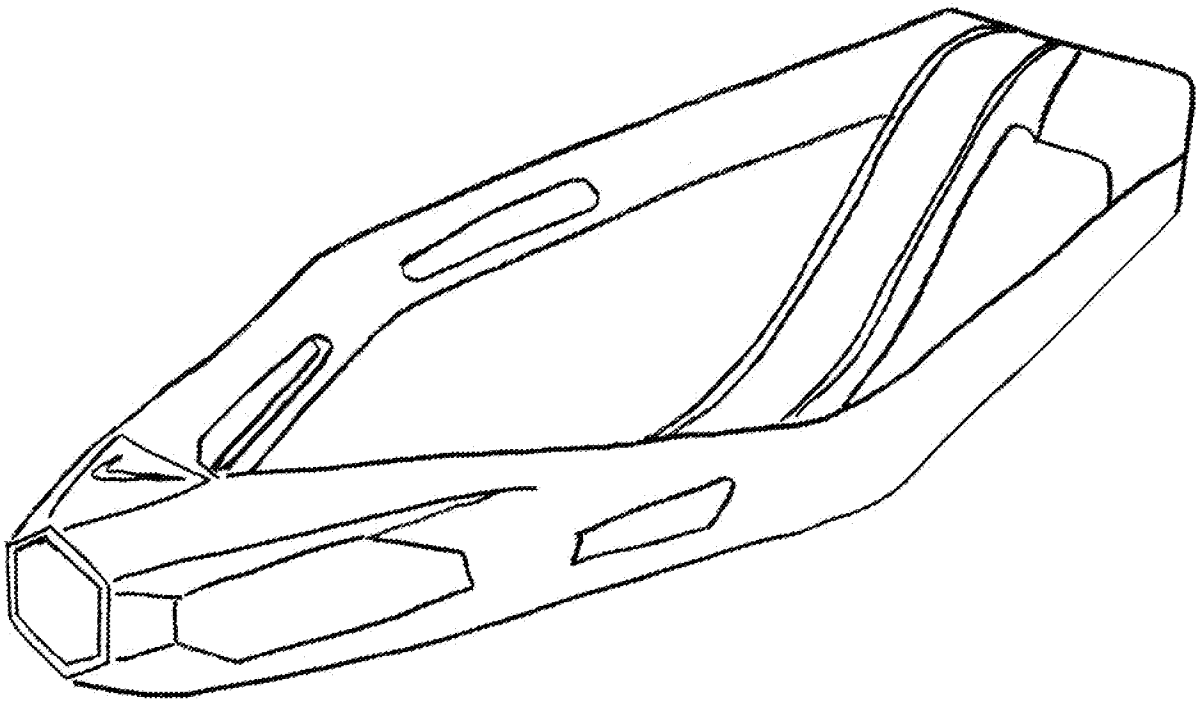
FIG. 61 illustrates an embodiment of the throwing head.

FIG. 61 illustrates an embodiment of the throwing head.

Figure 62C:
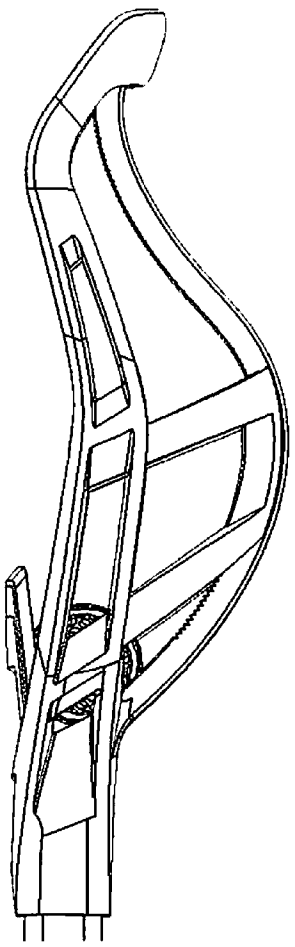
FIG. 62A, FIG. 62B, and FIG. 62C each illustrates an embodiment of the throwing head, from different perspectives.
Figure 62B:
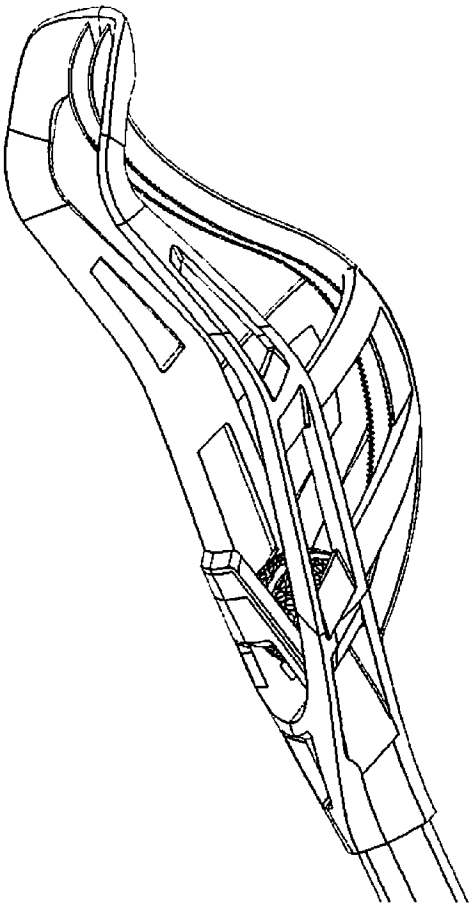
Figure 62A:
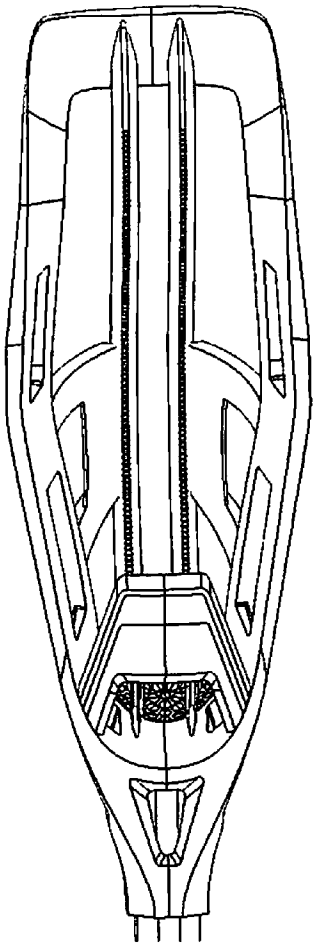

FIG. 62A illustrates an embodiment of the throwing head, from a front perspective, with a specialty projectile seated in a pocket.

FIG. 62B illustrates an embodiment of the throwing head, from a partial side perspective, with a specialty projectile seated in a pocket.

FIG. 62C illustrates an embodiment of the throwing head, from a partial side perspective, with a specialty projectile seated in a pocket.

Figure 63:
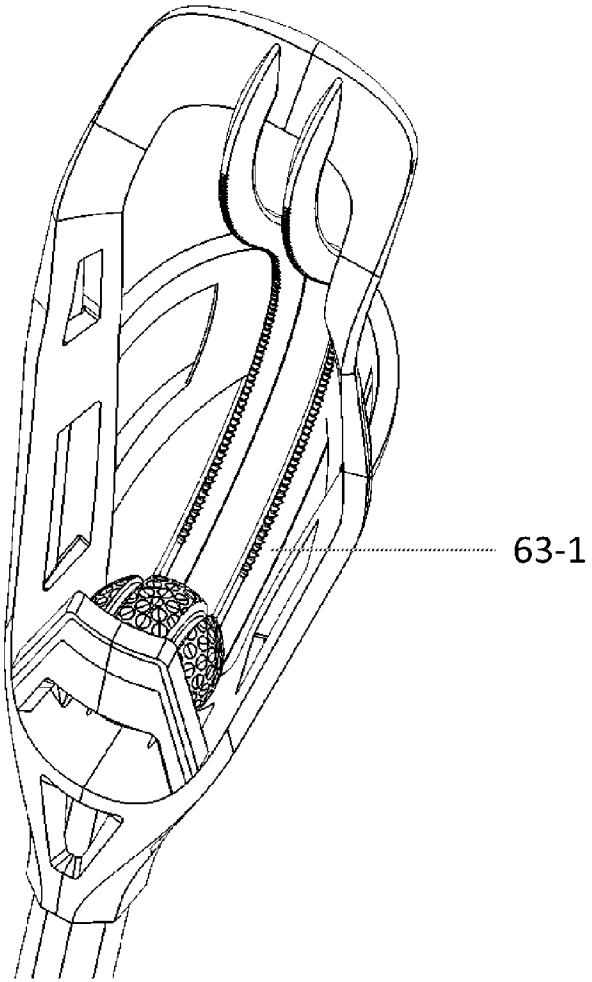
FIG. 63 illustrates an embodiment of the throwing head, and an embodiment of a specialty projectile.

FIG. 63 illustrates an embodiment of the throwing head, from a partial front perspective, with a specialty projectile seated in a pocket. A throwing ramp 63-1 is illustrated comprising a friction-based engager (here, teeth) adapted to engage a projectile. Illustrated is a specialty projectile, as shown in FIG. 55B.

Figure 64C:
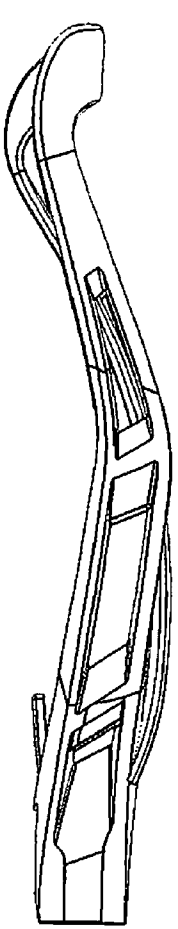
FIG. 64A, FIG. 64B, and FIG. 64C each illustrates an embodiment of the throwing head.
Figure 64B:
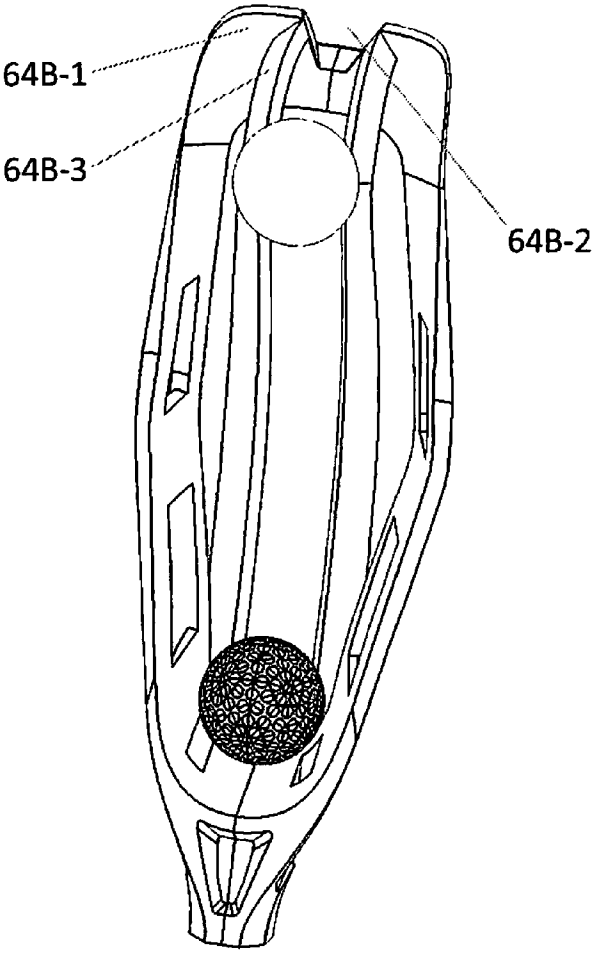
Figure 64A:
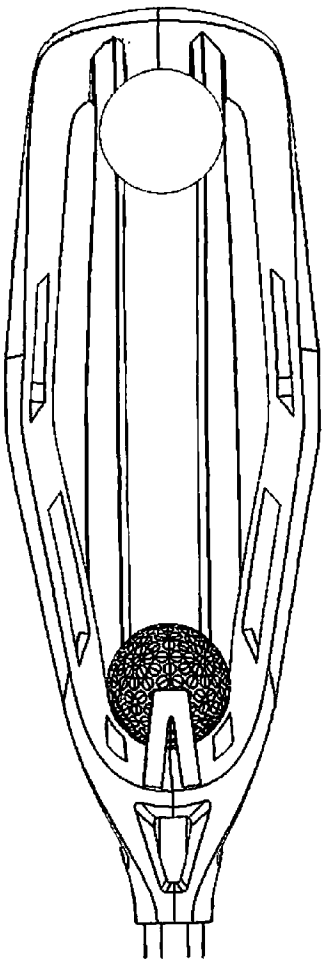

FIG. 64A illustrates an embodiment of the throwing head, from a front perspective, with a specialty projectile (indicated as a dimpled sphere) seated in a pocket. Illustrated at the distal end of the throwing head is the position of the projectile as it approaches a point of launch.

FIG. 64B illustrates an embodiment of the throwing head, from a partial front perspective, with a specialty projectile (indicated as a dimpled sphere) seated in a pocket. Illustrated at the distal end of the throwing head is the position of the projectile as it approaches a point of launch. The distal end of the throwing head 64B-1 defines a notch 64B-2, optimally created to avoid contact between the projectile and the throwing head as the projectile travels on the throwing ramp 64B-3.

FIG. 64C illustrates an embodiment of the throwing head, from a side perspective. The throwing ramp illustrated defines a more shallow curvature arc than, for example, the embodiments illustrated in FIG. 62A, FIG. 62B, and FIG. 62B.

Figure 65:
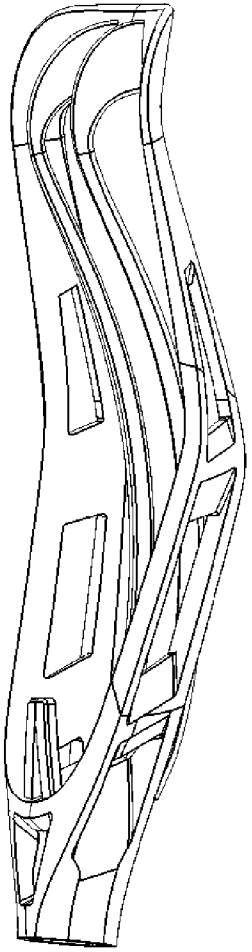
FIG. 65 illustrates an embodiment of the throwing head.

FIG. 65 illustrates an embodiment of the throwing head, from a partial side perspective. The throwing ramp is depicted as widening at the distal end in order to provide more material with which to physically bond the throwing ramp and the remainder of the throwing head. A stronger mechanical union at this joint is desirable to prevent breakage or deformation of the throwing ramp when force is exerted upon it when a projectile is thrown.

Figure 66:
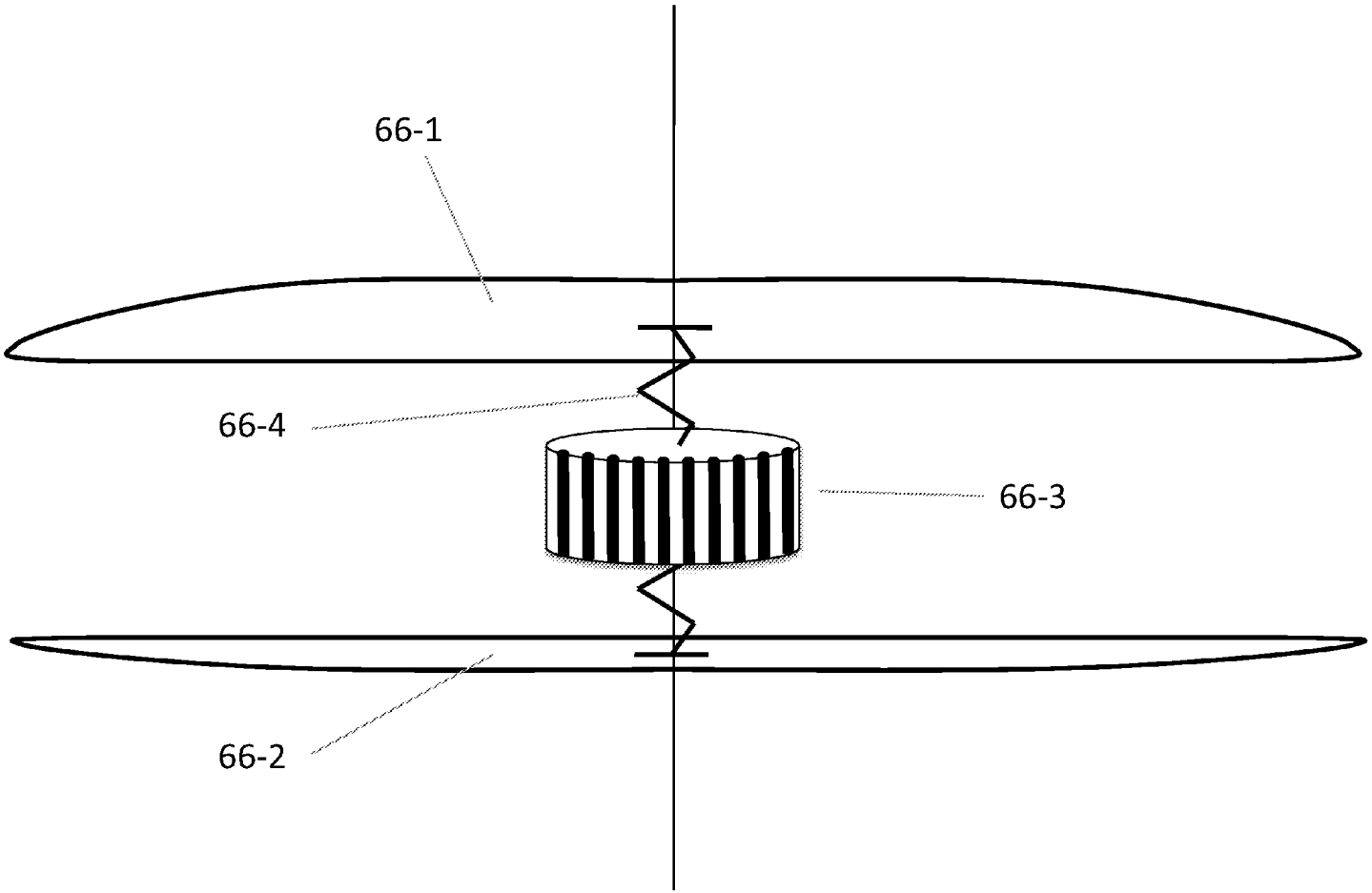
FIG. 66 illustrates an embodiment of a specialty projectile.

FIG. 66 illustrates a specialty projectile, in cutaway profile view, comprising a first part 66-1, a second part 66-2, and a mating part 66-3 with a spring tensioning element 66-4. The first part defines an upper surface with a leading edge portion and the second part defines a lower surface with a leading edge portion. The mating part 66-3 is depicted with gears, being designed to mate with a friction-based engager on a throwing ramp.

Figure 67:
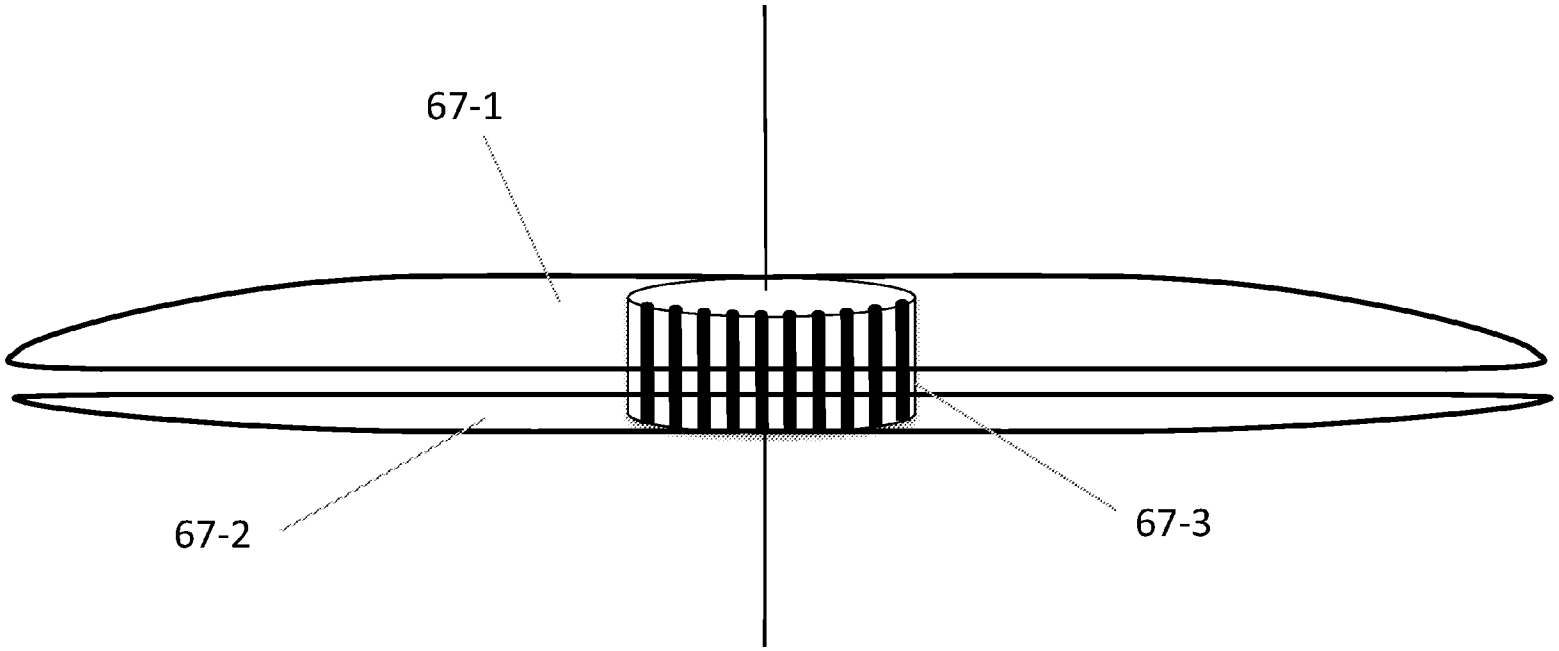
FIG. 67 illustrates an embodiment of a specialty projectile.

FIG. 67 illustrates a specialty projectile, in cutaway profile view, comprising a first part 67-1, a second part 67-2, and a mating part 67-3. This figure illustrates the first part and the second part being in assemblage with the mating part 67-3 and being slightly opened to allow a throwing head member to be inserted to engage the mating part 67-3 for throwing.

Figure 68:
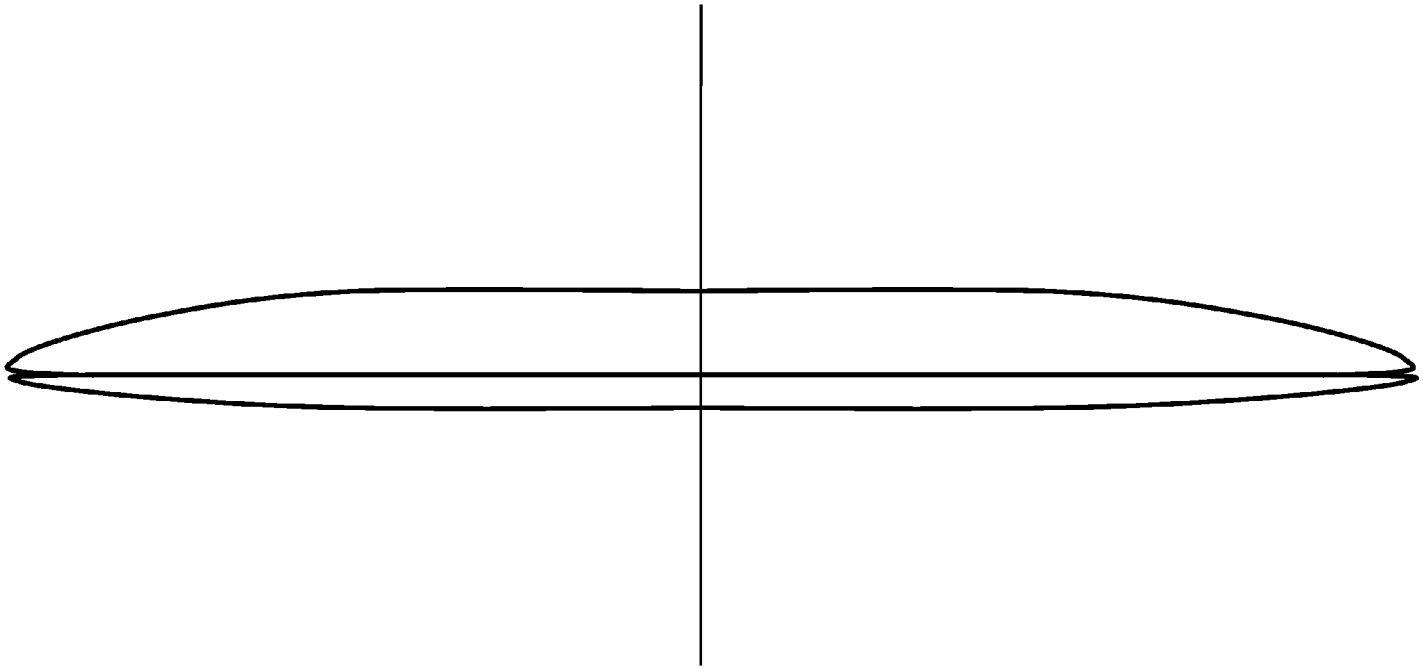
FIG. 68 illustrates an embodiment of a specialty projectile.

FIG. 68 illustrates a specialty projectile, in cutaway profile view, and as it may appear in flight, wherein the first part 66-1 and the second part 66-2 have been drawn closer together to form an aerodynamic assemblage profile.

Figures 69A, 69B:
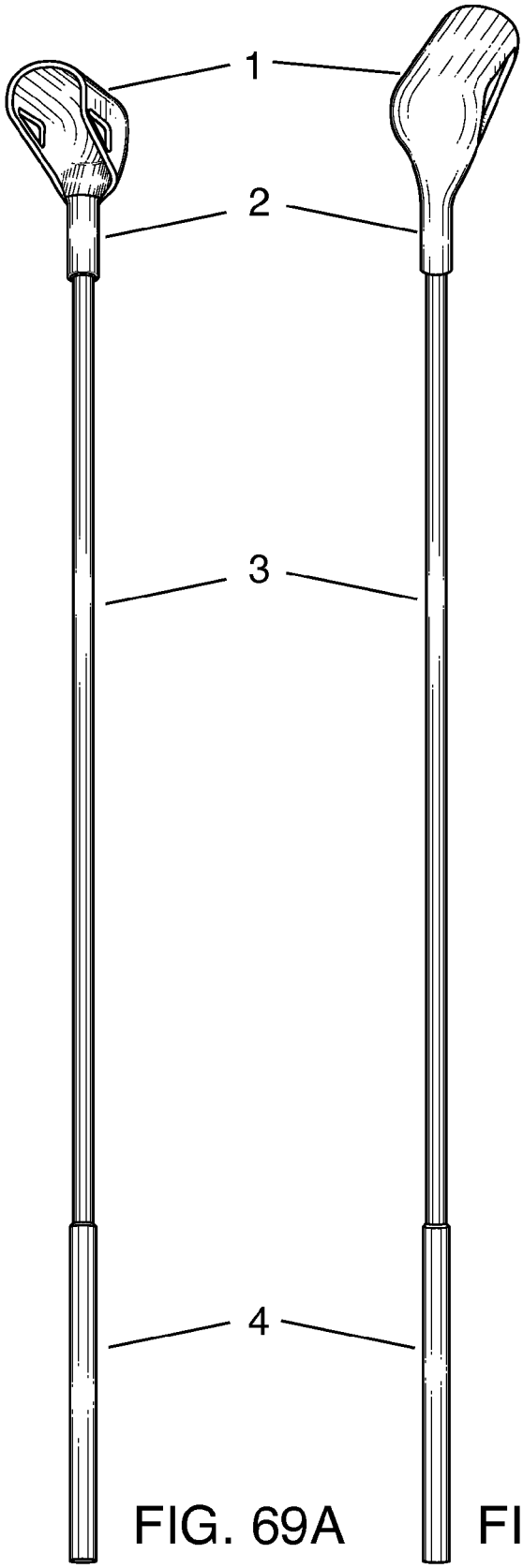
FIGS. 69A-69J illustrate an embodiment of the throwing apparatus from different perspectives.

FIGS. 69A-69J each illustrates an embodiment of the throwing apparatus or throwing head from different perspectives and as described herein. FIG. 69A illustrates a front perspective view of an embodiment of the throwing apparatus, including the scoop-shaped throwing head 69-1 (as described herein, such as with respect to FIGS. 5, 6A, 8, and 9) connected via a throwing head connector 69-2 to a shaft 69-3 that has a handle 69-4. A throwing head connector may function with the neck portion 69-2, for example a connecting bolt fastener passing through a hole in the neck portion 69-2. FIG. 69A shows generally an elongate shaft 69-3, a handle 69-4 at one end of the elongate shaft 69-3, and at the other end of the elongate shaft 69-3 a scoop-shaped throwing head of relatively small dimension (as compared to the length of the elongate shaft 69-3) configured to accommodate, for example, a golf ball-sized projectile in a pocket sized therefor, wherein the throwing head has a strut or support lattice member that connects near the distal end of the throwing head and near the proximal end of the channel of the throwing head. The width of the channel in the throwing head 69-1, as described above and shown for example in FIGS. 1C and 1D, may be substantially uniform throughout its height. Throwing head 69-1 width may be defined by relatively parallel sidewalls, the sidewalls having a height about at least half the diameter of the projectile, as was described above and shown in, for example, FIGS. 1C, 1D, 8, 9, 10, and 13. Throwing head neck portion 69-2 is similar to that portion shown in FIGS. 5, 6A, 6B, 6C, 7, 8, and 9, and is sized to accept elongate shaft 69-3. Elongate shaft 69-3 may be a golf shaft, as described above. The length of the elongate shaft 69-3 may be about 24 to 72 inches and is here shown to be about 46 inches. The handle 69-4, as described above and shown in FIG. 13, may be a standard golf grip.

FIG. 69B illustrates a back perspective view of an embodiment of the throwing apparatus, including throwing head and the entire shaft. The exterior closed end of the throwing head 69-1 is shown in the back perspective view to be a substantially rounded shape, as shown for example in FIGS. 6 and 8.

Figure 69C:
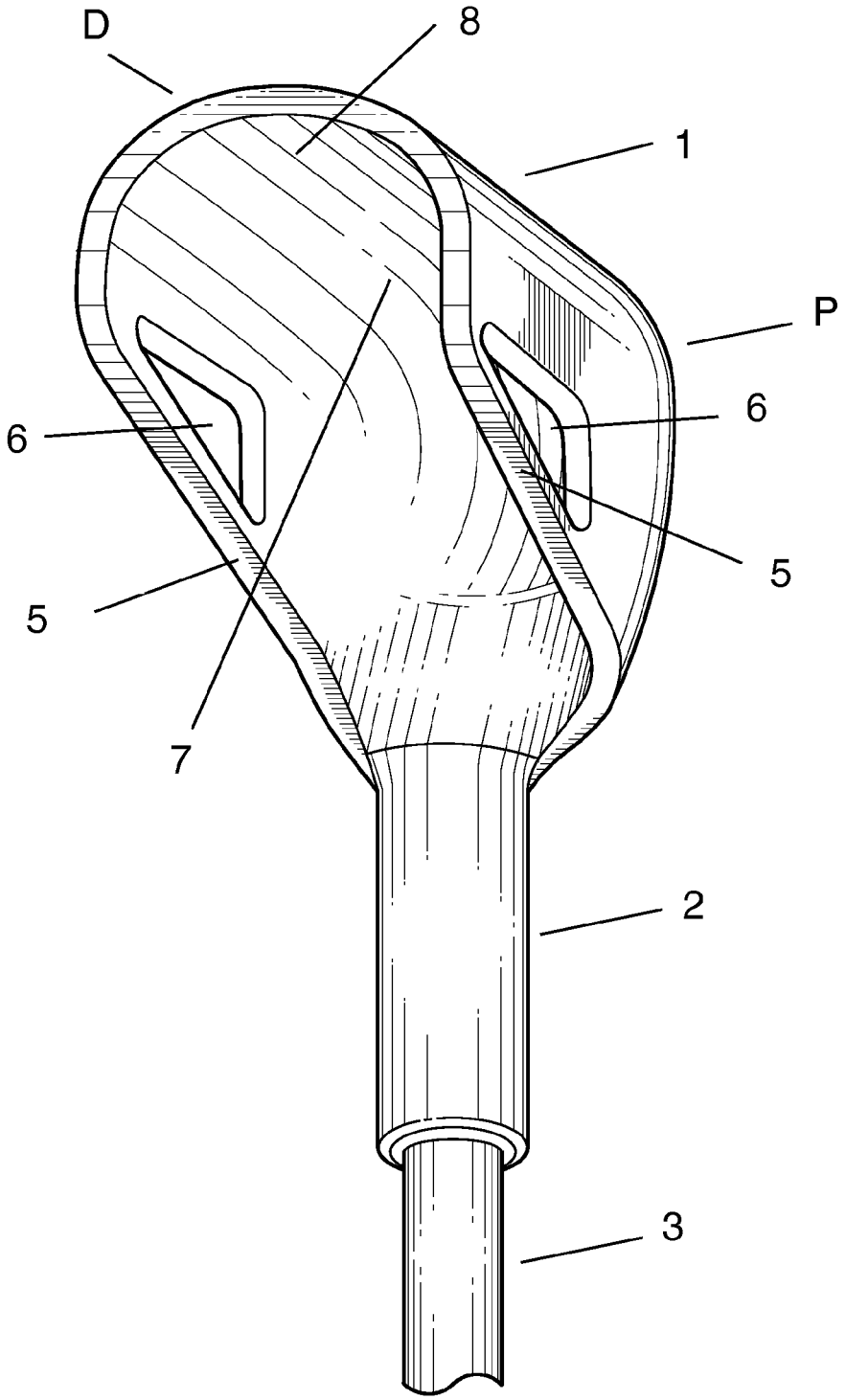

FIG. 69C illustrates a front perspective view of an embodiment of the throwing head, the throwing head 69-1 having a lattice member 69-5 (similar to lattice members shown in the embodiments of FIGS. 1A, 1B, 5, 6A, 6B, 6C, 9, and 15, among others), an opening 69-6 that is defined in part by lattice member 69-5 (similar to the opening formed in part by lattice members shown in the embodiments of FIGS. 1A, 1B, 5, 6A, 6B, 6C, 9, 15, 29, and 30 among others, some being of substantially triangular or trapezoidal or regular geometrical shape), a throwing ramp 69-7 with a terminus 69-8 (which may have added thereto a retrograde terminus, as in FIGS. 6A and 8), a proximal end P (in the length dimension) defined by a back wall, and a distal end D in the length and height dimension.

Figure 69D:
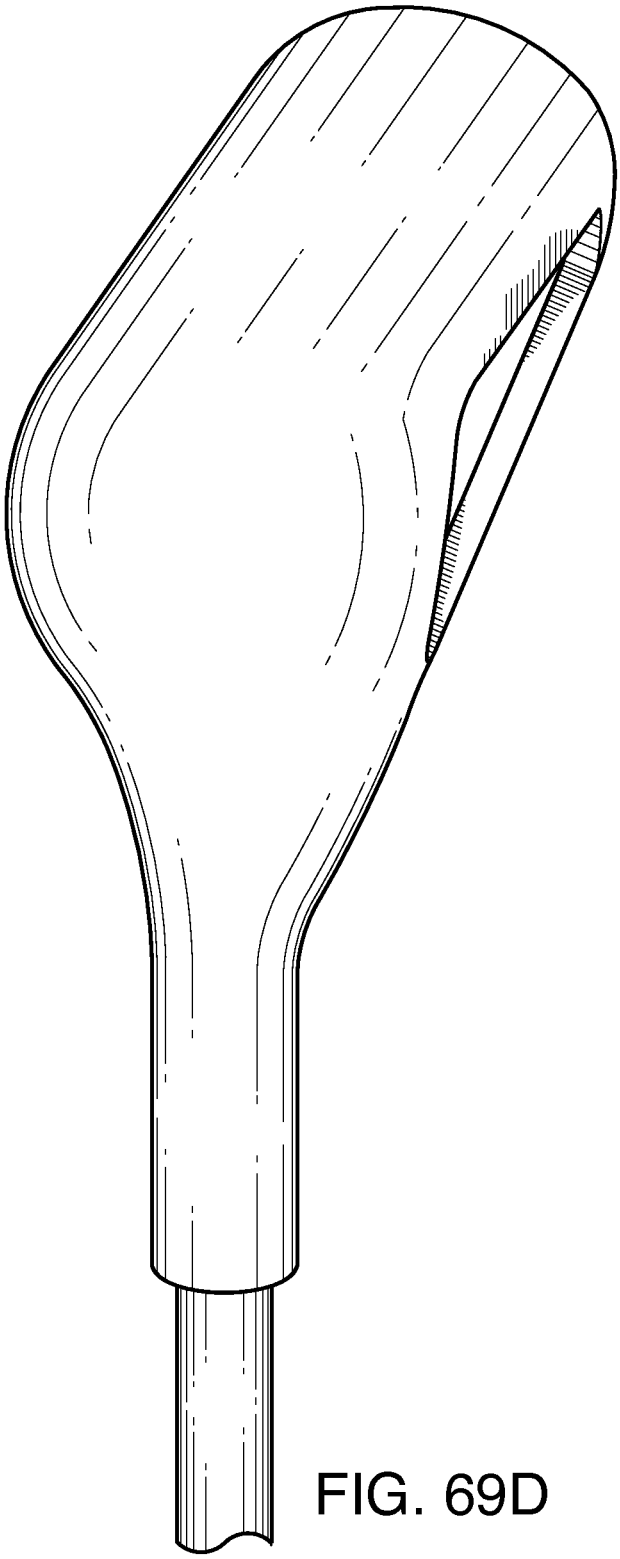
Figure 69E:
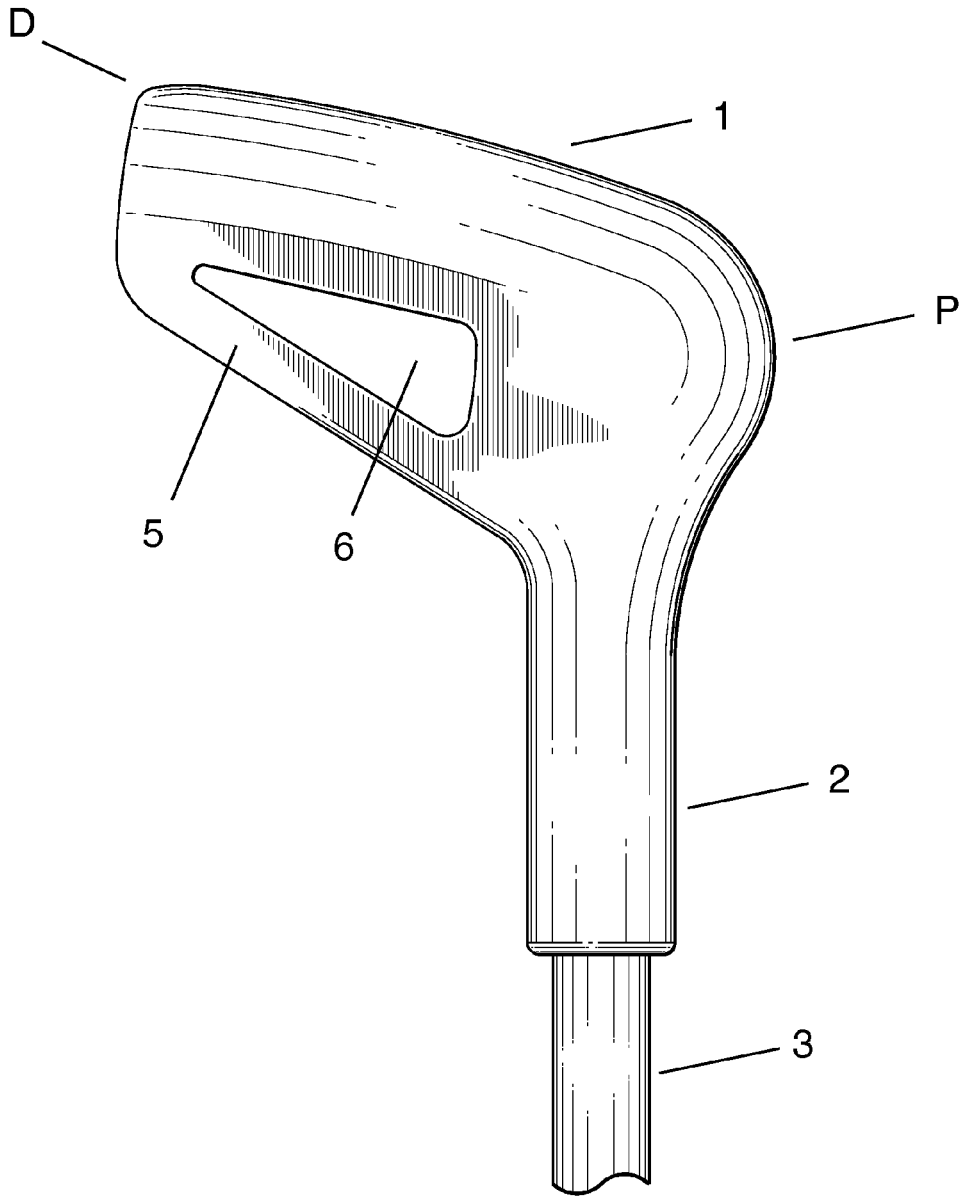
Figure 69F:
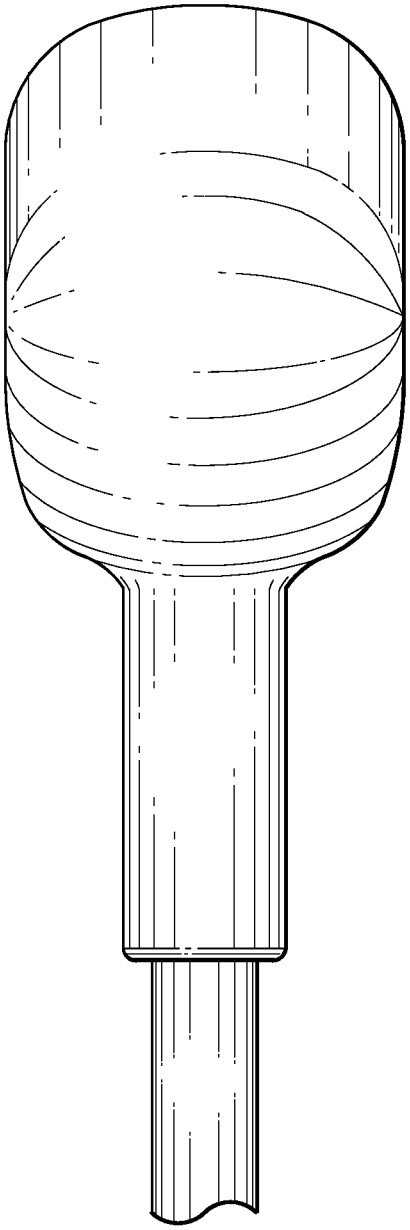
Figure 69G:
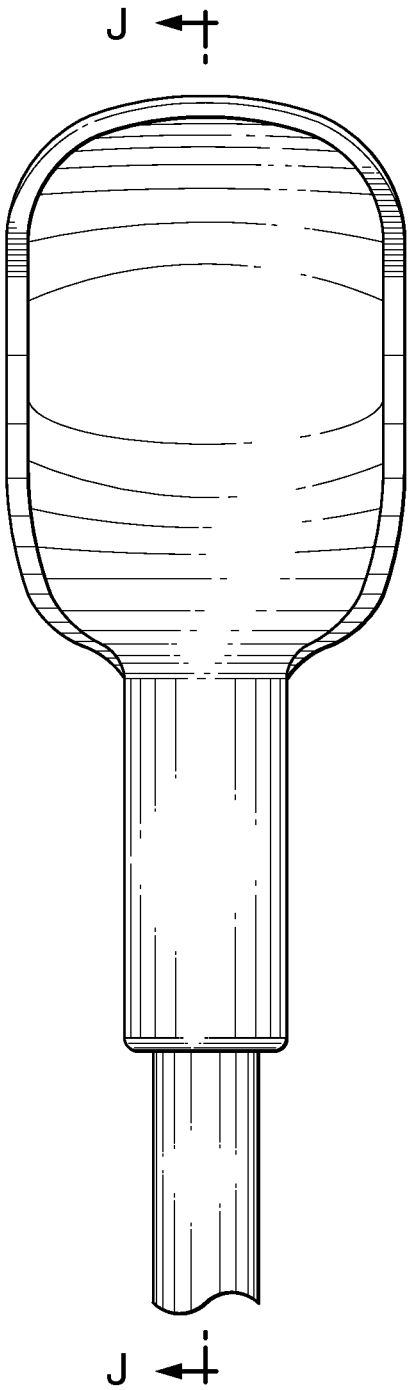
Figure 69H:
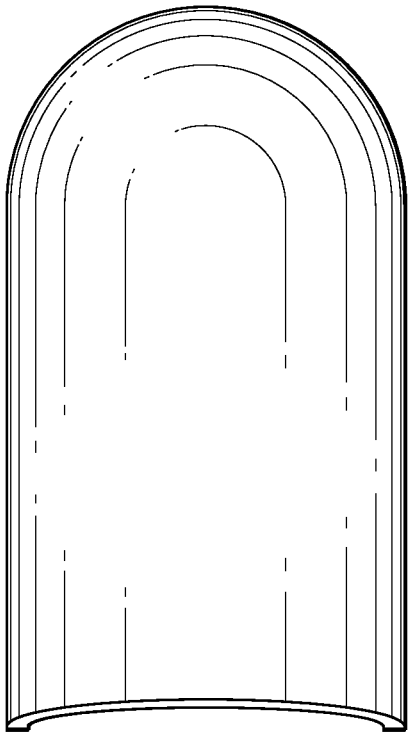
Figure 69I:
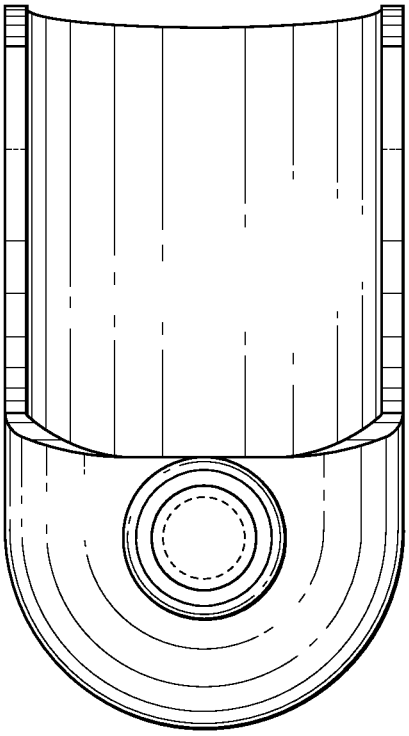
Figure 69J:
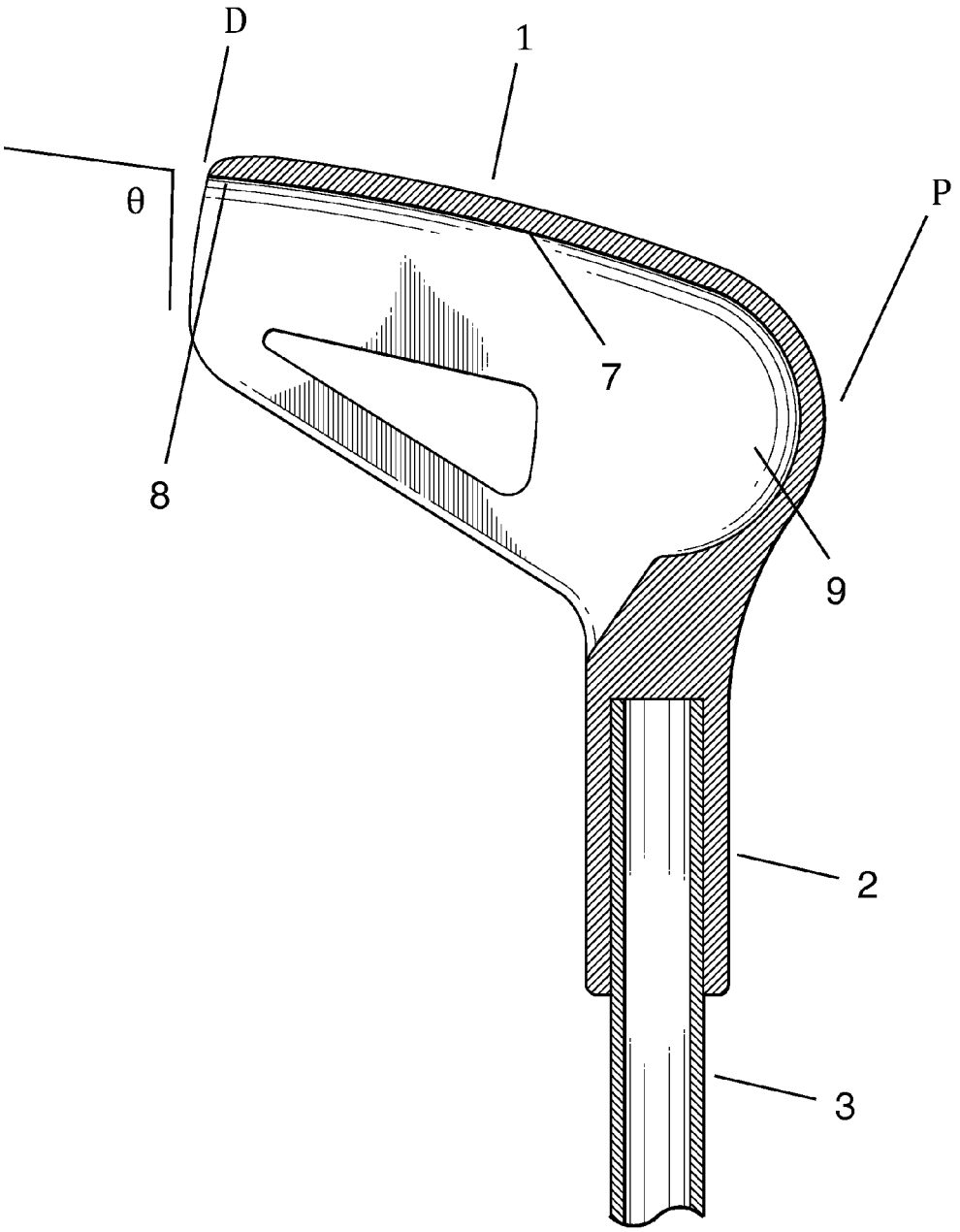

FIG. 69D illustrates a back perspective view of an embodiment of the throwing head. FIG. 69E illustrates a side view of an embodiment of the throwing head, showing throwing head 69-1, throwing head neck or throat portion 69-2, lattice member 69-5, opening 69-6, a proximal end P (in the length dimension) defined by a back wall, and a distal end D in the length and height dimension. FIG. 69F illustrates a back view of an embodiment of the throwing head. FIG. 69G illustrates a front view of an embodiment of the throwing head. FIG. 69H illustrates a top view of an embodiment of the throwing head. FIG. 69I illustrates a bottom view of an embodiment of the throwing head. FIG. 69J illustrates a cut-away side view of an embodiment of the throwing head 69-1 taken at section lines J-J of FIG. 69G, the view showing throwing head 69-1, throwing head neck or throat portion 69-2, a proximal end P (in the length dimension) defined by a back wall, a distal end D in the length and height dimension, a cup or pocket 9 defined in part by the back wall, a throwing ramp 69-7 having a terminus 69-8 and defining a throwing angle theta, (θ), which is described above and shown throughout the figures as being about 90 degrees to about 180 degrees with respect to the longitudinal axis of the shaft.

Titles, headers and section divisions within this disclosure are meant as navigational aids and are not meant to limit the scope of the disclosure. While multiple implementations have been illustrated and described in detail, it should be understood that various modifications in system and method design and details of construction are possible without departing from the spirit and scope of the disclosure.

The features and attributes of the specific embodiments disclosed above may be combined in different ways to form additional embodiments, all of which fall within the scope of the present disclosure. Although the present disclosure provides certain embodiments and applications, other embodiments that are apparent to those of ordinary skill in the art, including embodiments which do not provide all of the features and advantages set forth herein, are also within the scope of this disclosure.

What is claimed is:

1. A projectile throwing apparatus configured for use with a game ball, said apparatus comprising:

a shaft having a first end and a second end;

a rigid head provided at the second end of the shaft;

the head defining a center wall and a plurality of side walls, said side walls substantially parallel to each other, each of said side walls further comprising at least one lattice member, said side walls having situated therebetween said center wall, said side walls and said center wall defining a channel configured to facilitate throwing a golf ball, wherein the channel is between approximately 1.65 inches and approximately 2.3 inches in width and between approximately 2 inches and approximately 5 inches in length, wherein said shaft is between approximately 30 and approximately 72 inches long, wherein said shaft defines a longitudinal shaft axis and the channel defines a channel axis along its length, wherein the shaft axis and channel axis intersect at an obtuse angle, and wherein at least one of the side wall lattice members, or a combination of said sidewall lattice members, or a combination of at least one of said sidewall lattice members and any other portion of the rigid head, defines an exterior surface configured for putting said golf ball.

2. The projectile throwing apparatus as defined in claim 1, wherein at least one of the side wall lattice members at least partially defines a pocket, or at least one aperture, that is configured for receiving a portion of the golf ball and inhibiting movement of the golf ball when the golf ball is positioned at an end of the channel adjacent the shaft.

3. The projectile throwing apparatus as defined in claim 1, wherein the head includes a back wall defining an end of the channel adjacent the shaft, and wherein the back wall has an interior surface defining a back wall radius that is configured to cup a golf ball, whereby the golf ball fits within the interior surface when the golf ball is positioned at the end of the channel adjacent the shaft.

4. The projectile throwing apparatus as defined in claim 1, wherein at a closed end of the channel the sidewalls are positioned between approximately 1.65 inches and approximately 2.3 inches apart and wherein at an open end of the channel the sidewalls are positioned between approximately 1.65 inches and approximately 2.3 inches apart.

5. The projectile throwing apparatus as defined in claim 1, wherein the channel is defined by substantially smooth surfaces.

6. The projectile throwing apparatus as defined in claim 1, wherein each of said side walls defines an opening therein.

7. The projectile throwing apparatus as defined in claim 1, wherein each of said side walls defines a substantially flat interior surface, said head configured such that at least one of said interior surfaces directly contacts said golf ball during launch of said golf ball from said projectile throwing apparatus.

8. The projectile throwing apparatus as defined in claim 1, wherein said exterior surface is substantially flat.

9. A projectile throwing apparatus configured for use with a game ball, said apparatus comprising:

a shaft having a first end and a second end, where the first end is configured for gripping a shaft; and a rigid head provided at the second end of the shaft, wherein the rigid head has (i) a neck configured for attachment to the shaft, (ii) a back wall that extends from the neck, curves in a radius, and is configured to seat a golf ball, (iii) a center wall that extends from the back wall, the center wall configured to allow the golf ball to travel from the back wall and along the center wall without interruption when the golf ball is thrown from the projectile throwing apparatus, and (iv) side walls extending from at or near the back wall, wherein the center wall and the side walls define a channel having a length that extends from the back wall to an open end located distal from the back wall, the open end configured to release the golf ball therethrough when the golf ball is thrown from the projectile throwing apparatus, wherein said shaft defines a longitudinal shaft axis and the channel defines a channel axis along its length, wherein the shaft axis and channel axis intersect at a substantially fixed, obtuse angle, wherein the channel is between approximately 1.65 inches and approximately 2.3 inches in width along its length, wherein the length of the channel is between approximately 3 and approximately 12 inches, wherein the shaft is between approximately 30 and approximately 72 inches long, and wherein the center wall extends from the back wall in a straight or curved path toward the open end along a path distance of at least 2.5 inches, wherein the projectile throwing apparatus, when applying centrifugal force to the golf ball, is configured to move the golf ball uninterrupted along the path before the golf ball exits the open end of the channel.

10. The projectile throwing apparatus of claim 9, wherein the channel is between approximately 3 and approximately 6 inches long.

11. The projectile throwing apparatus of claim 9, the head further comprising at least one lattice member in each side wall, wherein at least one of the side wall lattice members, or a combination of the sidewall lattice members, defines a pocket, or at least one aperture, that is configured to receive a portion of the golf ball when the golf ball is positioned against the back wall.

12. The projectile throwing apparatus of claim 11, wherein at least one aperture is a closed polygon or at least partially round.

13. The projectile throwing apparatus of claim 9, wherein the side walls are configured to guide the golf ball, when thrown, through the channel and are sized in height to prevent the golf ball, when thrown, from leaving the channel at an angle substantially different from an exit angle defined by the path.

14. The projectile throwing apparatus of claim 9, wherein the side walls are at least about 0.8 inches in height and are configured to enable the golf ball to contact at least one sidewall and the center wall when travelling through the channel when the golf ball is being thrown using the projectile throwing apparatus.

15. The projectile throwing apparatus of claim 9, wherein the side walls are substantially parallel to each other, wherein a closed end of the channel separates the sidewalls by between approximately 1.65 inches and approximately 2.3 inches and wherein an open end of the channel separates the sidewalls by between approximately 1.65 inches and approximately 2.3 inches.

16. The projectile throwing apparatus of claim 9, the head further comprising at least one lattice member, wherein at least one of the lattice members, or a combination of lattice members, or a combination of at least one lattice member and any other portion of the rigid head, defines an exterior surface configured for putting the golf ball.

17. The projectile throwing apparatus of claim 9, wherein the head further comprises a plurality of apertures configured for reducing the weight of the head.

18. The projectile throwing apparatus of claim 9, wherein the substantially fixed, obtuse angle is between 90 degrees and approximately 100 degrees.

19. The projectile throwing apparatus of claim 9, wherein the substantially fixed, obtuse angle is between approximately 100 degrees and approximately 110 degrees.

20. The projectile throwing apparatus of claim 9, wherein the substantially fixed, obtuse angle is between approximately 110 degrees and approximately 120 degrees.

21. The projectile throwing apparatus of claim 9, wherein the substantially fixed, obtuse angle is between approximately 120 degrees and approximately 140 degrees.

22. A projectile throwing apparatus configured for use with a game ball, said apparatus comprising:

a shaft having a first end and a second end, where the first end is configured for gripping a shaft, a rigid head provided at the second end of the shaft, wherein the head has (i) a neck configured for attachment to the shaft, (ii) a back wall that extends from the neck, is curved in a radius, and is configured to seat the game ball, (iii) a center wall that extends from the back wall, the center wall configured to allow the game ball to travel from the back wall and along the center wall without interruption when the game ball is thrown from the projectile throwing apparatus, and (iv) side walls that extend from the back wall, said side walls substantially parallel to each other, wherein the center wall and side walls define a channel having a length that extends from the back wall to an open end located distal from the back wall, the open end configured to release the game ball therethrough when the game ball is thrown from the projectile throwing apparatus, wherein the shaft defines a longitudinal shaft axis and the channel defines a channel axis along its length, and wherein the shaft axis and channel axis intersect at a substantially fixed obtuse angle, wherein the channel has a width that is between approximately 1.0 times the diameter of the game ball and approximately 1.4 times the diameter of the game ball, wherein the channel has a length that is between approximately 1.8 times the diameter of the game ball and approximately 7.0 times the diameter of the game ball, wherein the shaft is between approximately 30 and approximately 72 inches long, and wherein the center wall extends from the back wall in a straight or curved path toward the open end along a path distance of at least 1.8 times the diameter of the game ball, wherein the projectile throwing apparatus, when applying centrifugal force to the game ball, is configured to move the game ball uninterrupted along the center wall a distance of at least 1.8 times the diameter of the game ball before the game ball exits the open end of the channel.

23. The projectile throwing apparatus of claim 22, wherein the side walls are at least about one-half the game ball diameter in height and are configured to enable the game ball to contact at least one sidewall and the center wall when travelling through the channel when the game ball is being thrown using the projectile throwing apparatus, and wherein the substantially fixed obtuse angle is between 90 degrees and approximately 135 degrees.

* * * * *